US011220869B2

(12) United States Patent
Rahmani et al.

(10) Patent No.: US 11,220,869 B2
(45) Date of Patent: Jan. 11, 2022

(54) DRILL BIT INSERTS AND DRILL BITS INCLUDING SAME

(71) Applicant: National Oilwell DHT, L.P., Conroe, TX (US)

(72) Inventors: Reza Rahmani, Spring, TX (US); Navid Omidvar, The Woodlands, TX (US); Afshin Babaie Aghdam, The Woodlands, TX (US); Ryan Basson Graham, The Woodlands, TX (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 26 days.

(21) Appl. No.: 16/481,133

(22) PCT Filed: Feb. 1, 2018

(86) PCT No.: PCT/US2018/016495
§ 371 (c)(1),
(2) Date: Jul. 26, 2019

(87) PCT Pub. No.: WO2018/144762
PCT Pub. Date: Aug. 9, 2018

(65) Prior Publication Data

US 2021/0131189 A1 May 6, 2021

Related U.S. Application Data

(60) Provisional application No. 62/453,836, filed on Feb. 2, 2017.

(51) Int. Cl.
*E21B 10/567* (2006.01)
*E21B 10/43* (2006.01)
(Continued)

(52) U.S. Cl.
CPC ..... *E21B 10/5673* (2013.01); *E21B 10/43* (2013.01); *E21B 10/52* (2013.01); *E21B 10/627* (2013.01)

(58) Field of Classification Search
CPC .... E21B 10/5673; E21B 10/627; E21B 10/52; E21B 10/43
See application file for complete search history.

(56) References Cited

U.S. PATENT DOCUMENTS 3,153,458 A 10/1964 William
4,108,260 A 8/1978 Bozarth
(Continued)

OTHER PUBLICATIONS

PCT/US2018/016495 International Search Report and Written Opinion dated Apr. 24, 2018 (15 p.).
(Continued)

*Primary Examiner* — Blake E Michener
(74) *Attorney, Agent, or Firm* — Conley Rose, P.C.

(57) ABSTRACT

An insert for a drill bit includes a base portion having a central axis and a formation engaging portion. The formation engaging portion includes an elongate peaked ridge, a first flanking surface extending from the peaked ridge, and a second flanking surface extending from the peaked ridge. The first flanking surface is defined by a first curve rotated about a first axis and the second flanking surface is defined by a second curve rotated about a second axis. The first axis and the second axis are disposed in a reference plane that bisects the base portion and contains the central axis of the base portion. The first axis is disposed at a first radius measured in the reference plane and the second axis is disposed at a second radius measured in the reference plane. The first radius is different from the second radius.

24 Claims, 33 Drawing Sheets

(51) Int. Cl.
*E21B 10/52* (2006.01)
*E21B 10/627* (2006.01)

(56) References Cited

U.S. PATENT DOCUMENTS 4,554,986 A 11/1985 Jones
4,889,017 A 12/1989 Fuller et al.
5,056,382 A 10/1991 Clench
5,090,492 A * 2/1992 Keith ..... E21B 10/43 175/408
5,172,777 A * 12/1992 Siracki ..... E21B 10/16 175/374
5,172,779 A * 12/1992 Siracki ..... E21B 10/52 175/420.1
5,244,039 A 9/1993 Newton, Jr. et al.
5,322,138 A * 6/1994 Siracki ..... E21B 10/56 175/374
5,505,273 A 4/1996 Azar et al.
5,706,906 A * 1/1998 Jurewicz ..... E21B 10/5673 175/428
6,021,858 A 2/2000 Southland
6,059,054 A * 5/2000 Portwood ..... E21B 10/16 175/430
6,095,265 A 8/2000 Alsup
6,161,634 A * 12/2000 Minikus ..... E21B 10/16 175/331
6,196,340 B1 * 3/2001 Jensen ..... E21B 10/52 175/431
6,298,930 B1 10/2001 Sinor et al.
6,408,958 B1 6/2002 Isbell et al.
6,460,631 B2 10/2002 Dykstra et al.
6,659,199 B2 * 12/2003 Swadi ..... E21B 10/43 175/57
6,779,613 B2 8/2004 Dykstra et al.
6,883,623 B2 * 4/2005 McCormick ..... E21B 10/46 175/408
6,935,441 B2 8/2005 Dykstra et al.
7,096,978 B2 8/2006 Dykstra et al.
7,631,709 B2 * 12/2009 McDonough ..... E21B 10/52 175/374
7,798,258 B2 * 9/2010 Singh ..... E21B 10/16 175/430
7,814,990 B2 10/2010 Dykstra et al.
8,028,773 B2 * 10/2011 Singh ..... E21B 10/58 175/430
8,459,382 B2 * 6/2013 Aliko ..... E21B 10/62 175/408
8,794,356 B2 * 8/2014 Lyons ..... E21B 10/5673 175/431
8,863,860 B2 10/2014 Chen et al.
9,097,065 B2 8/2015 Schwefe et al.
9,284,786 B2 3/2016 Haugvaldstad
9,291,002 B2 3/2016 Overstreet et al.
10,480,254 B2 * 11/2019 Lyons ..... E21B 10/567
10,590,710 B2 * 3/2020 Vempati ..... E21B 10/42
10,697,248 B2 * 6/2020 Russell ..... E21B 10/43
2004/0173384 A1 * 9/2004 Yong ..... E21B 10/52 175/374
2005/0023043 A1 * 2/2005 Tufts ..... E21B 10/52 175/374
2005/0263327 A1 * 12/2005 Meiners ..... E21B 10/52 175/430
2007/0278015 A1 * 12/2007 Boudrare ..... E21B 10/16 175/374
2008/0156543 A1 * 7/2008 McDonough ..... E21B 10/50 175/336
2008/0302575 A1 12/2008 Durairajan et al.
2010/0276200 A1 11/2010 Schwefe et al.
2010/0300766 A1 12/2010 Fan et al.
2011/0192651 A1 * 8/2011 Lyons ..... E21B 10/5673 175/428
2011/0266070 A1 * 11/2011 Scott ..... E21B 10/5673 175/428
2013/0199856 A1 8/2013 Bilen et al.
2015/0322726 A1 11/2015 Bilen et al.
2015/0330153 A1 11/2015 Miller et al.
2017/0096859 A1 * 4/2017 Spencer ..... E21B 10/46
2019/0010764 A1 * 1/2019 Lyons ..... E21B 10/567
2019/0100967 A1 * 4/2019 Russell ..... E21B 10/56
2020/0256132 A1 * 8/2020 Grimes ..... E21B 10/43

OTHER PUBLICATIONS

PCT/US2018/016495 Article 19 Amendments filed Feb. 1, 2018 (21 p.).
Examination Report dated Jun. 21, 2021 for GB Application No. 1910719.2 (2 p.).

* cited by examiner

DRILL BIT INSERTS AND DRILL BITS INCLUDING SAME

CROSS-REFERENCE TO RELATED APPLICATIONS

This application is a 35 U.S.C. § 371 national stage application of PCT/US2018/016495 filed Feb. 1, 2018, and entitled "Drill Bit Inserts and Drill Bits Including Same," which claims benefit of U.S. provisional patent application Ser. No. 62/453,836 filed Feb. 2, 2017, and entitled "Drilling Depth of Cut Control Features and Drill Bits Including Same," each of which is hereby incorporated herein by reference in its entirety for all purposes.

STATEMENT REGARDING FEDERALLY SPONSORED RESEARCH OR DEVELOPMENT

Not applicable.

BACKGROUND

The disclosure relates generally to drill bits for drilling a borehole in an earthen formation for the ultimate recovery of oil, gas, or minerals. More particularly, the disclosure relates to fixed cutter bits and to depth-of-cut control features to manage the torque-on-bit applied to such bits.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Fixed cutter bits, also known as rotary drag bits, are one type of drill bit commonly used to drill boreholes. Fixed cutter bit designs include a plurality of blades angularly spaced about the bit face. The blades generally project radially outward along the bit body and form flow channels there between. In addition, cutter elements are often grouped and mounted on several blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PD") material. In the typical fixed cutter bit, each cutter element or assembly comprises an elongate and generally cylindrical support member which is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, reference to "PDC bit" or "PDC cutter element" refers to a fixed cutter bit or cutting element employing a hard cutting layer of polycrystalline diamond or other superabrasive material such as cubic boron nitride, thermally stable diamond, polycrystalline cubic boron nitride, or ultrahard tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the flow passageways between the several blades. The flowing fluid performs several important functions. The fluid removes formation cuttings from the bit's cutting structure. Otherwise, accumulation of formation materials on the cutting structure may reduce or prevent the penetration of the cutting structure into the formation. In addition, the fluid removes cut formation materials from the bottom of the hole. Failure to remove formation materials from the bottom of the hole may result in subsequent passes by cutting structure to re-cut the same materials, thereby reducing the effective cutting rate and potentially increasing wear on the cutting surfaces. The drilling fluid and cuttings removed from the bit face and from the bottom of the hole are forced from the bottom of the borehole to the surface through the annulus that exists between the drill string and the borehole sidewall. Further, the fluid removes heat, caused by contact with the formation, from the cutter elements in order to prolong cutter element life. Thus, the number and placement of drilling fluid nozzles, and the resulting flow of drilling fluid, may significantly impact the performance of the drill bit.

Without regard to the type of bit, the cost of drilling a borehole for recovery of hydrocarbons may be very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is desirable to employ drill bits which will drill faster and longer, and which are usable over a wider range of formation hardness. The length of time that a drill bit may be employed before it must be changed depends upon a variety of factors. These factors include the bit's rate of penetration ("ROP"), as well as its durability or ability to maintain a high or acceptable ROP.

BRIEF SUMMARY OF THE DISCLOSURE

Embodiments of inserts for drill bits are disclosed herein. In one embodiment, an insert for a drill bit comprises a base portion having a central axis and defining a bottom portion of the insert. In addition, the insert comprises a formation engaging portion extending from the base portion and defining an upper portion of the insert. The formation engaging portion comprises a crown with an elongate peaked ridge extending from a first end of the formation engaging portion to a second end of the formation engaging portion. The formation engaging portions also includes a first flanking surface extending from the peaked ridge to a first lateral side of the formation engaging portion and a second flanking surface extending from the peaked ridge to a second lateral side of the formation engaging surface. The first lateral side extends from the first end to the second end and the second lateral side extends from the first end to the second end. The first flanking surface is defined by a first curve in a front profile view of the insert rotated about a first axis from the first end to the second end. The first axis is disposed in a reference plane that bisects the base portion and contains the central axis of the base portion. The first axis is disposed at a first radius measured in the reference plane and perpendicular to the central axis from a top of the peaked ridge to the first axis. The second flanking surface is defined by a second curve in the front profile view of the insert rotated about a second axis from the first end to the second end. The second axis is disposed in the reference plane. The second axis is disposed at a second radius measured in the reference plane and perpendicular to the central axis from the top of the peaked ridge to the second axis. The first radius is different from the second radius.

In another embodiment, an insert for a drill bit comprises a base portion. In addition, the insert comprises a formation engaging portion extending from the base portion. The formation engaging portion has a longitudinal axis and includes a first end, a second end opposite the first end, a first lateral side extending from the first end to the second end, and a second lateral side extending from the first end to the second end, and an elongate crown extending longitudinally from the first end to the second end and laterally from the first lateral side to the second lateral side. The first lateral side has a first radius of curvature in top view of the insert and the second lateral side has a second radius of curvature in top view of the insert. The first radius of curvature is different than the second radius of curvature.

Embodiments of drill bits are disclosed herein. In one embodiment, a drill bit for drilling a borehole in an earthen formation has a central axis and a cutting direction of rotation. The drill bit comprises a bit body configured to rotate about the axis in the cutting direction of rotation. The bit body includes a bit face, a blade extending radially along the bit face, and an insert mounted to a cutter-supporting surface of the blade. The insert comprises a base portion seated in a recess in the cutter-supporting surface. In addition, the insert comprises a formation engaging portion extending from the base portion and the cutter-supporting surface. The formation engaging portion comprises a crown with an elongate peaked ridge extending from a first end of the formation engaging portion to a second end of the formation engaging portion. The formation engaging portion also comprises a first flanking surface extending from the peaked ridge to a first lateral side of the formation engaging portion and a second flanking surface extending from the peaked ridge to a second lateral side of the formation engaging surface. The first lateral side extends from the first end to the second end and the second lateral side extends from the first end to the second end. The first flanking surface is defined by a first curve in a front profile view of the insert rotated about a first axis from the first end to the second end. The first axis is disposed in a reference plane that bisects the base portion and contains the central axis of the base portion, wherein the first axis is disposed at a first radius measured in the reference plane and perpendicular to the central axis from a top of the peaked ridge to the first axis. The second flanking surface is defined by a second curve in the front profile view of the insert rotated about a second axis from the first end to the second end. The second axis is disposed in the reference plane. The second axis is disposed at a second radius measured in the reference plane and perpendicular to the central axis from the top of the peaked ridge to the second axis. The first radius is different from the second radius.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
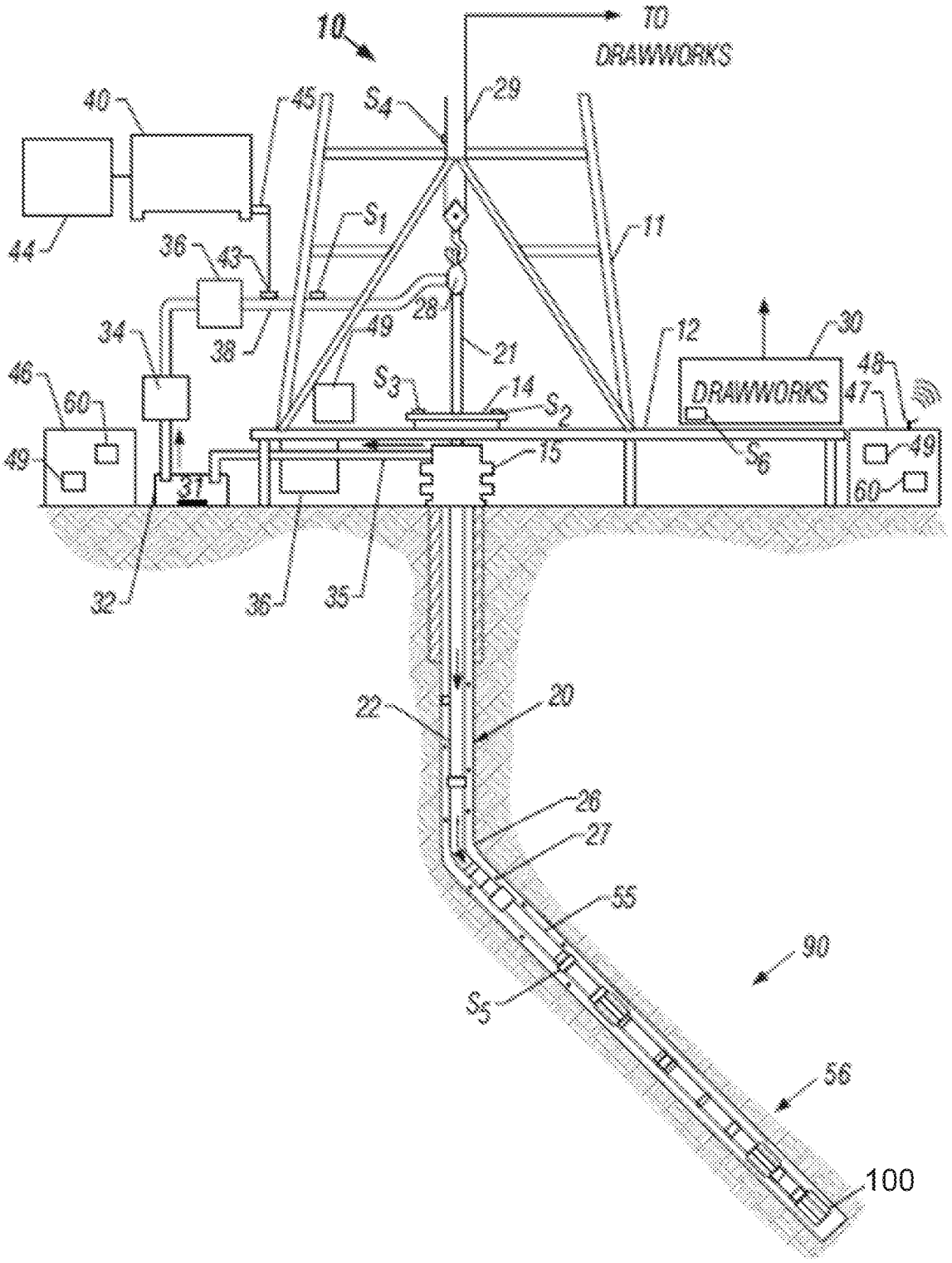
FIG. 1 is a schematic view of a drilling system including an embodiment of a drill bit with a plurality of depth-of-cut limiting inserts in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims will be made for purposes of clarity, with "up", "upper", "upwardly" or "upstream" meaning toward the surface of the borehole and with "down", "lower", "downwardly" or "downstream" meaning toward the terminal end of the borehole, regardless of the borehole orientation.

As previously described, the length of time that a drill bit may be employed before it must be changed depends upon a variety of factors including bit durability. Control over the torque-on-bit (TOB) can improve bit durability by reducing the potential for stick slip, torsional vibrations, and torque oscillations, each of which can damage PDC cutters. One approach for controlling TOB is to limit the maximum depth-of-cut (DOC) of the cutter elements on the bit with one or more dome-shaped inserts mounted to the bit blades preceding or trailing one or more cutter elements. The cutter elements engage the formation before the dome-shaped inserts. When a predetermined DOC is achieved, the dome-shaped inserts come into engagement with and bear against the formation, thereby restricting the cutter elements from cutting deeper into the formation and defining a maximum DOC. Although such dome-shaped inserts present a smooth convex surface to the formation, the relatively small contact surface area between the convex surface and the formation may result in stresses sufficient to crush or break the formation rock as opposed to sliding across the formation rock to control DOC. This may be particularly problematic in softer formations, which yield under lower stress as compared to harder formations.

Embodiments described herein are directed to passive/static DOC limiting structures mounted to the bit blades trailing one or more cutter elements. The cutter elements engage the formation before the DOC limiting structures. However, when a predetermined DOC is achieved, the DOC limiting structures come into engagement with and bear against the formation, thereby restricting the cutter elements from cutting deeper into the formation and defining a maximum DOC. As will be described in more detail below, embodiments of DOC limiting structures described herein seek to increase the contact surface area between the DOC limiting structures and the formation rock, and thus, may be particularly suitable for use in softer formations.

Referring now to FIG. 1, a schematic view of an embodiment of a drilling system 10 in accordance with the principles described herein is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (e.g., rotary table 14) may be augmented or replaced by a top drive suspended in the derrick (e.g., derrick 11) and connected to the drillstring (e.g., drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 and/or a top drive, rotated by downhole mud motor 55 disposed along drillstring 20 proximal bit 100, or combinations thereof (e.g., rotated by both rotary table 14 via drillstring 20 and mud motor 55, rotated by a top drive and the mud motor 55, etc.). For example, rotation via downhole motor 55 may be employed to supplement the rotational power of rotary table 14, if required, and/or to effect changes in the drilling process. In either case, the rate-of-penetration (ROP) of the drill bit 100 into the borehole 26 for a given formation and a drilling assembly largely depends upon the WOB and the rotational speed of bit 100.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
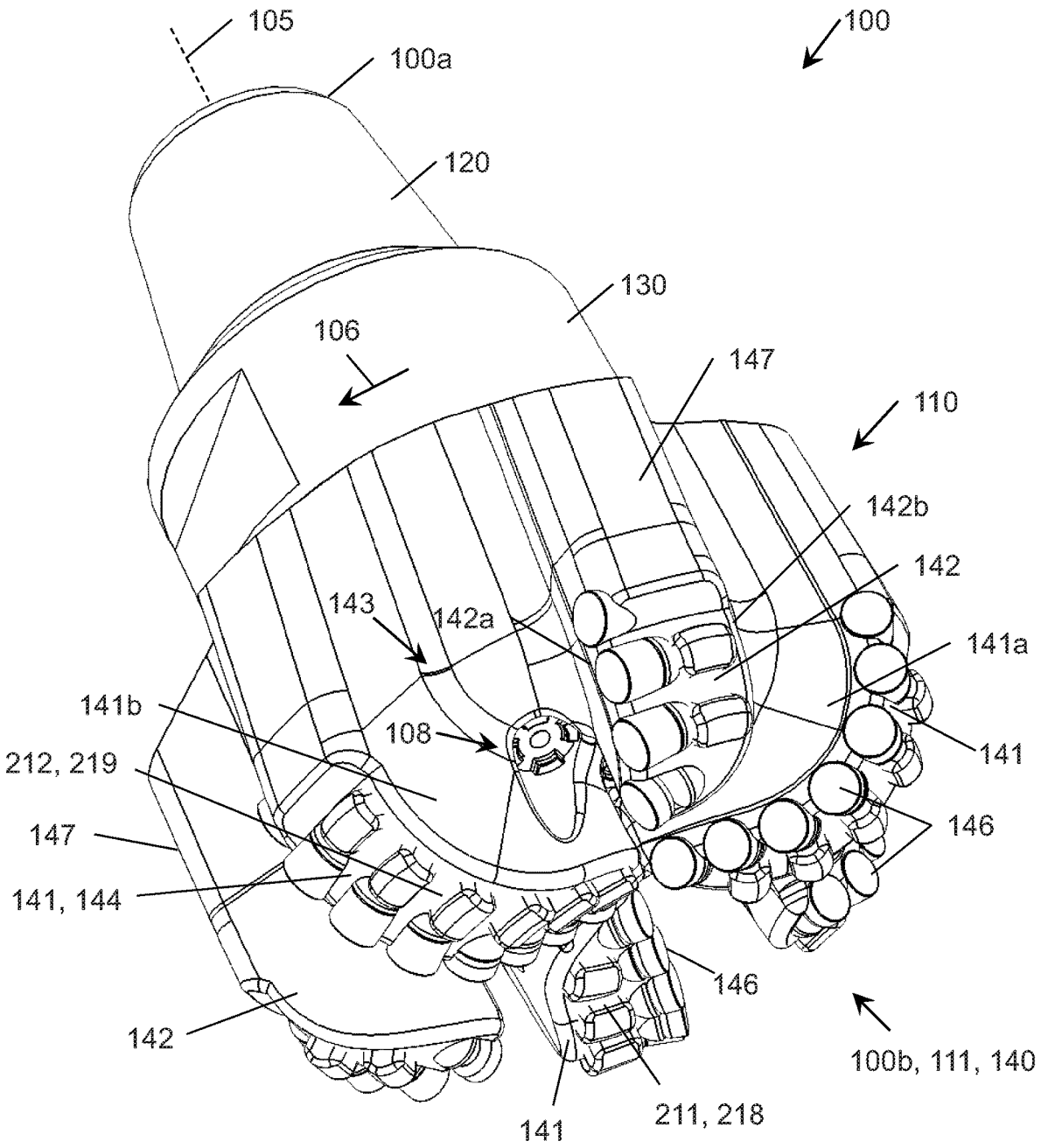
FIG. 2 is a perspective view of the drill bit of FIG. 1.
Figure 3:
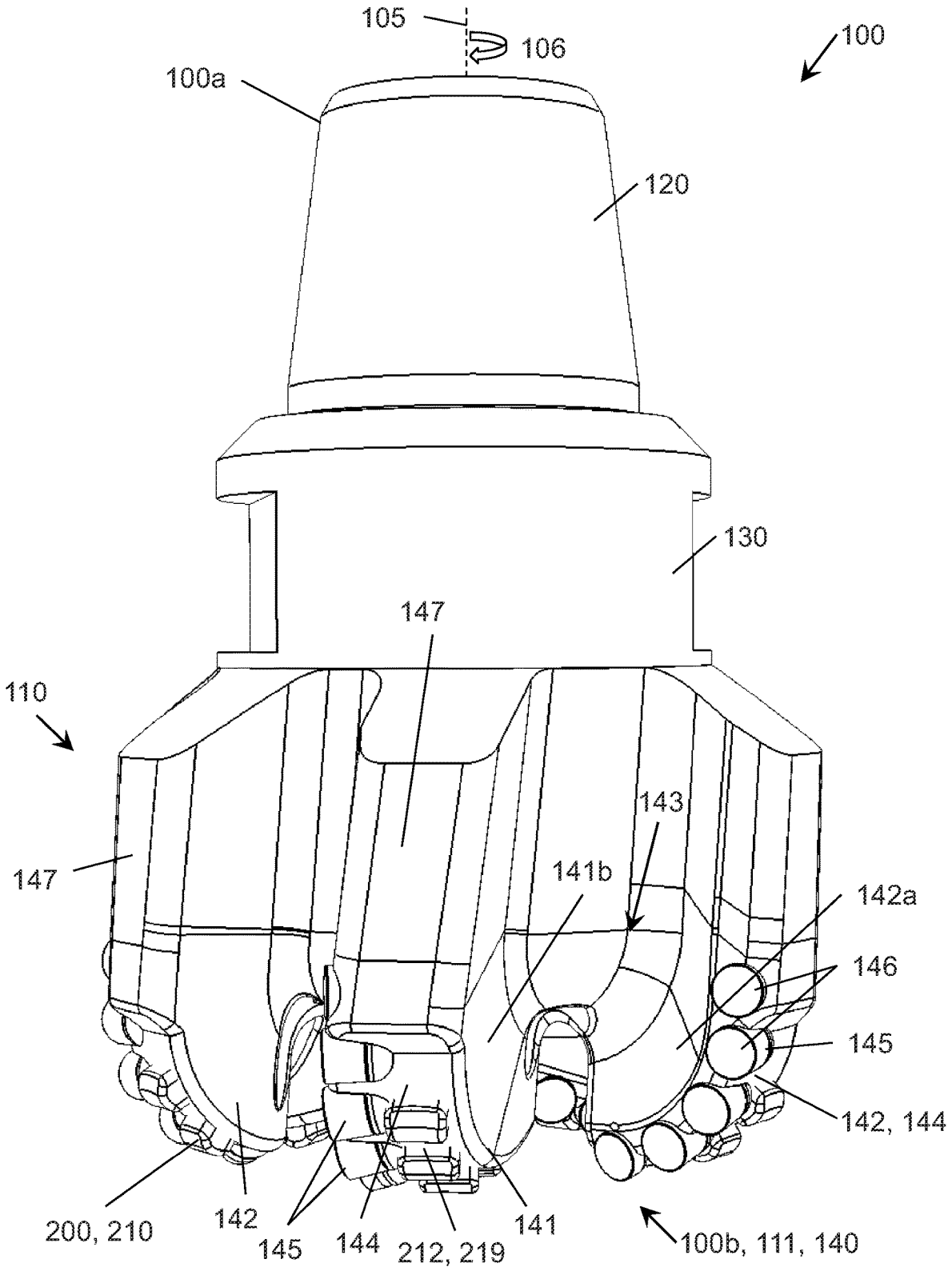
FIG. 3 is a side view of the drill bit of FIG. 2.
Figure 4:
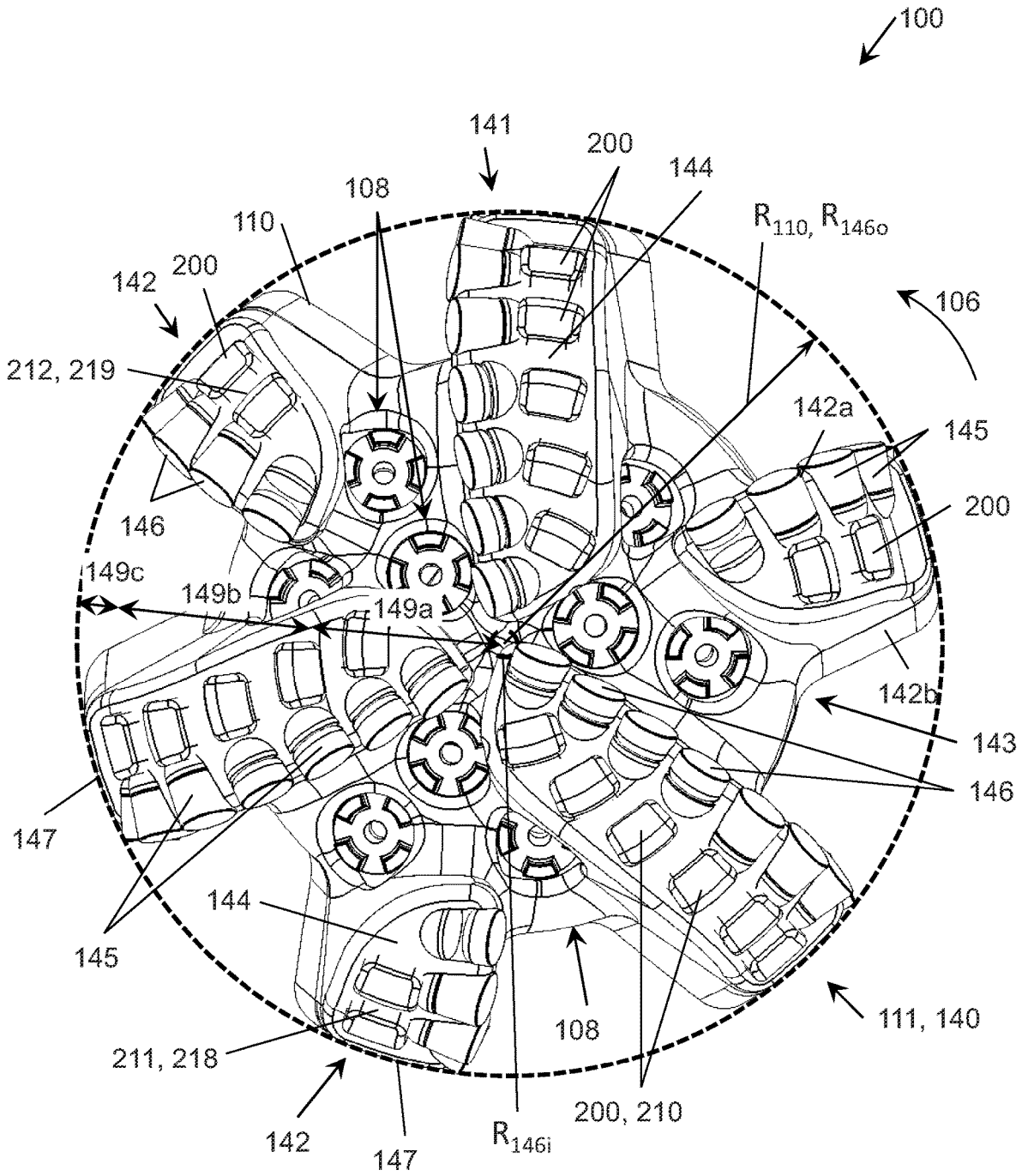
FIG. 4 is an end view of the drill bit of FIG. 2.

Referring now to FIGS. 2-4, drill bit 100 is a fixed cutter bit, sometimes referred to as a drag bit, and is designed for drilling through formations of rock to form a borehole. Bit 100 has a central or longitudinal axis 105, a first or uphole end 100*a*, and a second or downhole end 100*b*. Bit 100 rotates about axis 105 in the cutting direction represented by arrow 106. In addition, bit 100 includes a bit body 110 extending axially from downhole end 100*b*, a threaded connection or pin 120 extending axially from uphole end 100*a*, and a shank 130 extending axially between pin 120 and body 110. Pin 120 couples bit 100 to drill string 20, which is employed to rotate the bit 100 to drill the borehole 26. Bit body 110, shank 130, and pin 120 are coaxially aligned with axis 105, and thus, each has a central axis coincident with axis 105.

The portion of bit body 110 that faces the formation at downhole end 100*b* includes a bit face 111 provided with a cutting structure 140. Cutting structure 140 includes a plurality of blades which extend from bit face 111. As best shown in FIGS. 2 and 4, in this embodiment, cutting structure 140 includes three angularly spaced-apart primary blades 141, and three angularly spaced apart secondary blades 142. Further, in this embodiment, the plurality of blades (e.g., primary blades 141, and secondary blades 142) are uniformly angularly spaced on bit face 111 about bit axis 105. In particular, the three primary blades 141 are uniformly angularly spaced about 120° apart, the three secondary blades 142 are uniformly angularly spaced about 120° apart, and each primary blade 141 is angularly spaced about 60° from each circumferentially adjacent secondary blade 142. In other embodiments, one or more of the blades may be spaced non-uniformly about bit face 111. Still further, in this embodiment, the primary blades 141 and secondary blades 142 are circumferentially arranged in an alternating fashion. In other words, one secondary blade 142 is disposed between each pair of circumferentially-adjacent primary blades 141. Although bit 100 is shown as having three primary blades 141 and three secondary blades 142, in general, bit 100 may comprise any suitable number of primary and secondary blades. As one example only, bit 100 may comprise two primary blades and four secondary blades.

In this embodiment, primary blades 141 and secondary blades 142 are integrally formed as part of, and extend from, bit body 110 and bit face 111. Primary blades 141 and secondary blades 142 extend generally radially along bit face 111 and then axially along a portion of the periphery of bit 100. In particular, primary blades 141 extend radially from proximal central axis 105 toward the periphery of bit body 110. Primary blades 141 and secondary blades 142 are separated by drilling fluid flow courses 143. Each blade 141, 142 has a leading edge or side 141*a*, 142*a*, respectively, and a trailing edge or side 141*b*, 142*b*, respectively, relative to the direction of rotation 106 of bit 100.

Referring still to FIGS. 2-4, each blade 141, 142 includes a cutter-supporting surface 144 for mounting a plurality of cutter elements 145 and a plurality of depth-of-cut (DOC) limiting inserts 200. In particular, cutter elements 145 are arranged adjacent one another in a radially extending row proximal the leading edge of each primary blade 141 and each secondary blade 142, and DOC limiting inserts 200 are arranged adjacent one another in a radially extending row on each primary blade 141 and each secondary blade 142. The row of DOC limiting inserts 200 on each blade 141, 142 trails the row of cutter elements 145 on the same blade 141, 142 relative to the direction of rotation 106 of bit 100. As used herein, the terms "leads," "leading," "trails," and "trailing" are used to describe the relative positions of two structures (e.g., cutter element and DOC limiting structure) on the same blade relative to the direction of bit rotation. In particular, a first structure that is disposed ahead or in front of a second structure on the same blade relative to the direction of bit rotation "leads" the second structure (i.e., the first structure is in a "leading" position), whereas the second structure that is disposed behind the first structure on the same blade relative to the direction of bit rotation "trails" the first structure (i.e., the second structure is in a "trailing" position).

Each cutter element 145 has a cutting face 146 and comprises an elongated and generally cylindrical support member or substrate which is received and secured in a pocket formed in the surface of the blade to which it is fixed. In general, each cutter element may have any suitable size and geometry. In this embodiment, each cutter element 145 has substantially the same size and geometry. Cutting face 146 of each cutter element 145 comprises a disk or tabletshaped, hard cutting layer of polycrystalline diamond or other superabrasive material that is bonded to the exposed end of the support member. In the embodiments described herein, each cutter element 145 is mounted such that its cutting face 146 is generally forward-facing. As used herein, "forward-facing" is used to describe the orientation of a surface that is substantially perpendicular to, or at an acute angle relative to, the cutting direction of the bit (e.g., cutting direction 106 of bit 100). For instance, a forward-facing cutting face (e.g., cutting face 146) may be oriented perpendicular to the direction of rotation 106 of bit 100, may include a backrake angle, and/or may include a siderake angle. However, the cutting faces are preferably oriented perpendicular to the direction of rotation 106 of bit 100 plus or minus a 45° backrake angle and plus or minus a 45° siderake angle. In addition, each cutting face 146 includes a cutting edge adapted to positively engage, penetrate, and remove formation material with a shearing action, as opposed to the grinding action utilized by impregnated bits to remove formation material. Such cutting edge may be chamfered or beveled as desired. In this embodiment, cutting faces 146 are substantially planar, but may be convex or concave in other embodiments.

Depth-of-cut limiting inserts 200 are intended to limit the maximum depth-of-cut of cutting faces 146 as they engage the formation. As will be described in more detail below, each depth-of-cut limiting insert 200 includes an outer formation engaging surface 210 extending from cutter-supporting surface 144 of the corresponding blade 141, 142. Surfaces 210 of inserts 200 are intended to slide across the formation and limit the depth to which cutting faces 146 bite or penetrate into the formation. Thus, unlike cutter elements (e.g., cutter elements 145), depth-of-cut limiting inserts 200 are not intended to penetrate and shear the formation.

Referring still to FIGS. 2-4, bit body 110 further includes gage pads 147 of substantially equal axial length measured generally parallel to bit axis 105. Gage pads 147 are circumferentially-spaced about the radially outer surface of bit body 110. Specifically, one gage pad 147 intersects and extends from each blade 141, 142. In this embodiment, gage pads 147 are integrally formed as part of the bit body 110. In general, gage pads 147 can help maintain the size of the borehole by a rubbing action when cutter elements 145 wear slightly under gage. Gage pads 147 also help stabilize bit 100 against vibration.

Figure 5:
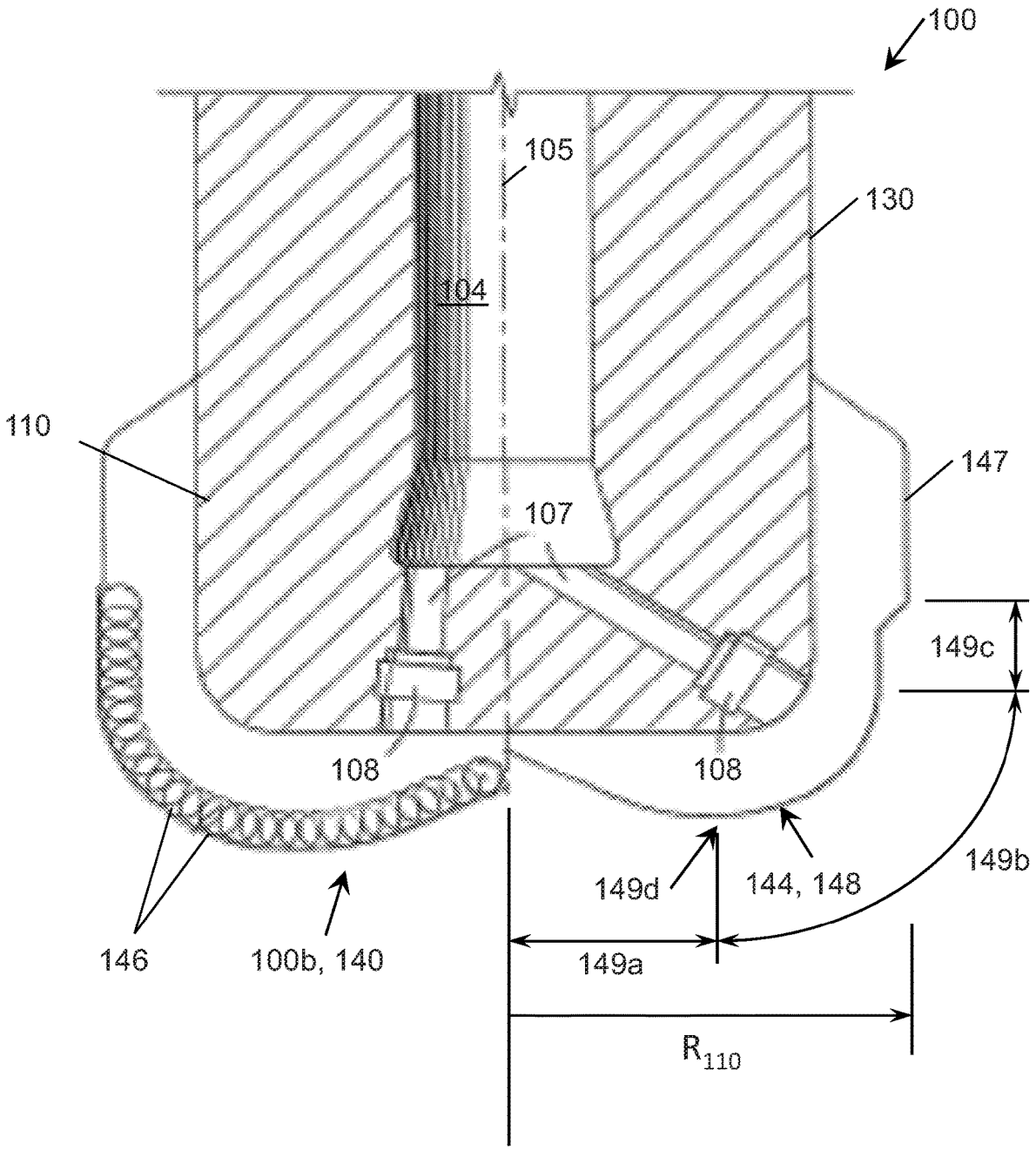
FIG. 5 is a partial cross-sectional view of the bit shown in FIG. 2 with the blades and the cutting faces of the cutter elements rotated into a single composite profile.

Referring now to FIG. 5, an exemplary profile of bit body 110 is shown as it would appear with blades 141, 142 and cutting faces 146 rotated into a single rotated profile. The profiles of depth-of-cut limiting inserts 200 are not shown in this view. In rotated profile view, blades 141, 142 of bit body 110 form a combined or composite blade profile 148 generally defined by cutter-supporting surfaces 144 of blades 141, 142. In this embodiment, the profiles of surfaces 144 of blades 141, 142 are generally coincident with each other, thereby forming a single composite blade profile 148.

Composite blade profile 148 and bit face 111 may generally be divided into three regions conventionally labeled cone region 149*a*, shoulder region 149*b*, and gage region 149*c*. Cone region 149*a* comprises the radially innermost region of bit body 110 and composite blade profile 148 extending from bit axis 105 to shoulder region 149*b*. In this embodiment, cone region 149*a* is generally concave. Adjacent cone region 149*a* is the generally convex shoulder region 149*b*. The transition between cone region 149*a* and shoulder region 149*b*, typically referred to as the nose 149*d*, occurs at the axially outermost portion of composite blade profile 148 where a tangent line to the blade profile 148 has a slope of zero. Moving radially outward, adjacent shoulder region 149*b* is the gage region 149*c* which extends substantially parallel to bit axis 105 at the outer radial periphery of composite blade profile 148. As shown in composite blade profile 148, gage pads 147 define the gage region 149*c* and the outer radius $R_{110}$ of bit body 110. Outer radius $R_{110}$ extends to and therefore defines the full gage diameter of bit body 110. As used herein, the term "full gage diameter" refers to elements or surfaces extending to the full, nominal gage of the bit diameter. As best shown in FIG. 4, the radially innermost cutting face 146 has a radially innermost cutting edge disposed at a radius $R_{146i}$, and the radially outermost cutting face 146 has a radially outermost cutting edge disposed at radius $R_{146o}$. In this embodiment, radius $R_{146o}$ lies along outer radius $R_{110}$.

Referring briefly to FIG. 4, moving radially outward from bit axis 105, bit face 111 includes cone region 149*a*, shoulder region 149*b*, and gage region 149*c* as previously described. Primary blades 141 extend radially along bit face 111 from within cone region 149*a* proximal bit axis 105 toward gage region 149*c* and outer radius $R_{110}$. Secondary blades 142 extend radially along bit face 111 from proximal nose 149*d* toward gage region 149*c* and outer radius $R_{110}$. Thus, in this embodiment, each primary blade 141 and each secondary blade 142 extends substantially to gage region 149*c* and outer radius $R_{110}$. In this embodiment, secondary blades 142 do not extend into cone region 149*a*, and thus, secondary blades 142 occupy no space on bit face 111 within cone region 149*a*. Although a specific embodiment of bit body 110 has been shown in described, one skilled in the art will appreciate that numerous variations in the size, orientation, and locations of the blades (e.g., primary blades 141, secondary blades, 142, etc.), and cutter elements (e.g., cutter elements 145) are possible.

Figure 6:
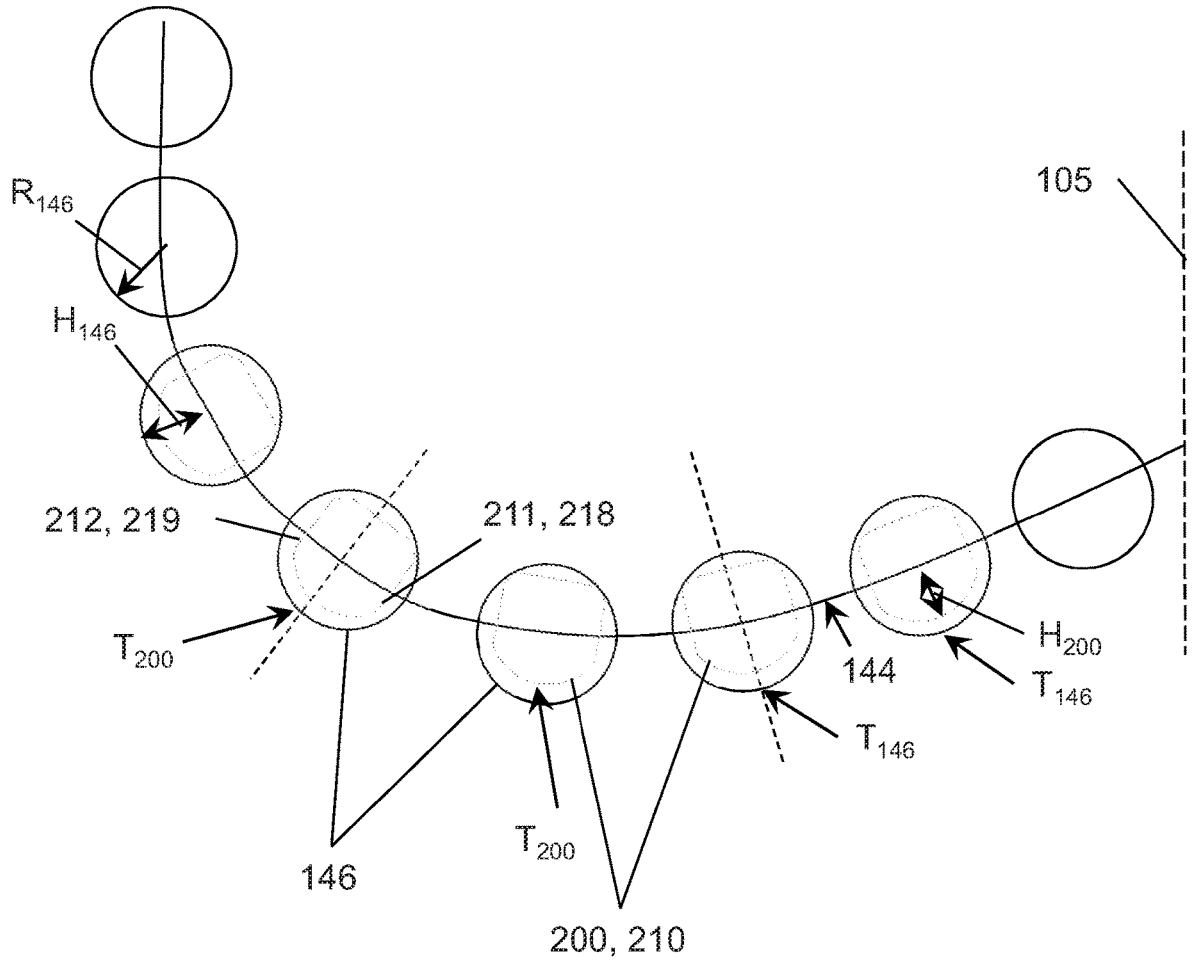
FIG. 6 is an enlarged rotated profile view of one of the primary blades and associated cutting faces and depth-of-cut limiting inserts of the drill bit of FIG. 2.

Referring now to FIG. 6, the profile of one exemplary blade 141, cutting faces 146 mounted thereto, and inserts 200 mounted thereto are shown rotated into a single rotated profile. Although only one blade 141 and associated cutting faces 146 and inserts 200 is shown in FIG. 6, it is to be understood that the other blades 141, 142 and associated cutting faces 146 and inserts 200 of bit 100 are arranged similarly. One or more cutter elements 145 and one or more depth-of-cut limiting inserts 200 are disposed in the cone region 149*a*, the shoulder region 149*b*, and the gage region 149*c*. Although depth-of-cut limiting inserts 200 are disposed in each region 149*a*, 149*b*, 149*c* in this embodiment, in general, one or more of the depth-of-cut limiting inserts 200 are preferably disposed in at least the cone region 149*a* and at or proximal the nose 149*d*.

Each cutting face 146 has an outer radius $R_{146}$ and an outermost cutting tip $T_{146}$ positioned furthest from cutter-supporting surface 144 to which it is mounted (as measured perpendicularly from its respective cutter-supporting surface 144); and each depth-of-cut limiting insert 200 has an outermost bearing surface 210 defined by a bearing tip $T_{200}$ positioned furthest from cutter-supporting surface 144 to which it is mounted (as measured perpendicularly from its respective cutter-supporting surface 144). In this embodiment, bearing tip $T_{200}$ is a contact point (as opposed to a contact line or surface), however, in other embodiments, the bearing tip positioned furthest from cutter-supporting surface to which it is mounted may be a contact line or surface. In addition, each cutting element 145 and associated cutting face 146 has a radial position defined by the radial distance measured perpendicularly from bit axis 105 to its cutting tip $T_{146}$; and each depth-of-cut limiting insert 200 has a radial position defined by the radial distance measured perpendicularly from bit axis 105 to its bearing tip $T_{200}$. Thus, as used herein, the phrase "radial position" refers to the radial distance measured perpendicularly from the bit axis to the outermost tip of a structure mounted to a blade (e.g., cutting tip $T_{146}$, bearing tip $T_{200}$, etc.). Still further, each cutting face 146 extends to an extension height $H_{146}$ measured perpendicularly from cutter-supporting surface 144 (or blade profile 148) to its cutting tip $T_{146}$; and each depth-of-cut limiting insert 200 has an extension height $H_{200}$ measured perpendicularly from cutter-supporting surface 144 (or blade profile 148) to its bearing tip $T_{200}$. Thus, as used herein, the phrase "extension height" refers to the distance or height to which a structure (e.g., cutting face, DOC limiting insert, etc.) extends perpendicularly from the cutter-supporting surface (e.g., cutter-supporting surface 144) of the blade to which it is mounted. In this embodiment, each cutting face 146 extends to substantially the same extension height $H_{146}$, and each depth-of-cut limiting insert 200 extends to substantially the same extension height $H_{200}$ that is less than or equal to extension height $H_{146}$.

As previously described and shown in FIG. 4, depth-of-cut limiting inserts 200 on each blade 141, 142 trail the cutter elements 145 on the same blade 141, 142 relative to the direction of rotation 106 of bit 100. More specifically, in this embodiment, each depth-of-cut limiting insert 200 on each blade 141, 142 is positioned immediately behind and trails a corresponding cutter element 145 on the same blade 141, 142. Thus, as best shown in FIG. 6, each depth-of-cut limiting insert 200 is disposed at substantially the same radial position as the cutting face 146 of the corresponding cutter element 145. As a result of the relative sizes, radial positions, and extension heights of cutting faces 146 and depth-of-cut limiting insert 200, the profile or path of each depth-of-cut limiting insert 200 is completely eclipsed and overlapped by the cutting profile or path of its associated primary cutting face 146.

Referring again to FIG. 5, bit 100 includes an internal plenum 104 extending axially from uphole end 100*a* through pin 120 and shank 130 into bit body 110. Plenum 104 permits drilling fluid to flow from the drill string 20 into bit 100. Body 110 is also provided with a plurality of flow passages 107 extending from plenum 104 to downhole end 100*b*. As best shown in FIGS. 2, 4, and 5, a nozzle 108 is seated in the lower end of each flow passage 107. Together, passages 107 and nozzles 108 distribute drilling fluid around cutting structure 140 to flush away formation cuttings and to remove heat from cutting structure 140, and more particularly cutting elements 145, during drilling.

Figure 7A:
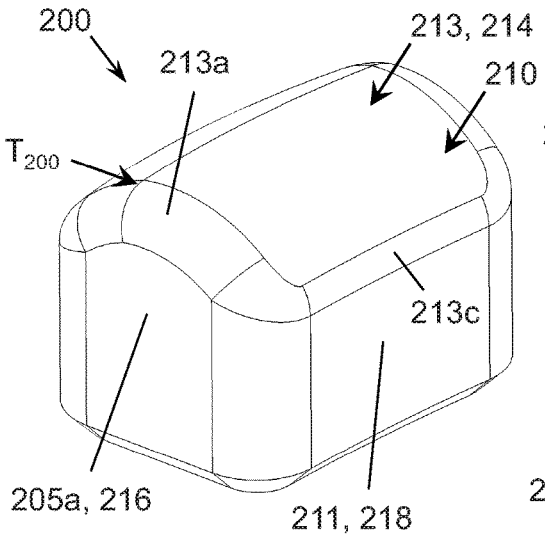
FIGS. 7A-7D are perspective, top, end, and side views, respectively, of one of the depth-of-cut limiting inserts of the drill bit of FIG. 2.
Figure 7B:
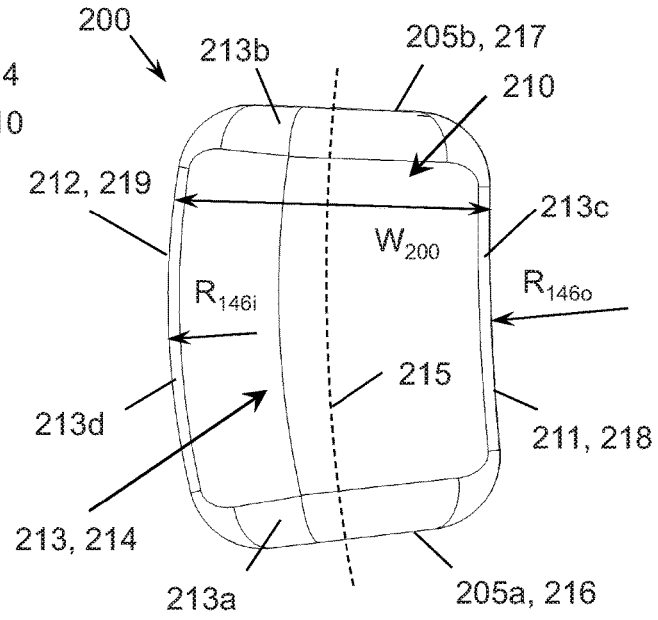
Figure 7C:
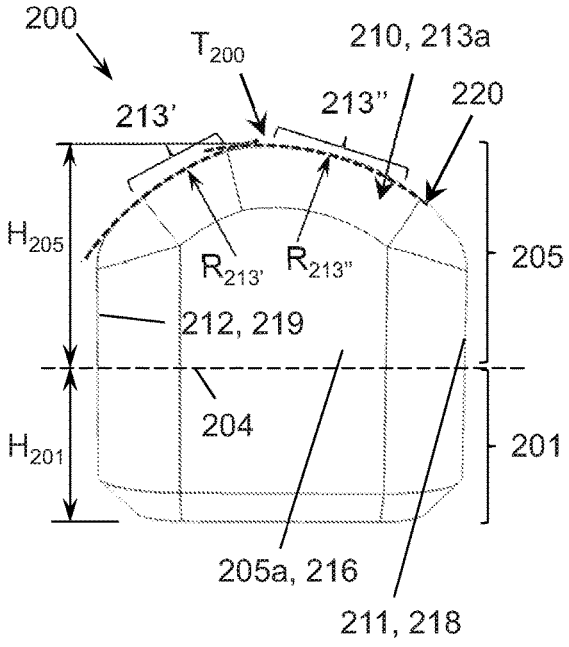
Figure 7D:
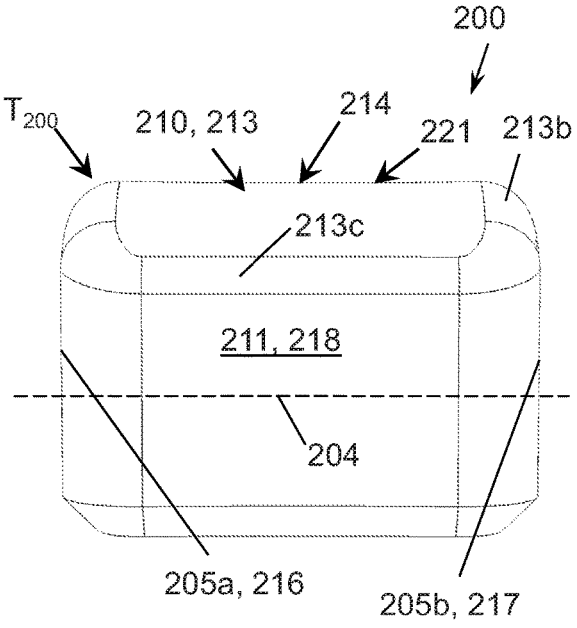

Referring now to FIGS. 7A-7D, one depth-of-cut limiting insert 200 is shown. Although only one insert 200 is shown in FIGS. 7A-7D, it is to be understood that all inserts 200 are the same. In this embodiment, insert 200 includes a base portion 201 and a formation engaging portion 205 extending therefrom. As shown in FIGS. 7C and 7D, reference plane of intersection 204 divides insert 200 into base portion 201 and formation engaging portion 205 (i.e., portions 201, 205 meet at plane of intersection 204). In this embodiment, base portion 201 is generally rectangular in end and side view (FIGS. 7C and 7D, respectively) and slightly arcuate in top view (FIG. 7B). As best shown in FIG. 7C, base portion 201 has a height $H_{201}$, and formation engaging portion 205 extends from base portion 201 to a height $H_{205}$. Collectively, base 201 and formation engaging portion 205 define the insert's overall height. Base portion 201 is retained within a mating socket in cutter-supporting surface 144 of a blade 141, 142 by interference fit, or by other means, such as brazing or welding, such that formation engaging portion 205 extends from cutter supporting surface 144. In other words, when insert 200 is mounted to a blade 141, 142, base portion 201 is the part of insert seated in the mating socket such that a projection of the plane of intersection 204 is generally aligned with cutter-supporting surface 144 of that blade 141, 142. Thus, once mounted to a blade 141, 142, the height $H_{205}$ of portion 205 is generally the distance from the cutter-supporting surface 144 to the outermost point, line, or surface of formation engaging portion 205 as measured perpendicular to cutter-supporting surface 144, and thus, defines the extension height $H_{200}$ of insert 200. Accordingly, as used herein, the term "base portion" may be used to refer to the portion of an insert (e.g., insert 200) that is seated within a mating socket in cutter-supporting surface of a blade of a drill bit (e.g., cutter-supporting surface 144 of a blade 141, 142), and "formation engaging portion" may be used to refer to the portion of an insert that extends from the base portion and is configured to directly contact the formation during drilling operations.

Referring still to FIGS. 7A-7D, formation engaging portion 205 has an outer or formation engaging surface 210 extending from plane of intersection 204 and an elongate, arcuate central or longitudinal axis 215. In addition, formation engaging portion 205 includes a first end 205*a*, a second end 205*b* longitudinally opposite end 205*a*, a pair of lateral sides 211, 212, and an elongate crown 213. Lateral sides 211, 212 extend longitudinally between ends 205*a*, 205*b*, and thus, sides 211, 212 are disposed on opposite sides of axis 215 and extend generally parallel to axis 215. Axis 215 intersects each end 205*a*, 205*b* perpendicularly thereto and is equidistant from sides 211, 212. Elongate crown 213 extends longitudinally between ends 205*a*, 205*b* generally in the same direction as axis 215 and laterally between sides 211, 212. Crown 213 intersects ends 205*a*, 205*b* at end corners 213*a*, 213*b*, respectively, and intersects sides 211, 212 at side corners 213*c*, 213*d*, respectively. In this embodiment, corners 213*a*, 213*b*, 213*c*, 213*d* are radiused such that there is a smooth, continuously contoured transition between crown 213 and ends 205*a*, 205*b* and between crown 213 and sides 211, 212. In this embodiment, crown 213 is smoothly curved and convex (i.e., outwardly bowed) as it extends laterally between sides 211, 212 and smoothly transitions into side corners 213*c*, 213*d*. Crown 213 has an elongate arcuate peaked ridge 214 generally extending to and defining the extension height $H_{200}$ of insert 200. Insert 200 has a width $W_{200}$ measured perpendicular to axis 215 between lateral sides 211, 212 in top view (FIG. 7B).

In this embodiment, ends 205*a*, 205*b* comprise planar surfaces 216, 217, respectively, and lateral sides 211, 212 comprise arcuate or curved surfaces 218, 219, respectively. In particular, surface 218 is concave or bowed inwardly, and surface 219 is convex or bowed outwardly. The curvature of sides 211, 212 and associated surfaces 218, 219, respectively, results in the general C-shaped arcuate geometry of insert 200 in top view (FIG. 7B). As best shown in FIG. 4, in this embodiment, inserts 200 are mounted to blades 141, 142 such that (a) ends 205*a*, 205*b* are generally oriented perpendicular to the direction of rotation 106 of bit 100 with each end 205*a* leading the corresponding end 205*b* of the same insert 200 relative to the direction of rotation 106 of bit 100 (i.e., axis 215 is generally aligned with direction of rotation 106); and (b) each lateral side 211 positioned radially inwardly of the corresponding lateral side 212 of the same insert 200. Accordingly, ends 205*a*, 205*b* may also be referred to as leading and trailing ends, respectively, and sides 211, 212 may also be referred to as radially inner and radially outer sides, respectively. In this embodiment, concave surface 218 of radially inner side 211 is a cylindrical surface having a radius of curvature equal to radius $R_{146o}$ and convex surface 219 of radially outer side 212 is a cylindrical surface having a radius of curvature equal to radius $R_{146i}$. Radius $R_{146i}$ is less than radius $R_{146o}$, and as a result, the width $W_{200}$ of insert 200 changes moving along longitudinal axis 215. More specifically, width $W_{200}$ is smallest at ends 205*a*, 205*b*, largest in the middle of insert 200 (equidistant from ends 205*a*, 205*b*), and continuously and gradually increases moving along axis 215 from each end 205*a*, 205*b* to the middle of insert 200.

Referring to the end and side views of FIGS. 7C and 7D, respectively, lateral side surfaces 218, 219 and crown 213 define a front periphery or profile 220 of insert 200 generally viewed along axis 215 (FIG. 7C), while end surfaces 216, 217 and peaked ridge 214 define a side periphery or profile 221 of insert 200 generally viewed perpendicular to axis 215 (FIG. 7D). As seen in front profile 220 (FIG. 7C), lateral side surfaces 218, 219 are generally straight in the region between base portion 201 and crown 213. Likewise, as seen in side profile 221 (FIG. 7D), end surfaces 216, 217 are generally straight in the region between base portion 201 and crown 213.

As best shown in the front profile 220 of FIG. 7C, crown 213 is smoothly curved between side corners 213*c*, 213*d*. The apex of peaked ridge 214 at end corner 213*a* defines bearing tip $T_{200}$. In the front profile 220 of FIG. 7C, crown 213 and peaked ridge 214 are generally convex. In this embodiment, crown 213 includes two sections or portions 213', 213" that intersect in end view. In the front profile view 220, the transition between portions 213', 213" is defined by the intersection of two circles (shown with dashed lines in FIG. 7C) having radii $R_{213'}$, $R_{213''}$. Thus, in front profile view 220, radius of curvature $R_{213'}$, $R_{213''}$ represents the radius of curvature of the corresponding portion 213', 213", respectively. In general, each radius $R_{213'}$, $R_{213''}$, can be the same or different, and further, each radius $R_{213'}$, $R_{213''}$ of crown 213 is preferably less than or equal to radius $R_{146}$ of the corresponding cutting face 146. In this embodiment, both radii $R_{213'}$, $R_{213''}$ are the same, and in particular are equal to the radius $R_{146}$ of cutting face 146. The location where portions 213', 213" intersect can be varied depending on the radial position of the insert 200 on the bit 100.

As best shown in the side profile 221 of FIG. 7D, peaked ridge 214 is slightly concave or bowed inwardly between end corners 213*a*, 213*b*. Although peaked ridge 214 is slightly concave between end corners 213*a*, 213*b* in side profile 221, in other embodiments, the peaked ridge (e.g., peaked ridge 214) may be convex or bowed outwardly or flat between the end corners (e.g., end corners 213*a*, 213*b*) in side profile (e.g., side profile 221). To enhance the contact surface area between formation engaging surface 210 and the formation during drilling operations, in embodiments described herein, each insert 200 positioned radially inside nose 129*d* (i.e., along cone region 149*a*) of bit 100 preferably has a peaked ridge 214 that is slightly concave between end corners 213*a*, 213*b* in side profile 221, and each insert 200 positioned radially outside nose 129*d* (i.e., along shoulder region 129*b* and gage region 149*c*) of bit 100 preferably has a peaked ridge 214 that is slightly convex between end corners 213*a*, 213*b* in side profile 221.

During drilling operations, each cutting face 146 engages, penetrates, and shears the formation as the bit 100 is rotated in the cutting direction 106 and is advanced through the formation. As each cutting face 146 advances through the formation, it cuts a kerf in the formation generally defined by the cutting profile of the cutting face 146. In embodiments described herein, when the depth-of-cut of a cutting face 146 is sufficiently large, the formation bearing surface 210 of the depth-of-cut limiting insert 200 associated with and trailing the cutting face 146 will engage the formation, and more specifically, engage the kerf cut in the formation by the cutting face 146. The depth-of-cut limiting inserts 200 are not intended to penetrate and shear the formation, but rather, contact and slide across the formation, thereby limiting a further increase in the depth-of-cut of the corresponding cutting faces 146. As the depth-of-cut limiting insert 200 is non-aggressive and not intended to penetrate or shear the formation, the formation bearing surface 210 slides across the formation, thereby limiting the penetration of corresponding cutting face 146. In addition, due to the elongate geometry of the depth-of-cut limiting inserts 200, the radii $R_{213'}$, $R_{213''}$ of the crown 213, each matching the radius $R_{146}$ of the corresponding cutting face 146, and the concavity or convexity of peaked ridge 214 in side profile 221 depending on the radial position of the insert 200 (concave peaked ridge 214 for inserts 200 positioned radially inside nose 149*d* and convex peaked ridge 214 for inserts 200 positioned radially outside nose 149*d*), the depth-of-cut limiting inserts 200 provide increased bearing surface area for engaging and sliding across the formation as compared to similarly sized dome-shaped depth-of-cut limiters, and thus, may be particularly beneficial for limiting the depth-of-cut in relatively soft formations.

Figure 8:
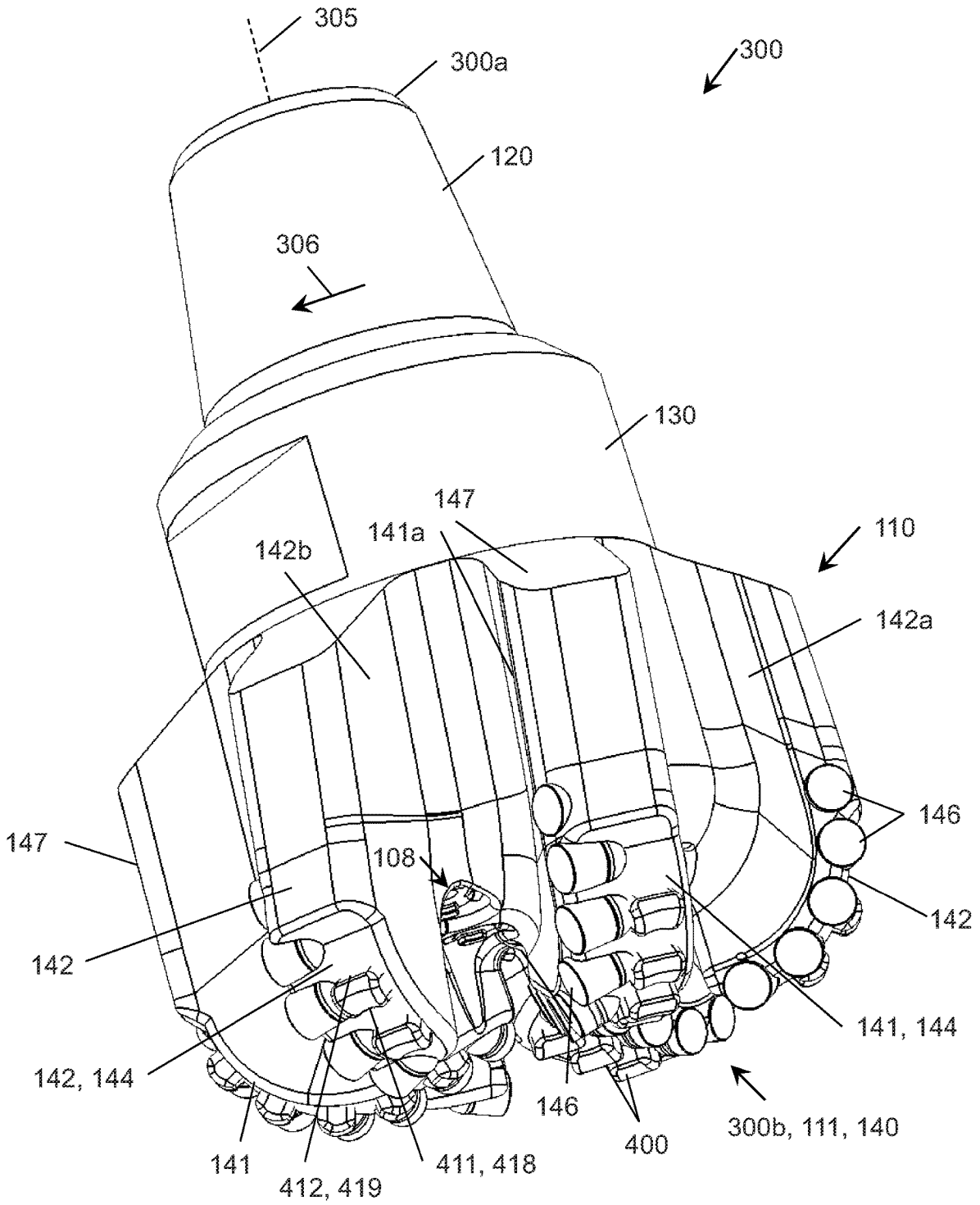
FIG. 8 is a perspective view of an embodiment of a drill bit with a plurality of depth-of-cut limiting inserts in accordance with the principles described herein.
Figure 9:
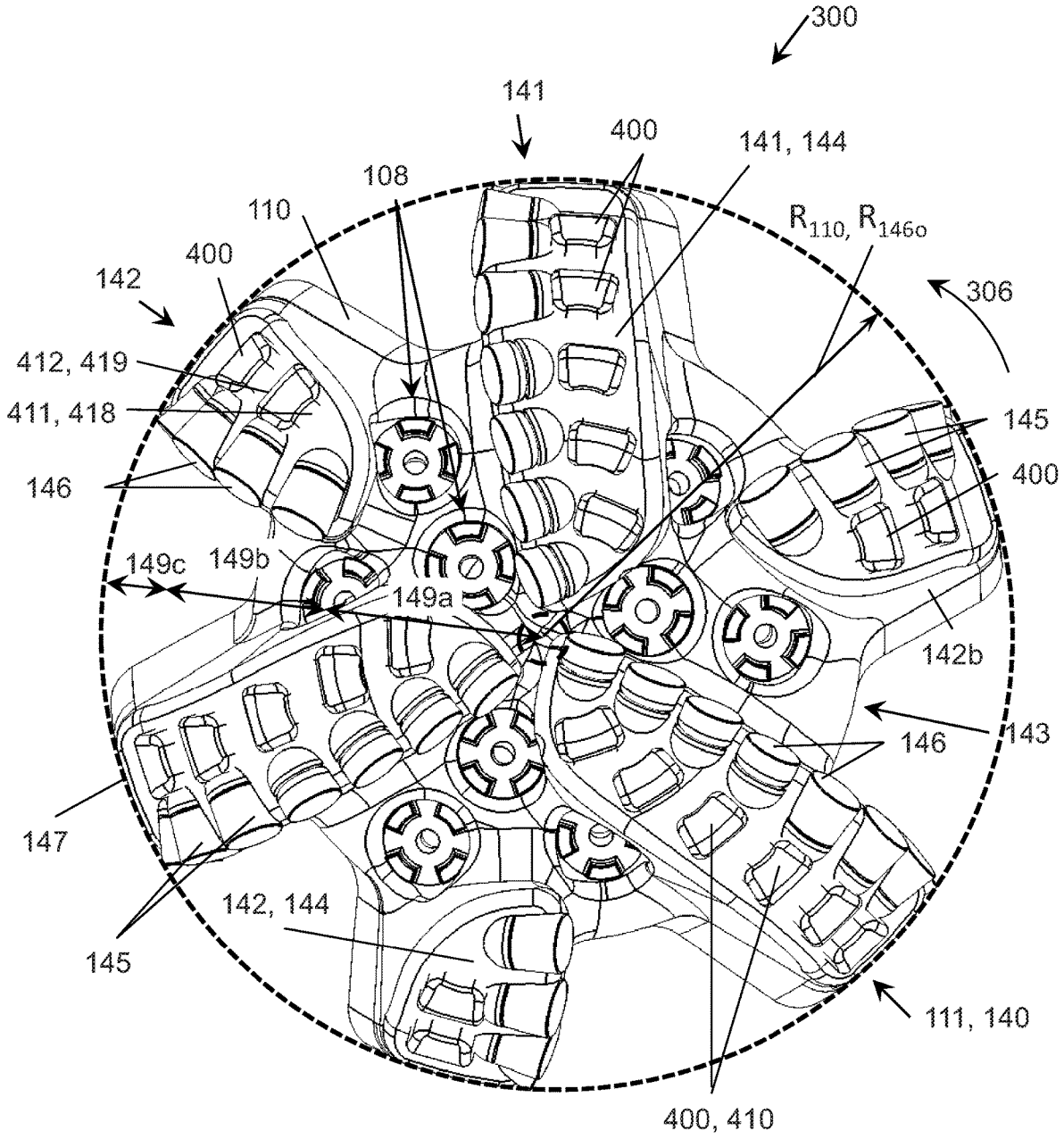
FIG. 9 is an end view of the drill bit of FIG. 8.

Referring now to FIGS. 8 and 9, another embodiment of a fixed cutter drill bit 300 is shown. Bit 300 can be used in place of bit 100 in drilling system 10 previously described. Bit 300 is substantially the same as bit 100 previously described. Namely, bit 300 has a central or longitudinal axis 305, a first or uphole end 300*a*, a second or downhole end 300*b*, and a cutting direction or rotation 306 about axis 305. In addition, bit 300 includes a bit body 110 extending axially from downhole end 300*b*, a threaded connection or pin 120 extending axially from uphole end 300*a*, and a shank 130 extending axially between pin 120 and body 110. Bit body 110, pin 120, and shank 130 are each as previously described. Thus, for example, the portion of bit body 110 that faces the formation at downhole end 300*b* includes bit face 111 and cutting structure 140.

Each blade 141, 142 includes cutter-supporting surface 144 for mounting a plurality of cutter elements 145 arranged adjacent one another in a radially extending row proximal the leading edge of each primary blade 141 and each secondary blade 142. However, in this embodiment, the plurality of depth-of-cut limiting inserts 200 are replaced with a plurality depth-of-cut limiting inserts 400. In particular, the plurality of DOC limiting inserts 400 are arranged adjacent one another in a radially extending row on each primary blade 141 and each secondary blade 142. The row of DOC limiting inserts 400 on each blade 141, 142 trails the row of cutter elements 145 on the same blade 141, 142 relative to the direction of rotation 306 of bit 300. Similar to depth-of-cut limiting inserts 200 previously described, depth-of-cut limiting inserts 400 are intended to limit the maximum depth-of-cut of cutting faces 146 as they engage the formation. As will be described in more detail below and similar to inserts 200, each depth-of-cut limiting insert 400 includes an outer formation engaging surface 410 extending from cutter-supporting surface 144 of the corresponding blade 141, 142. Surfaces 410 of inserts 400 are intended to slide across the formation and limit the depth to which cutting faces 146 bite or penetrate into the formation. Thus, depth-of-cut limiting inserts 400 are not intended to penetrate and shear the formation.

Figure 10:
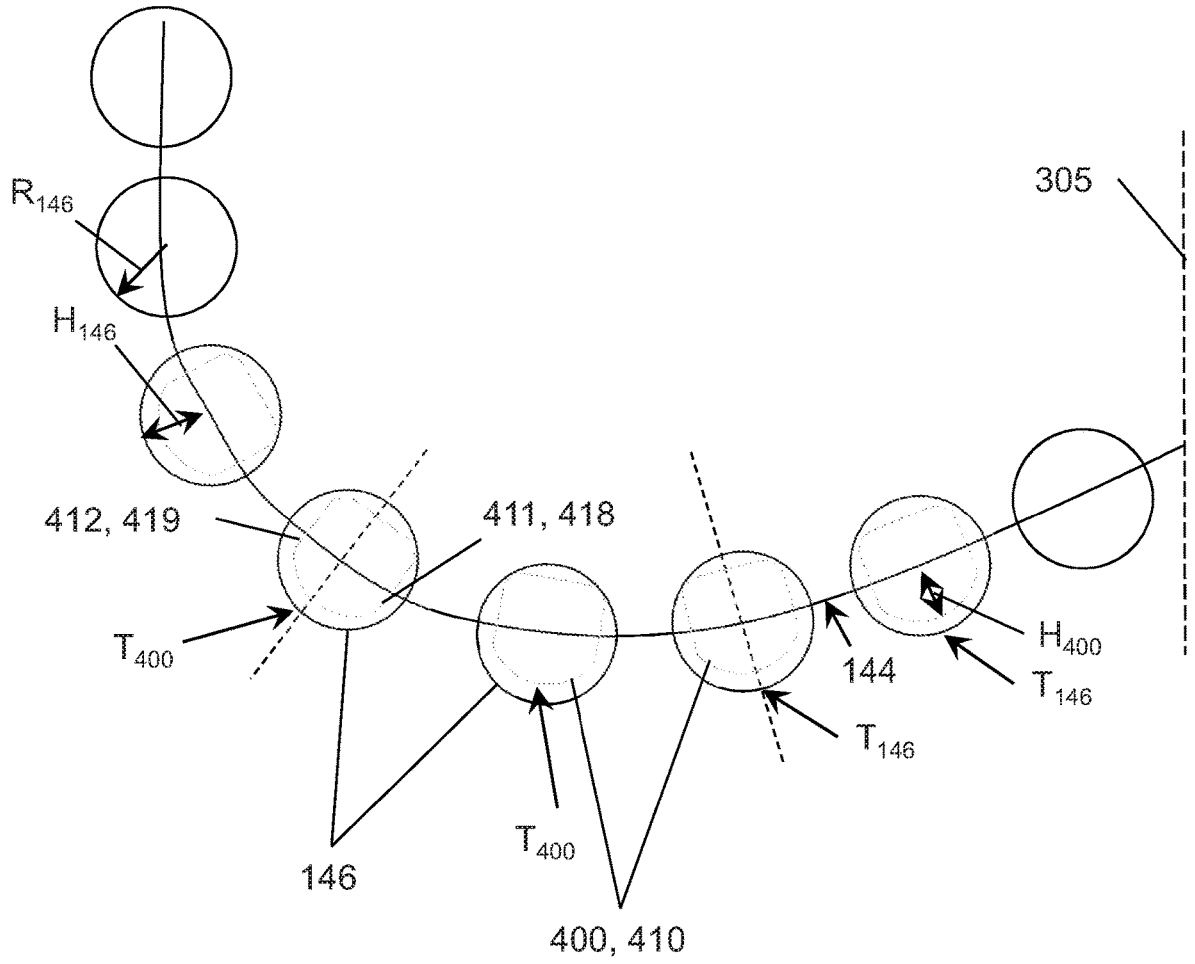
FIG. 10 is an enlarged rotated profile view of one of the primary blades and associated cutting faces and depth-of-cut limiting inserts of the drill bit of FIG. 8.

Referring now to FIG. 10, the profile of one exemplary blade 141, cutting faces 146 mounted thereto, and inserts 400 mounted thereto are shown rotated into a single rotated profile. Although only one blade 141 and associated cutting faces 146 and inserts 400 are shown in FIG. 10, it is to be understood that the other blades 141, 142 and associated cutting faces 146 and inserts 400 of bit 300 are arranged similarly. One or more cutter elements 145 and one or more depth-of-cut limiting inserts 400 are disposed in the cone region 149*a*, the shoulder region 149*b*, and the gage region 149*c*. Although depth-of-cut limiting inserts 400 are disposed in each region 149*a*, 149*b*, 149*c* in this embodiment, in general, one or more of the depth-of-cut limiting inserts 400 are preferably mounted to each blade 141, 142 in at least the cone region 149*a* and at or proximal the nose 149*d*.

Each depth-of-cut limiting insert 400 has an outermost bearing surface 410 defined by a tip $T_{400}$ positioned furthest from cutter-supporting surface 144 to which it is mounted (as measured perpendicularly from its respective cutter-supporting surface 144). In this embodiment, bearing tip $T_{400}$ is a contact point (as opposed to a contact line or surface), however, in other embodiments, the bearing tip positioned furthest from cutter-supporting surface to which it is mounted may be a contact line or surface. In addition, each depth-of-cut limiting insert 400 has a radial position defined by the radial distance measured perpendicularly from bit axis 305 to its bearing tip $T_{400}$. Still further, each depth-of-cut limiting insert 400 has an extension height $H_{400}$ measured perpendicularly from cutter-supporting surface 144 (or blade profile 148) to its bearing tip $T_{400}$. In this embodiment, each cutting face 146 extends to substantially the same extension height $H_{146}$, and each depth-of-cut limiting insert 400 extends to substantially the same extension height $H_{400}$ that is less than or equal to extension height $H_{146}$.

As previously described and shown in FIG. 9, depth-of-cut limiting inserts 400 on each blade 141, 142 trail the cutter elements 145 on the same blade 141, 142 relative to the direction of rotation 306 of bit 300. More specifically, in this embodiment, each depth-of-cut limiting insert 400 on each blade 141, 142 is positioned immediately behind and trails a corresponding cutter element 145 on the same blade 141, 142. Thus, as best shown in FIG. 10, each depth-of-cut limiting insert 400 is disposed at substantially the same radial position as the cutting face 146 of the corresponding cutter element 145. As a result of the relative sizes, radial positions, and extension heights of cutting faces 146 and depth-of-cut limiting insert 400, the profile or path of each depth-of-cut limiting insert 400 is completely eclipsed and overlapped by the cutting profile or path of its associated primary cutting face 146.

Figure 11A:
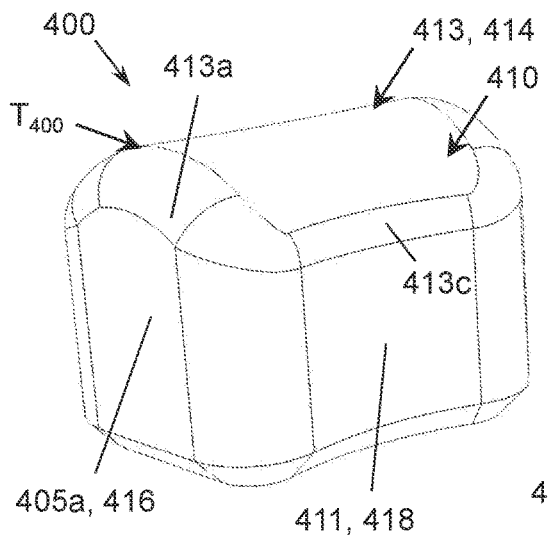
FIGS. 11A-11D are perspective, top, end, and side views, respectively, of one of the depth-of-cut limiting inserts of the drill bit of FIG. 8.
Figure 11B:
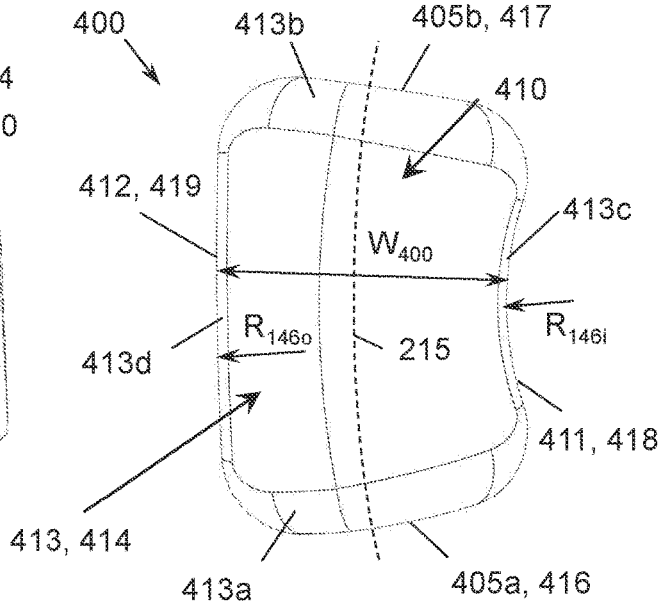
Figure 11C:
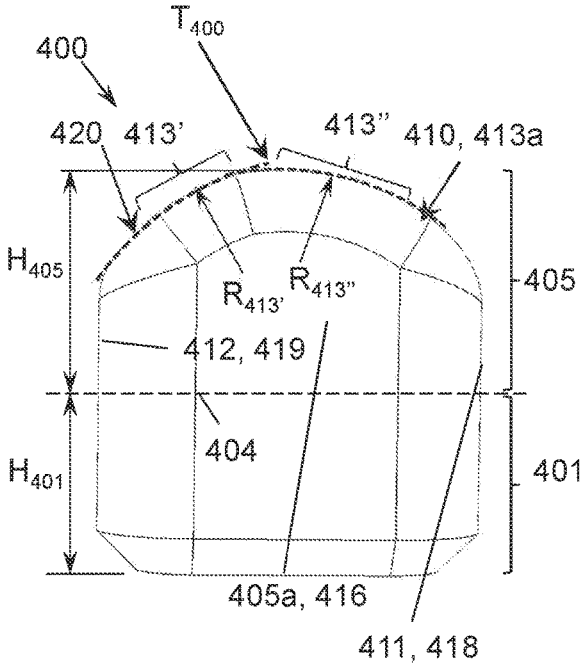
Figure 11D:
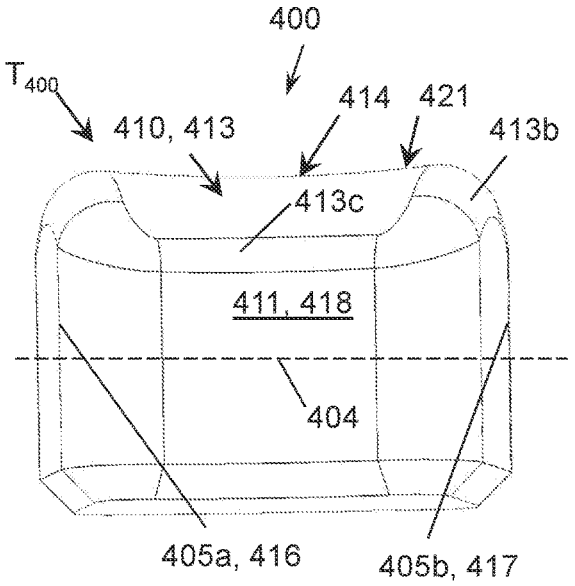

Referring now to FIGS. 11A-11D, one depth-of-cut limiting insert 400 is shown, it is to be understood that all inserts 400 are the same. Insert 400 is substantially the same as insert 200 previously described with the exception of the geometry of the lateral sides and corresponding side surfaces. More specifically, in this embodiment, insert 400 includes a base portion 401 and a formation engaging portion 405 extending therefrom. As shown in FIGS. 11C and 11D, reference plane of intersection 404 divides insert 400 into base portion 401 and formation engaging portion 405. In this embodiment, base portion 401 is generally rectangular in end and side view (FIGS. 11C and 11D, respectively) and slightly arcuate in top view (FIG. 11B). As best shown in FIG. 11C, base portion 401 has a height $H_{401}$, and formation engaging portion 405 extends from base portion 401 to a height $H_{405}$. Base portion 401 is retained within a mating socket in cutter-supporting surface 144 of a blade 141, 142 by interference fit, or by other means, such as brazing or welding, such that formation engaging portion 405 extends from cutter supporting surface 144. In other words, when insert 400 is mounted to a blade 141, 142, base portion 401 is the part of insert 400 seated in the mating socket such that a projection of the plane of intersection 404 is generally aligned with cutter-supporting surface 144 of that blade 141, 142. Thus, once mounted to a blade 141, 142, the height $H_{405}$ of portion 405 is generally the distance from the cutter-supporting surface 144 to the outermost point, line, or surface of formation engaging portion 405 as measured perpendicular to cutter-supporting surface 144, and thus, defines the extension height $H_{400}$ of insert 400.

Referring still to FIGS. 11A-11D, formation engaging portion 405 has an outer or formation engaging surface 410 extending from plane of intersection 404 and an elongate, arcuate central or longitudinal axis 415. In addition, formation engaging portion 405 includes a first end 405*a*, a second end 405*b* longitudinally opposite end 405*a*, a pair of lateral sides 411, 412, and an elongate crown 413. Lateral sides 411, 412 extend longitudinally between ends 405*a*, 405*b*, and thus, sides 411, 412 are disposed on opposite sides of axis 415 and extend generally parallel to axis 415. Axis 415 intersects each end 405*a*, 405*b* perpendicularly thereto and is equidistant from sides 411, 412. Elongate crown 413 extends longitudinally between ends 405*a*, 405*b* generally parallel to axis 415 and laterally between sides 411, 412. Crown 413 intersects ends 405*a*, 405*b* at end corners 413*a*, 413*b*, respectively, and intersects sides 411, 412 at side corners 413*c*, 413*d*, respectively. In this embodiment, corners 413*a*, 413*b*, 413*c*, 413*d* are radiused such that there is a smooth, continuously contoured transition between crown 413 and ends 405*a*, 405*b* and between crown 413 and sides 411, 412. In this embodiment, crown 413 is smoothly curved and convex (i.e., outwardly bowed) as it extends laterally between sides 411, 412 and smoothly transitions into side corners 413*c*, 413*d*. Crown 413 has an elongate arcuate peaked ridge 414 generally extending to and defining the extension height $H_{400}$ of insert 400. Insert 400 has a width $W_{400}$ measured perpendicular to axis 415 between lateral sides 411, 412 in top view (FIG. 11B).

In this embodiment, ends 405*a*, 405*b* comprise planar surfaces 416, 417, respectively, and lateral sides 411, 412 comprise arcuate or curved surfaces 418, 419, respectively. In particular, surface 418 is concave or bowed inwardly, and surface 419 is convex or bowed outwardly. The curvature of sides 411, 412 and associated surfaces 418, 419, respectively, results in the general C-shaped arcuate geometry of insert 400 in top view (FIG. 11B). As best shown in FIG. 9, in this embodiment, inserts 400 are mounted to blades 141, 142 such that (a) ends 405*a*, 405*b* are generally oriented perpendicular to the direction of rotation 306 of bit 300 with each end 405*a* leading the corresponding end 405*b* of the same insert 400 relative to the direction of rotation 306 of bit 300 (i.e., axis 415 is generally aligned with direction of rotation 306); and (b) each lateral side 411 positioned radially inwardly of the corresponding lateral side 412 of the same insert 400. Accordingly, ends 405*a*, 405*b* may also be referred to as leading and trailing ends, respectively, and sides 411, 412 may also be referred to as radially inner and radially outer sides, respectively. Thus, insert 400 is generally shaped and oriented similarly to insert 200 previously described. As previously described, concave surface 218 of radially inner side 211 of insert 200 has a radius of curvature equal to radius $R_{146o}$ and convex surface 219 of radially outer side 212 of insert 200 has a radius of curvature equal to radius $R_{146i}$. However, in this embodiment, concave surface 418 of radially inner side 411 is a cylindrical surface having a radius of curvature equal to radius $R_{146o}$ and convex surface 419 of radially outer side 412 is a cylindrical surface having a radius of curvature equal to radius $R_{146o}$. As previously described, radius $R_{146i}$ is less than radius $R_{146o}$, and thus, the width $W_{400}$ of insert 400 changes moving along longitudinal axis 415. More specifically, width $W_{400}$ is largest at ends 405*a*, 405*b*, smallest in the middle of insert 400 (equidistant from ends 405*a*, 405*b*), and continuously and gradually decreases moving along axis 415 from each end 405*a*, 405*b* to the middle of insert 400.

Referring to the end and side views of FIGS. 11C and 11D, respectively, lateral side surfaces 418, 419 and crown 413 define a front periphery or profile 420 of insert 400 generally viewed along axis 415 (FIG. 11C), while end surfaces 416, 417 and peaked ridge 414 define a side periphery or profile 421 of insert 400 generally viewed perpendicular to axis 415 (FIG. 11D). As seen in front profile 420 (FIG. 11C), lateral side surfaces 418, 419 are generally straight in the region between base portion 401 and crown 413. Likewise, as seen in side profile 421 (FIG. 11D), end surfaces 416, 417 are generally straight in the region between base portion 401 and crown 413.

As best shown in the front profile 420 of FIG. 11C, crown 413 is smoothly curved between side corners 413*c*, 413*d*. The apex of peaked ridge 414 at end corner 413*a* defines bearing tip $T_{400}$. In the front profile 420 of FIG. 11C, crown 413 and peaked ridge 414 are generally convex. In this embodiment, the crown 413 includes two sections or portions 413', 413" that intersect in end view. In the front profile view 420, the transition between portions 413', 413" is defined by the intersection of two circles (shown with dashed lines in FIG. 11C) having radii $R_{413'}$, $R_{413''}$. Thus, in front profile view 420, radius of curvature $R_{413'}$, $R_{413''}$ represents the radius of curvature of the corresponding portion 413', 413", respectively. In general, each radius $R_{413'}$, $R_{413''}$, can be the same or different, and further, each radius $R_{413'}$, $R_{413''}$ of crown 413 is preferably less than or equal to radius $R_{146}$ of the corresponding cutting face 146. In this embodiment, both radii $R_{413'}$, $R_{413''}$ are the same, and in particular are equal to the radius $R_{146}$ of cutting face 146. The location where portions 413', 413" intersect can be varied depending on the radial position of the insert 400 on the bit 300.

As best shown in the side profile 421 of FIG. 11D, peaked ridge 414 is slightly concave or bowed inwardly between end corners 413*a*, 413*b*. Although peaked ridge 414 is slightly concave between end corners 413*a*, 413*b* in side profile 421, in other embodiments, the peaked ridge (e.g., peaked ridge 414) may be convex or bowed outwardly or flat between the end corners (e.g., end corners 413*a*, 413*b*) in side profile (e.g., side profile 421). To enhance the contact surface area between formation engaging surface 410 and the formation during drilling operations, in embodiments described herein, each insert 400 positioned radially inside nose 129*d* (i.e., along cone region 149*a*) of bit 300 preferably has a peaked ridge 414 that is slightly concave between end corners 413*a*, 413*b* in side profile 421, and each insert 400 positioned radially outside nose 129*d* (i.e., along shoulder region 129*b* and gage region 149*c*) of bit 300 preferably has a peaked ridge 414 that is slightly convex between end corners 413*a*, 413*b* in side profile 421.

During drilling operations, each cutting face 146 engages, penetrates, and shears the formation as the bit 300 is rotated in the cutting direction 306 and is advanced through the formation. As each cutting face 146 advances through the formation, it cuts a kerf in the formation generally defined by the cutting profile of the cutting face 146. In embodiments described herein, when the depth-of-cut of a cutting face 146 is sufficiently large, the formation bearing surface 410 of the depth-of-cut limiting insert 400 associated with and trailing the cutting face 146 will engage the formation, and more specifically, engage the kerf cut in the formation by the cutting face 146. The depth-of-cut limiting inserts 400 are not intended to penetrate and shear the formation, but rather, contact and slide across the formation, thereby limiting a further increase in the depth-of-cut of the corresponding cutting faces 146. As the depth-of-cut limiting insert 400 is non-aggressive and not intended to penetrate or shear the formation, the formation bearing surface 410 slides across the formation, thereby limiting the penetration of corresponding cutting face 146. In addition, due to the elongate geometry of the depth-of-cut limiting inserts 400, the radii $R4_{13'}$, $R_{413''}$ of the crown 413, each matching the radius $R_{146}$ of the corresponding cutting face 146, and the concavity or convexity of peaked ridge 414 in side profile 421 depending on the radial position of the insert 400 (concave peaked ridge 414 for inserts 400 positioned radially inside nose 129*d* and convex peaked ridge 414 for inserts 400 positioned radially outside nose 129*d*), the depth-of-cut limiting inserts 400 provide increased bearing surface area for engaging and sliding across the formation as compared to similarly sized dome-shaped depth-of-cut limiters, and thus, may be particularly beneficial for limiting the depth-of-cut in relatively soft formations.

Figure 12:
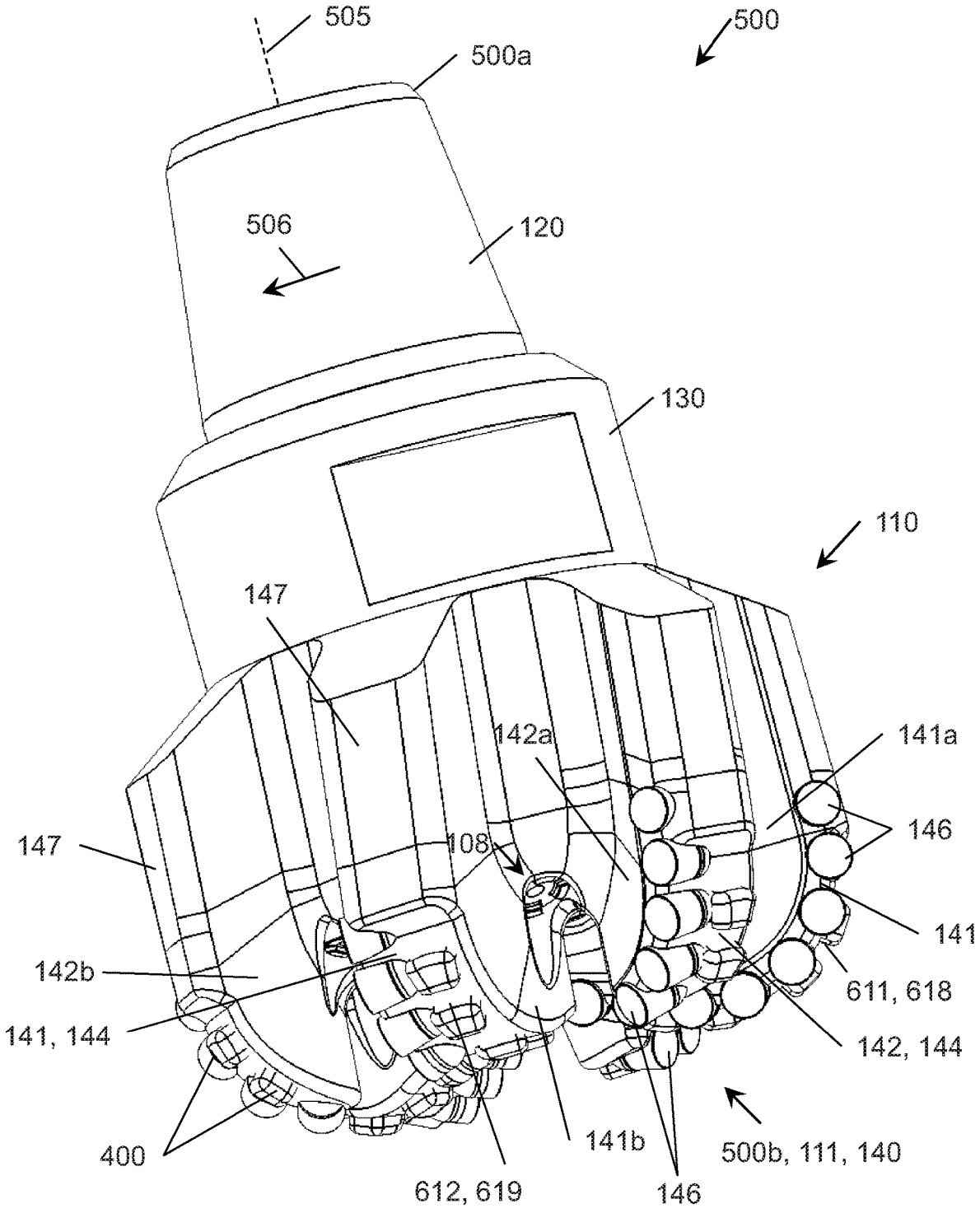
FIG. 12 is a perspective view of an embodiment of a drill bit with a plurality of depth-of-cut limiting inserts in accordance with the principles described herein.
Figure 13:
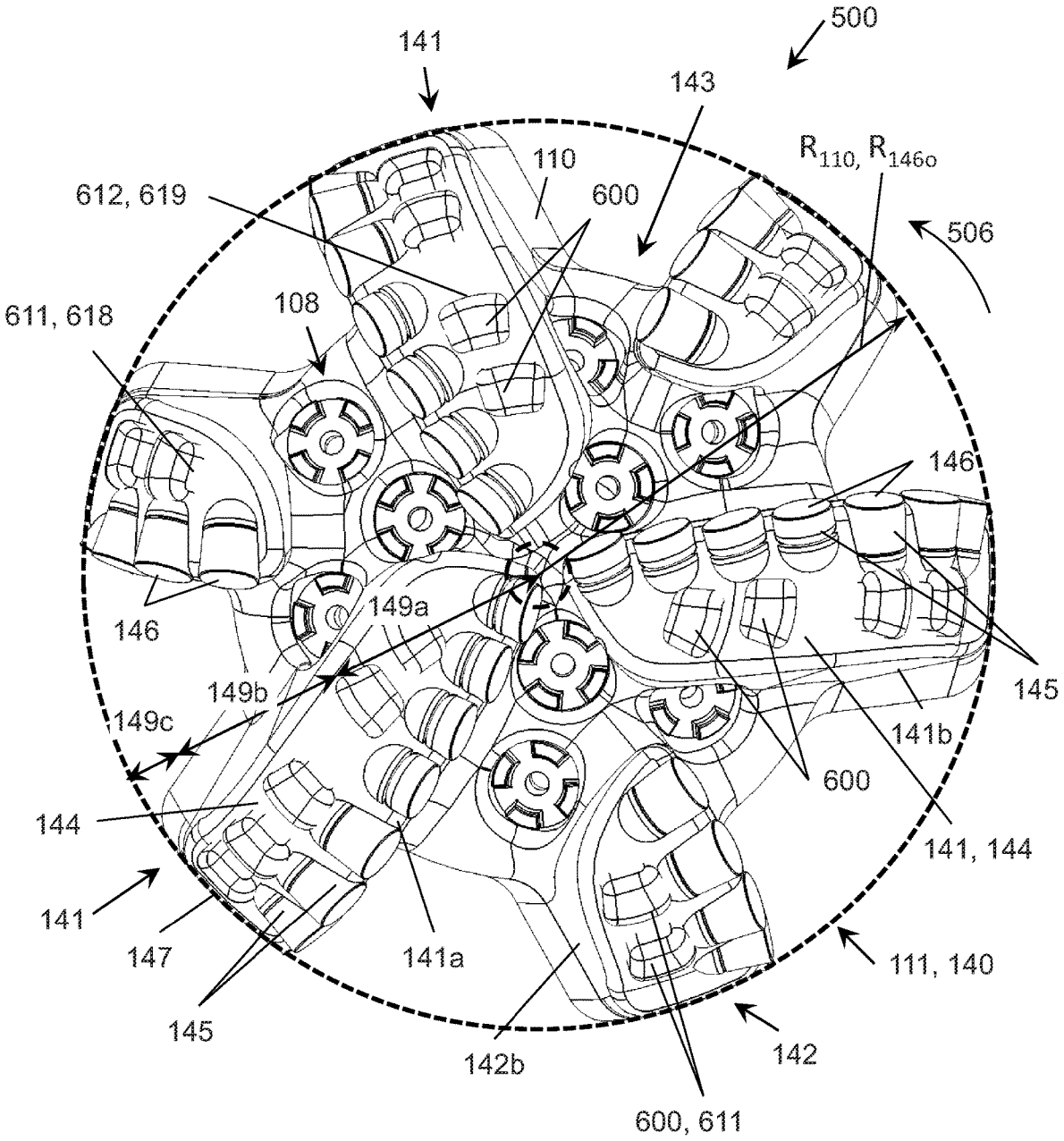
FIG. 13 is an end view of the drill bit of FIG. 12.

Referring now to FIGS. 12 and 13, another embodiment of a fixed cutter drill bit 500 is shown. Bit 500 can be used in place of bit 100 in drilling system 10 previously described. Bit 500 is substantially the same as bit 100 previously described. Namely, bit 500 has a central or longitudinal axis 505, a first or uphole end 500*a*, a second or downhole end 500*b*, and a cutting direction or rotation 506 about axis 505. In addition, bit 500 includes a bit body 110 extending axially from downhole end 500*b*, a threaded connection or pin 120 extending axially from uphole end 500*a*, and a shank 130 extending axially between pin 120 and body 110. Bit body 110, pin 120, and shank 130 are each as previously described. Thus, for example, the portion of bit body 110 that faces the formation at downhole end 500*b* includes bit face 111 and cutting structure 140.

Each blade 141, 142 includes cutter-supporting surface 144 for mounting a plurality of cutter elements 145 arranged adjacent one another in a radially extending row proximal the leading edge of each primary blade 141 and each secondary blade 142. However, in this embodiment, the plurality of depth-of-cut limiting inserts 200 are replaced with a plurality depth-of-cut limiting inserts 600. In particular, the plurality of DOC limiting inserts 600 are arranged adjacent one another in a radially extending row on each primary blade 141 and each secondary blade 142. The row of DOC limiting inserts 600 on each blade 141, 142 trails the row of cutter elements 145 on the same blade 141, 142 relative to the direction of rotation 506 of bit 500. Similar to depth-of-cut limiting inserts 200 previously described, depth-of-cut limiting inserts 600 are intended to limit the maximum depth-of-cut of cutting faces 146 as they engage the formation. As will be described in more detail below and similar to inserts 200, each depth-of-cut limiting insert 600 includes an outer formation engaging surface 610 extending from cutter-supporting surface 144 of the corresponding blade 141, 142. Surfaces 610 of inserts 600 are intended to slide across the formation and limit the depth to which cutting faces 146 bite or penetrate into the formation. Thus, depth-of-cut limiting inserts 600 are not intended to penetrate and shear the formation.

Figure 14:
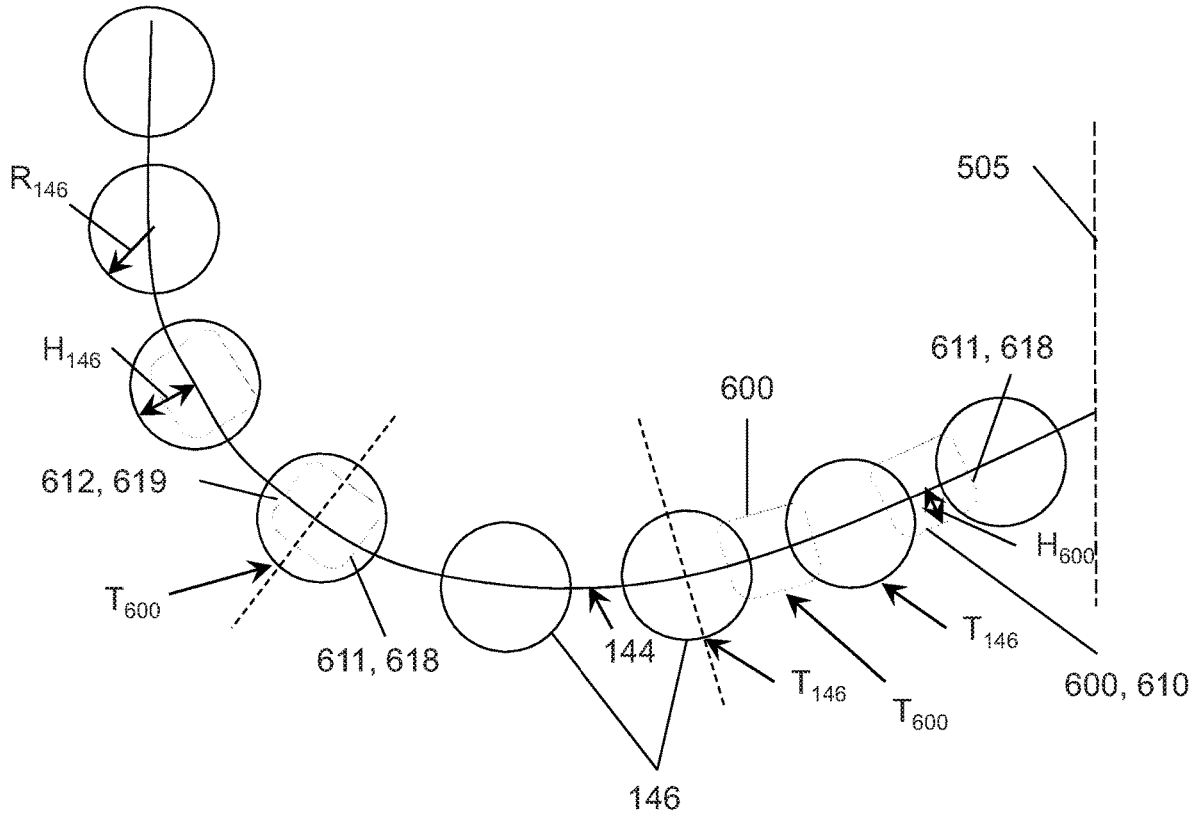
FIG. 14 is an enlarged rotated profile view of one of the primary blades and associated cutting faces and depth-of-cut limiting inserts of the drill bit of FIG. 12.

Referring now to FIG. 14, the profile of one exemplary blade 141, cutting faces 146 mounted thereto, and inserts 600 mounted thereto are shown rotated into a single rotated profile. Although only one blade 141 and associated cutting faces 146 and inserts 600 is shown in FIG. 14, it is to be understood that the other blades 141, 142 and associated cutting faces 146 and inserts 600 of bit 500 are arranged similarly. One or more cutter elements 145 and one or more depth-of-cut limiting inserts 600 are disposed in the cone region 149*a*, the shoulder region 149*b*, and the gage region 149*c*. Although depth-of-cut limiting inserts 600 are disposed in each region 149*a*, 149*b*, 149*c* in this embodiment, in general, one or more of the depth-of-cut limiting inserts 600 are preferably mounted to each blade 141, 142 in at least the cone region 149*a* and at or proximal the nose 149*d*.

Each depth-of-cut limiting insert 600 has an outermost bearing surface 610 defined by a tip $T_{600}$ positioned furthest from cutter-supporting surface 144 to which it is mounted (as measured perpendicularly from its respective cutter-supporting surface 144). In this embodiment, bearing tip $T_{600}$ is a contact surface. In addition, each depth-of-cut limiting insert 600 has a radial position defined by the radial distance measured perpendicularly from bit axis 605 to its bearing tip $T_{600}$. Still further, each depth-of-cut limiting insert 600 has an extension height $H_{600}$ measured perpendicularly from cutter-supporting surface 144 (or blade profile 148) to its bearing tip $T_{600}$. In this embodiment, each cutting face 146 extends to substantially the same extension height $H_{146}$, and each depth-of-cut limiting insert 600 extends to substantially the same extension height $H_{600}$ that is less than or equal to extension height $H_{146}$.

As shown in FIG. 13 and similar to the arrangement of inserts 200, 400 previously described, depth-of-cut limiting inserts 600 on each blade 141, 142 trail the cutter elements 145 on the same blade 141, 142 relative to the direction of rotation 506 of bit 500. However, unlike inserts 200, 400, each of which is positioned at substantially the same radial position as a corresponding cutting face 146 on the same blade 141, 142 and is completely eclipsed by a corresponding cutting face 146 on the same blade 141, 142, in this embodiment, select depth-of-cut limiting inserts 600 on each blade 141, 142 are positioned at radial positions between the radial positions of two corresponding cutting faces 146 on the same blade 141, 142 and are not completely eclipsed by a single cutting face 146 on the same blade 141, 142. More specifically, as best shown in FIGS. 13 and 14, in this embodiment, each depth-of-cut limiting insert 600 in the cone region 149*a* is disposed at a radial position that is between the radial positions of two corresponding cutting faces 146 on the same blade 141, 142, whereas each depth-of-cut limiting insert 600 in the shoulder region 149*b* and gage region 149*c* is positioned at substantially the same radial position as a corresponding cutting face 146 on the same blade 141, 142. As a result of the relative sizes, radial positions, and extension heights of cutting faces 146 and depth-of-cut limiting insert 600, the profile or path of each depth-of-cut limiting insert 600 in cone region 149*a* is only partially eclipsed and overlapped by the cutting profile or path of one or more corresponding cutting faces 146 on the same blade 141, 142, while each depth-of-cut limiting insert 600 in the shoulder region 149*b* and gage region 149*c* is completely eclipsed and overlapped by the cutting profile or path of a corresponding cutting face 146 on the same blade 141, 142.

Figure 15A:
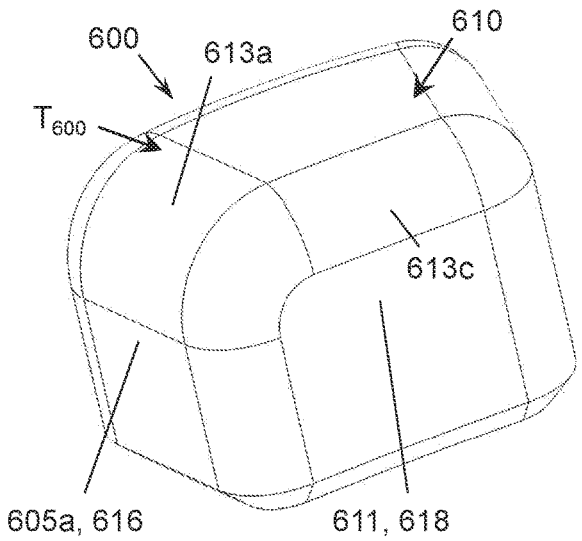
FIGS. 15A-15D are perspective, top, end, and side views, respectively, of one of the depth-of-cut limiting inserts of the drill bit of FIG. 12.
Figure 15B:
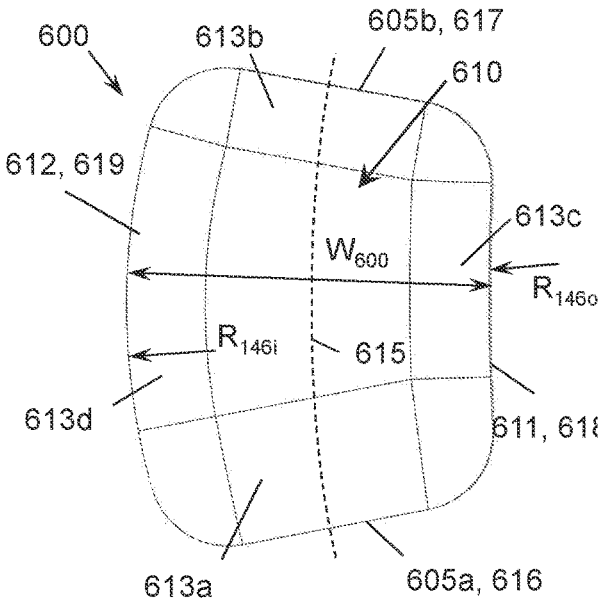
Figure 15C:
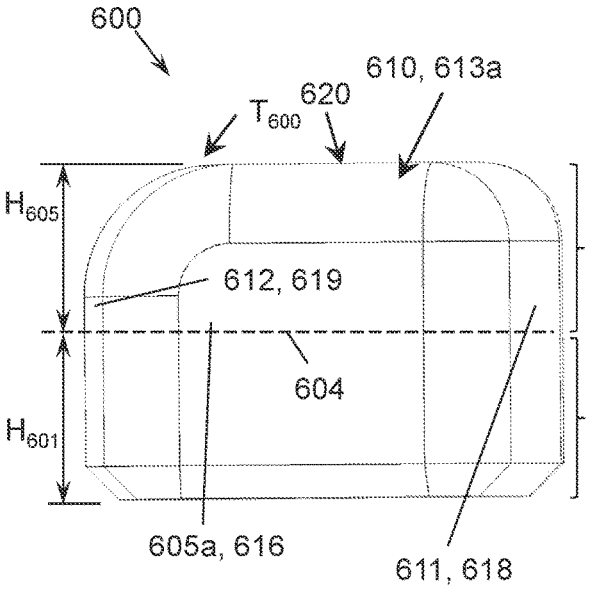
Figure 15D:
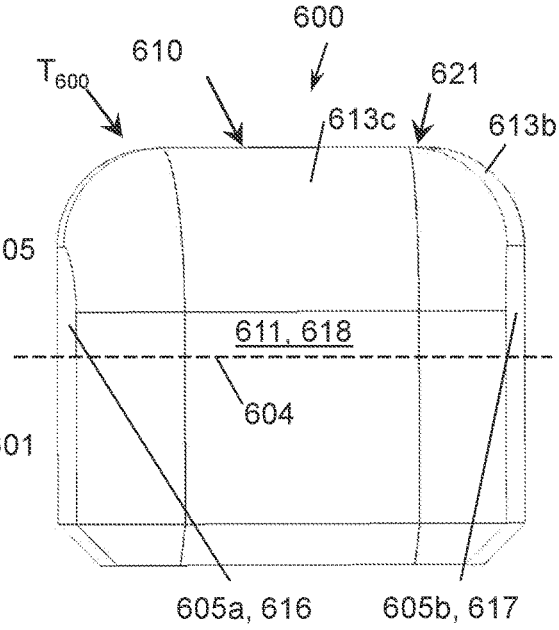

Referring now to FIGS. 15A-15D, one depth-of-cut limiting insert 600 is shown, it is to be understood that all inserts 600 are the same. Insert 600 is substantially the same as insert 200 previously described with the exception of the geometry of the crown. More specifically, in this embodiment, insert 600 includes a base portion 601 and a formation engaging portion 605 extending therefrom. As shown in FIGS. 15C and 15D, reference plane of intersection 604 divides insert 600 into base portion 601 and formation engaging portion 605. In this embodiment, base portion 601 is generally rectangular in end and side view (FIGS. 15C and 15D, respectively) and slightly arcuate in top view (FIG. 15B). As best shown in FIG. 15C, base portion 601 has a height $H_{601}$, and formation engaging portion 605 extends from base portion 601 to a height $H_{605}$. Base portion 601 is retained within a mating socket in cutter-supporting surface 144 of a blade 141, 142 by interference fit, or by other means, such as brazing or welding, such that formation engaging portion 605 extends from cutter supporting surface 144. In other words, when insert 600 is mounted to a blade 141, 142, base portion 601 is the part of insert 600 seated in the mating socket such that a projection of the plane of intersection 604 is generally aligned with cutter-supporting surface 144 of that blade 141, 142. Thus, once mounted to a blade 141, 142, the height $H_{605}$ of portion 605 is generally the distance from the cutter-supporting surface 144 to the outermost point, line, or surface of formation engaging portion 605 as measured perpendicular to cutter-supporting surface 144, and thus, defines the extension height $H_{600}$ of insert 600.

Referring still to FIGS. 15A-15D, formation engaging portion 605 has an outer or formation engaging surface 610 extending from plane of intersection 604 and an elongate, arcuate central or longitudinal axis 615. In addition, formation engaging portion 605 includes a first end 605*a*, a second end 605*b* longitudinally opposite end 605*a*, a pair of lateral sides 611, 612, and an elongate crown 613. Lateral sides 611, 612 extend longitudinally between ends 605*a*, 605*b*, and thus, sides 611, 612 are disposed on opposite sides of axis 615 and extend generally parallel to axis 615. Axis 615 intersects each end 605*a*, 605*b* perpendicularly thereto and is equidistant from sides 611, 612. Elongate crown 613 extends longitudinally between ends 605*a*, 605*b* generally parallel to axis 615 and laterally between sides 411, 412. Crown 613 intersects ends 605*a*, 605*b* at end corners 613*a*, 613*b*, respectively, and intersects sides 611, 612 at side corners 613*c*, 613*d*, respectively. In this embodiment, corners 613*a*, 613*b*, 613*c*, 613*d* are radiused such that there is a smooth, continuously contoured transition between crown 613 and ends 605*a*, 605*b* and between crown 613 and sides 611, 612. Unlike crowns 213, 413 previously described, which are convex and include an elongate peaked ridge 214, 414, respectively, in this embodiment, crown 613 comprises a planar surface 614 disposed at and defining the extension height $H_{600}$ of insert 600. Insert 600 has a width $W_{600}$ measured perpendicular to axis 615 between lateral sides 611, 612 in top view (FIG. 15B).

In this embodiment, ends 605*a*, 605*b* comprise planar surfaces 616, 617, respectively, and lateral sides 611, 612 comprise arcuate or curved surfaces 618, 619, respectively. In particular, surface 618 is concave or bowed inwardly, and surface 619 is convex or bowed outwardly. The curvature of sides 611, 612 and associated surfaces 618, 619, respectively, results in the general C-shaped arcuate geometry of insert 600 in top view (FIG. 15B). As best shown in FIG. 13, in this embodiment, inserts 600 are mounted to blades 141, 142 such that (a) ends 605*a*, 605*b* are generally oriented perpendicular to the direction of rotation 506 of bit 500 with each end 605*a* leading the corresponding end 605*b* of the same insert 600 relative to the direction of rotation 506 of bit 500 (i.e., axis 615 is generally aligned with direction of rotation 606); and (b) each lateral side 611 positioned radially inwardly of the corresponding lateral side 612 of the same insert 600. Accordingly, ends 605*a*, 605*b* may also be referred to as leading and trailing ends, respectively, and sides 611, 612 may also be referred to as radially inner and radially outer sides, respectively. Thus, insert 600 is generally shaped and oriented similarly to insert 200 previously described. In addition, similar to insert 200 previously described, in this embodiment, concave surface 618 of radially inner side 611 of insert 600 has a radius of curvature equal to radius $R_{146o}$ and convex surface 619 of radially outer side 612 of insert 600 has a radius of curvature equal to radius $R_{146i}$. As previously described, radius $R_{146i}$ is less than radius $R_{146o}$, and thus, the width $W_{600}$ of insert 600 changes moving along longitudinal axis 615. More specifically, width $W_{600}$ is smallest at ends 605*a*, 605*b*, largest in the middle of insert 600 (equidistant from ends 605*a*, 605*b*), and continuously and gradually increases moving along axis 615 from each end 605*a*, 605*b* to the middle of insert 600. In other embodiments, the concave surface of the radially inner side (e.g., concave surface 618 of side 611) of the insert (e.g., insert 600) has a radius of curvature equal to radius $R_{146o}$ and convex surface of the radially outer side (e.g., convex surface 619 of side 612) of the insert has a radius of curvature equal to radius $R_{146i}$.

Referring to the end and side views of FIGS. 15C and 15D, respectively, lateral side surfaces 618, 619 and crown 613 define a front periphery or profile 620 of insert 600 generally viewed along axis 615 (FIG. 15C), while end surfaces 616, 617 and crown 613 define a side periphery or profile 621 of insert 600 generally viewed perpendicular to axis 615 (FIG. 15D). As seen in front profile 620 (FIG. 15C), lateral side surfaces 618, 619 are generally straight in the region between base portion 601 and crown 613. Likewise, as seen in side profile 621 (FIG. 15D), end surfaces 616, 617 are generally straight in the region between base portion 601 and crown 613. As best shown in the front profile 620 of FIG. 15C, planar surface 614 of crown 613 extends between side corners 413*c*, 413*d*. Thus, the entire planar surface 614 defines the top bearing tip $T_{600}$ of insert 600.

During drilling operations, each cutting face 146 engages, penetrates, and shears the formation as the bit 500 is rotated in the cutting direction 506 and is advanced through the formation. As each cutting face 146 advances through the formation, it cuts a kerf in the formation generally defined by the cutting profile of the cutting face 146. As each pair of radially adjacent cutting faces 146 advances through the formation, a ridge of uncut formation is formed between the kerfs. In embodiments described herein where the depth-of-cut limiting insert 600 is radially positioned between two adjacent cutting faces 146 (e.g., in the cone region 149*a*), when the depth-of-cut of the cutting face 146 is sufficiently large, the formation bearing surface 610 of the depth-of-cut limiting insert 600 engages the ridge of uncut formation defined by the adjacent kerfs. The depth-of-cut limiting inserts 600 are not intended to penetrate and shear the formation, but rather, contact and slide across the ridge of uncut formation, thereby limiting a further increase in the depth-of-cut of the corresponding cutting faces 146 on the same blade. As the depth-of-cut limiting insert 600 is non-aggressive and not intended to penetrate or shear the formation, its formation bearing surface 610 slides across the ridge of uncut formation, thereby limiting the penetration of corresponding cutting faces 146. In addition, due to the elongate geometry of the depth-of-cut limiting inserts 600, as well as the planar surface 614 disposed at the extension height $H_{600}$, the depth-of-cut limiting inserts 600 provide increased surface area for engaging the ridge of uncut formation as compared to similarly sized dome-shaped depth-of-cut limiters, and thus, may be particularly beneficial for limiting the depth-of-cut in relatively soft formations.

Figure 16:
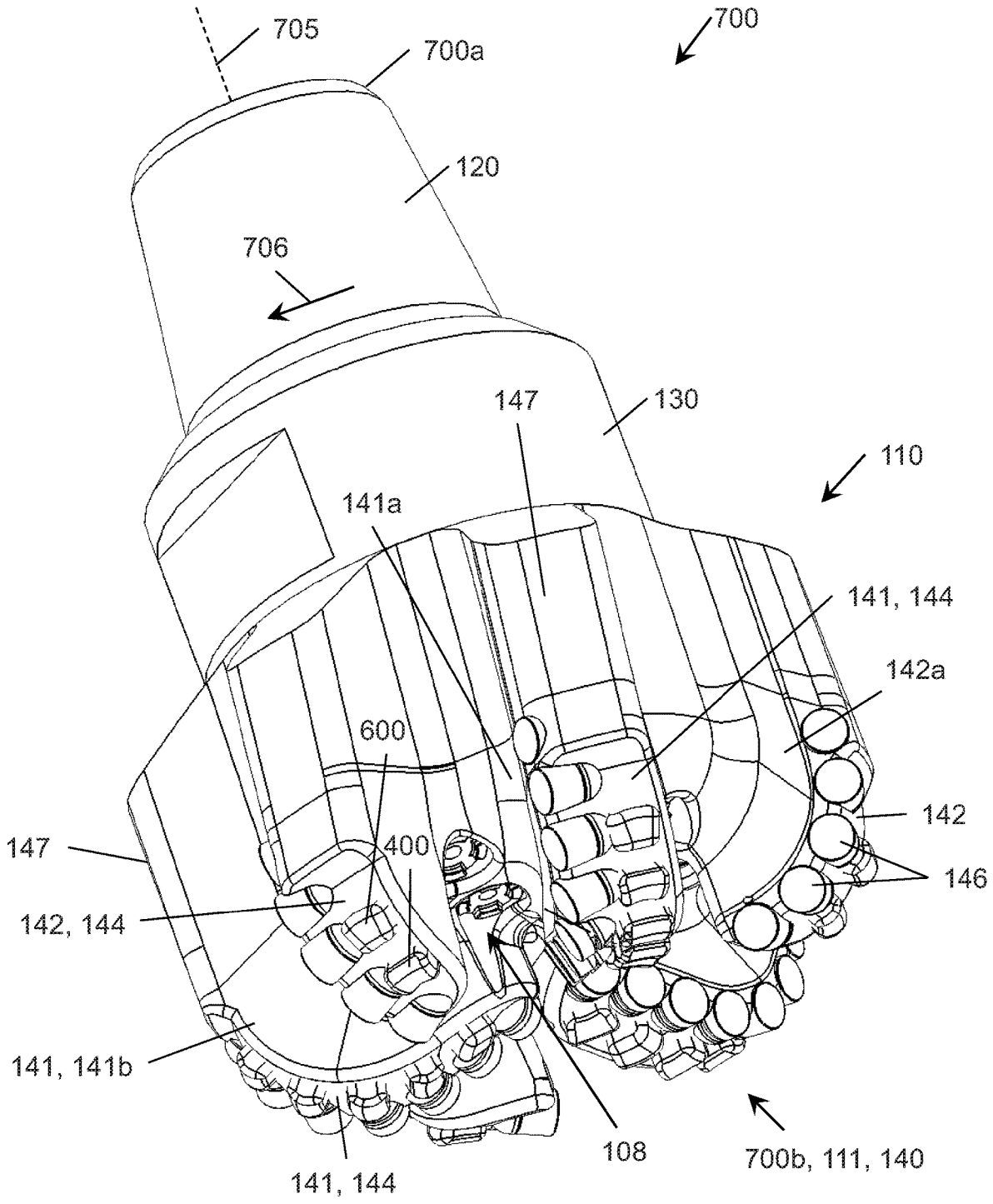
FIG. 16 is a perspective view of an embodiment of a drill bit with a plurality of depth-of-cut limiting inserts in accordance with the principles described herein.
Figure 17:
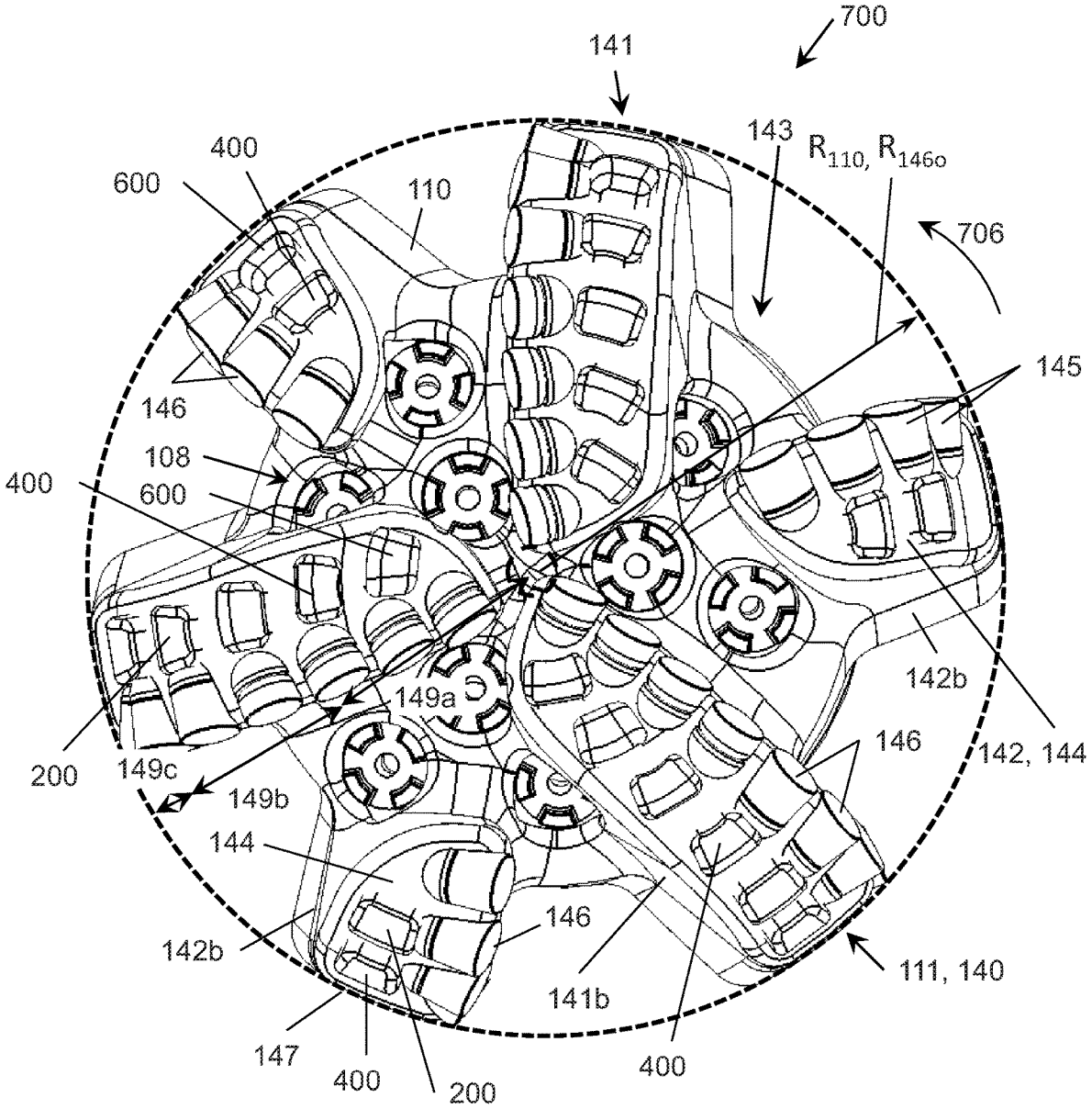
FIG. 17 is an end view of the drill bit of FIG. 16.

In bits 100, 300, 500 previously described, only one type of depth-of-cut limiting insert 200, 400, 600, respectively, was provided. However, in general, any one or more of depth-of-cut limiting inserts disclosed herein (e.g., DOC limiting inserts 200, 400, 600, 900, 1100, 1300) can be included on a single bit to manage and control the depth-of-cut of the cutter elements on that bit. For example, referring now to FIGS. 16 and 17, an embodiment of a fixed cutter bit 700 that includes depth-of-cut limiting inserts 200, 400, 600 is shown. Bit 700 can be used in place of bit 100 in drilling system 10 previously described.

Bit 700 is substantially the same as bit 100 previously described. Namely, bit 700 has a central or longitudinal axis 705, a first or uphole end 700*a*, a second or downhole end 700*b*, and a cutting direction or rotation 706 about axis 705. In addition, bit 700 includes a bit body 110 extending axially from downhole end 700*b*, a threaded connection or pin 120 extending axially from uphole end 700*a*, and a shank 130 extending axially between pin 120 and body 110. Bit body 110, pin 120, and shank 130 are each as previously described. Thus, for example, the portion of bit body 110 that faces the formation at downhole end 700*b* includes bit face 111 and cutting structure 140.

Each blade 141, 142 includes cutter-supporting surface 144 for mounting a plurality of cutter elements 145 arranged adjacent one another in a radially extending row proximal the leading edge of each primary blade 141 and each secondary blade 142. In this embodiment, all three embodiments of depth-of-cut limiting inserts 200, 400, 600 are mounted to cutter-supporting surfaces 144 of blades 141, 142. Each insert 200, 400, 600 is as previously described and is oriented relative to cutting faces 146 as previously described. In general, inserts 200, 400, 600 can be positioned at any desired radial position along any blade 141, 142 such as in the cone region 149*a*, the shoulder region 149*b*, the gage region 149*c*, or combinations thereof. In embodiments of bits including both types of inserts 200, 400 (e.g., bit 700), to enhance the contact surface area between inserts 200, 400 with the surrounding formation, inserts 200, 400 are preferably positioned as shown in Table 1 below

TABLE 1

| Bit Spiral | Insert type within cone region | Insert type outside cone region |
|---|---|---|
| Forward spiral bit | Insert 400 | Insert 200 |
| Reverse spiral bit | Insert 200 | Inserts 400 |

Figure 18:
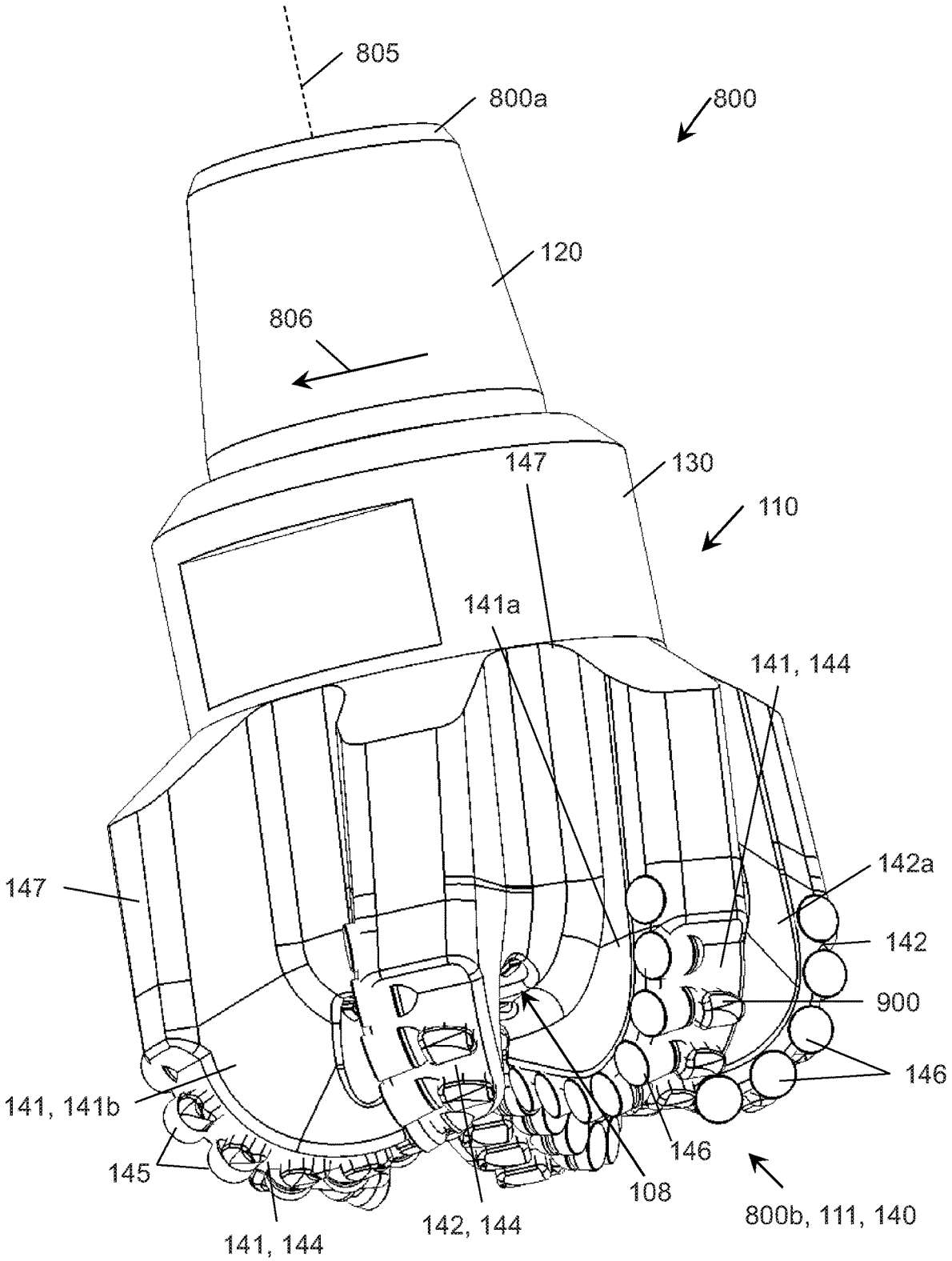
FIG. 18 is a perspective view of an embodiment of a drill bit with a plurality of depth-of-cut limiting inserts in accordance with the principles described herein.
Figure 19:
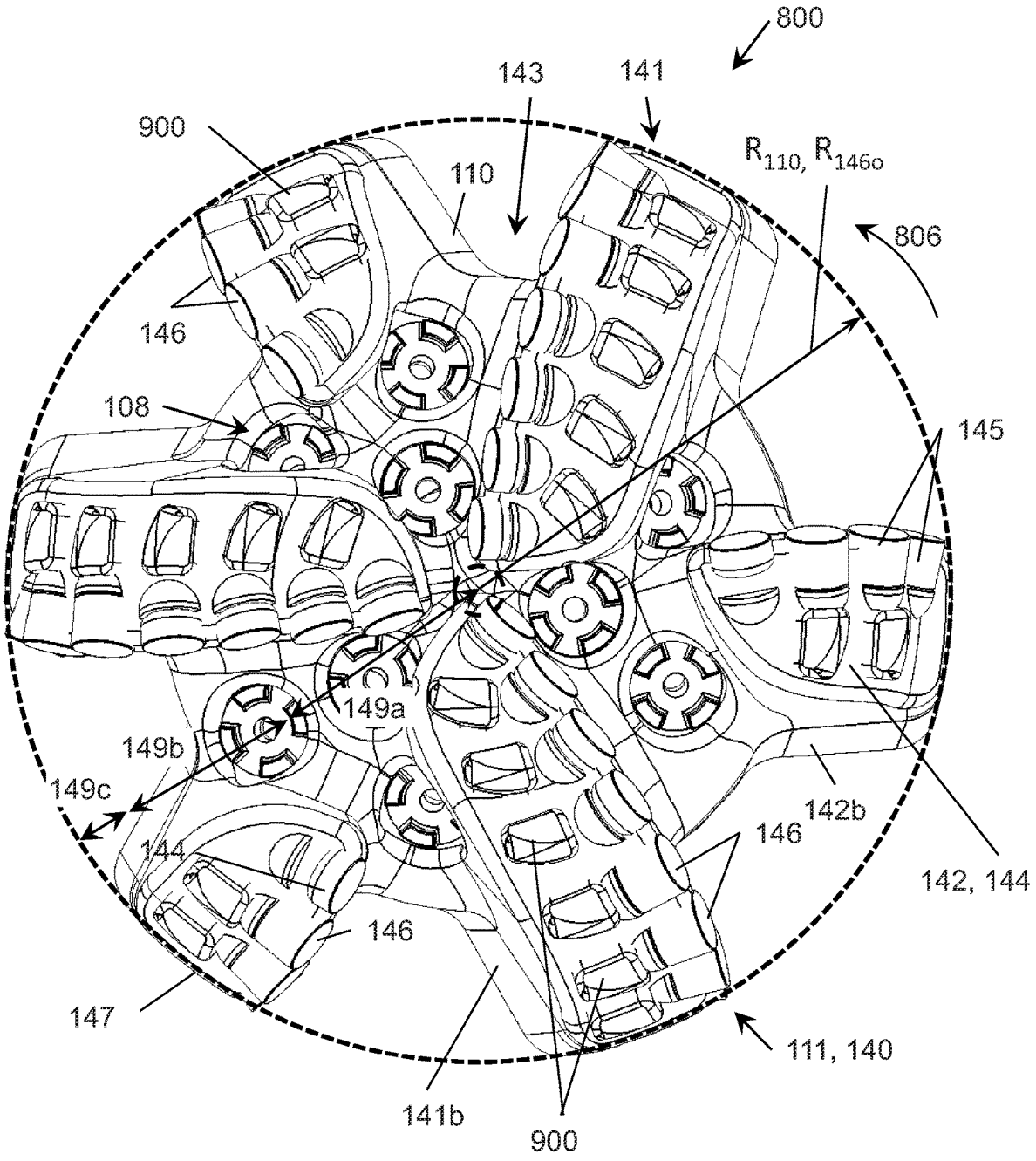
FIG. 19 is an end view of the drill bit of FIG. 18.

Referring now to FIGS. 18 and 19, another embodiment of a fixed cutter drill bit 800 is shown. Bit 800 can be used in place of bit 100 in drilling system 10 previously described. Bit 800 is substantially the same as bit 100 previously described. Namely, bit 800 has a central or longitudinal axis 805, a first or uphole end 800*a*, a second or downhole end 800*b*, and a cutting direction or rotation 806 about axis 805. In addition, bit 800 includes a bit body 110 extending axially from downhole end 800*b*, a threaded connection or pin 120 extending axially from uphole end 800*a*, and a shank 130 extending axially between pin 120 and body 110. Bit body 110, pin 120, and shank 130 are each as previously described. Thus, for example, the portion of bit body 110 that faces the formation at downhole end 800*b* includes bit face 111 and cutting structure 140.

Each blade 141, 142 includes cutter-supporting surface 144 for mounting a plurality of cutter elements 145 arranged adjacent one another in a radially extending row proximal the leading edge of each primary blade 141 and each secondary blade 142. However, in this embodiment, the plurality of depth-of-cut limiting inserts 200 are replaced with a plurality of depth-of-cut limiting inserts 900. In particular, the plurality of DOC limiting inserts 900 are arranged adjacent one another in a radially extending row on each primary blade 141 and each secondary blade 142. The row of DOC limiting inserts 900 on each blade 141, 142 trails the row of cutter elements 145 on the same blade 141, 142 relative to the direction of rotation 806 of bit 800. Similar to depth-of-cut limiting inserts 200 previously described, depth-of-cut limiting inserts 900 are intended to limit the maximum depth-of-cut of cutting faces 146 as they engage the formation. As will be described in more detail below and similar to inserts 200, each depth-of-cut limiting insert 900 includes an outer formation engaging surface 910 extending from cutter-supporting surface 144 of the corresponding blade 141, 142. Surfaces 910 of inserts 900 are intended to slide across the formation and limit the depth to which cutting faces 146 bite or penetrate into the formation. Thus, depth-of-cut limiting inserts 900 are not intended to penetrate and shear the formation.

Figure 20:
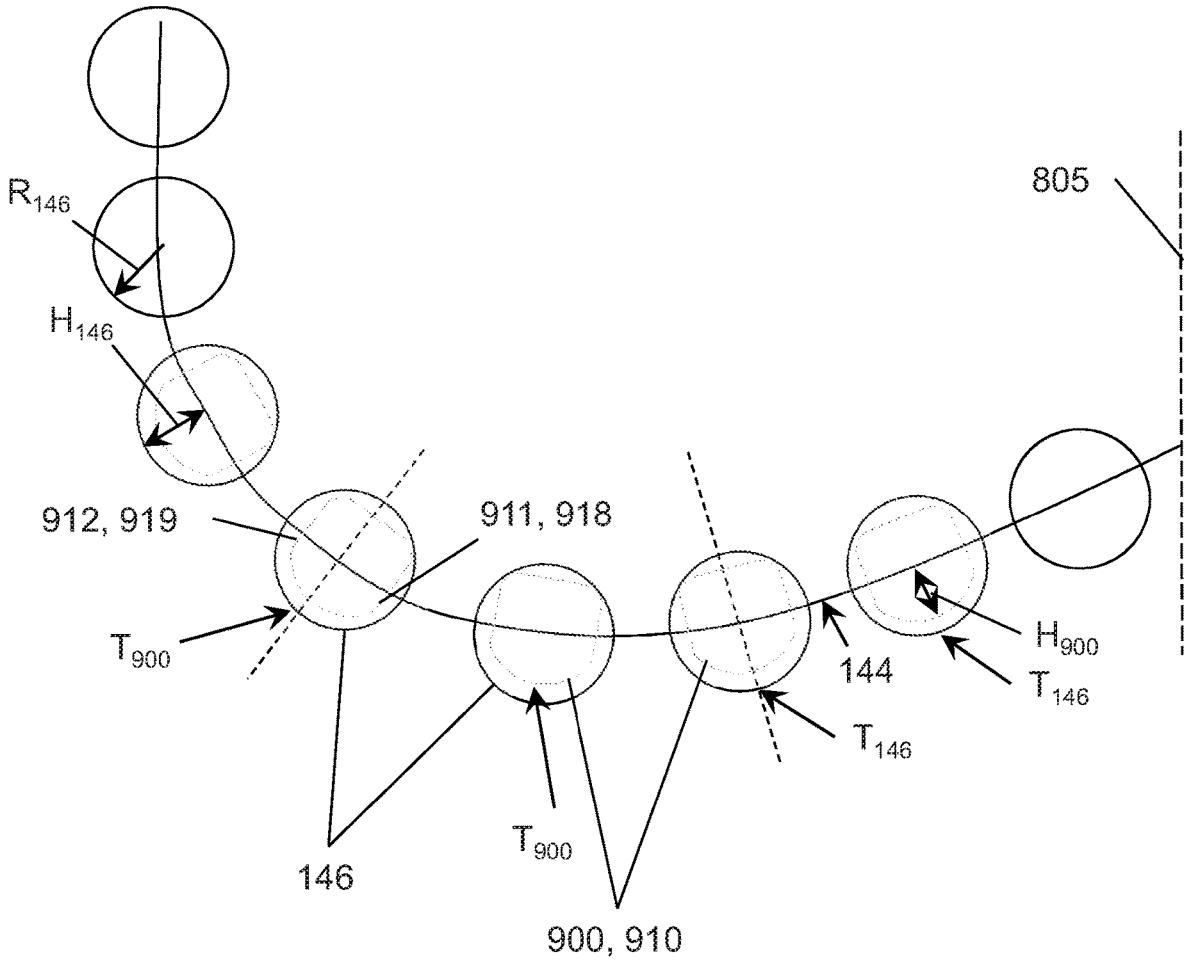
FIG. 20 is an enlarged rotated profile view of one of the primary blades and associated cutting faces and depth-of-cut limiting inserts of the drill bit of FIG. 18.

Referring now to FIG. 20, the profile of one exemplary blade 141, cutting faces 146 mounted thereto, and inserts 900 mounted thereto are shown rotated into a single rotated profile. Although only one blade 141 and associated cutting faces 146 and inserts 900 is shown in FIG. 20, it is to be understood that the other blades 141, 142 and associated cutting faces 146 and inserts 900 of bit 800 are arranged similarly. One or more cutter elements 145 and one or more depth-of-cut limiting inserts 900 are disposed in the cone region 149*a*, the shoulder region 149*b*, and the gage region 149*c*. Although depth-of-cut limiting inserts 900 are disposed in each region 149*a*, 149*b*, 149*c* in this embodiment, in general, one or more of the depth-of-cut limiting inserts 900 are preferably mounted to each blade 141, 142 in at least the cone region 149*a* and at or proximal the nose 149*d*.

Each depth-of-cut limiting insert 900 has an outermost bearing surface 910 defined by a tip $T_{900}$ positioned furthest from cutter-supporting surface 144 to which it is mounted (as measured perpendicularly from its respective cutter-supporting surface 144). In this embodiment, bearing tip $T_{900}$ is a contact surface. In addition, each depth-of-cut limiting insert 900 has a radial position defined by the radial distance measured perpendicularly from bit axis 805 to its bearing tip $T_{900}$. Still further, each depth-of-cut limiting insert 900 has an extension height $H_{900}$ measured perpendicularly from cutter-supporting surface 144 (or blade profile 148) to its bearing tip $T_{900}$. In this embodiment, each cutting face 146 extends to substantially the same extension height $H_{146}$, and each depth-of-cut limiting insert 900 extends to substantially the same extension height $H_{900}$ that is less than or equal to extension height $H_{146}$.

As previously described and shown in FIG. 19, depth-of-cut limiting inserts 900 on each blade 141, 142 trail the cutter elements 145 on the same blade 141, 142 relative to the direction of rotation 806 of bit 800. More specifically, in this embodiment, each depth-of-cut limiting insert 900 on each blade 141, 142 is positioned immediately behind and trails a corresponding cutter element 145 on the same blade 141, 142. Thus, as best shown in FIG. 20, each depth-of-cut limiting insert 900 is disposed at substantially the same radial position as the cutting face 146 of the corresponding cutter element 145. As a result of the relative sizes, radial positions, and extension heights of cutting faces 146 and depth-of-cut limiting insert 900, the profile or path of each depth-of-cut limiting insert 900 is completely eclipsed and overlapped by the cutting profile or path of its associated primary cutting face 146.

Figure 21A:
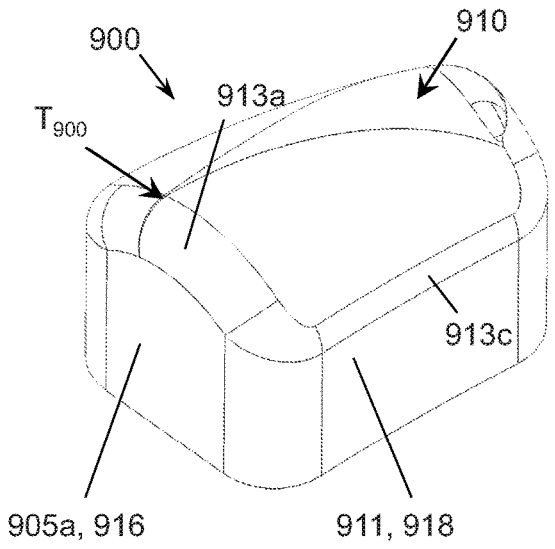
FIGS. 21A-21D are perspective, top, end, and side views, respectively, of one of the depth-of-cut limiting inserts of the drill bit of FIG. 18.
Figure 21B:
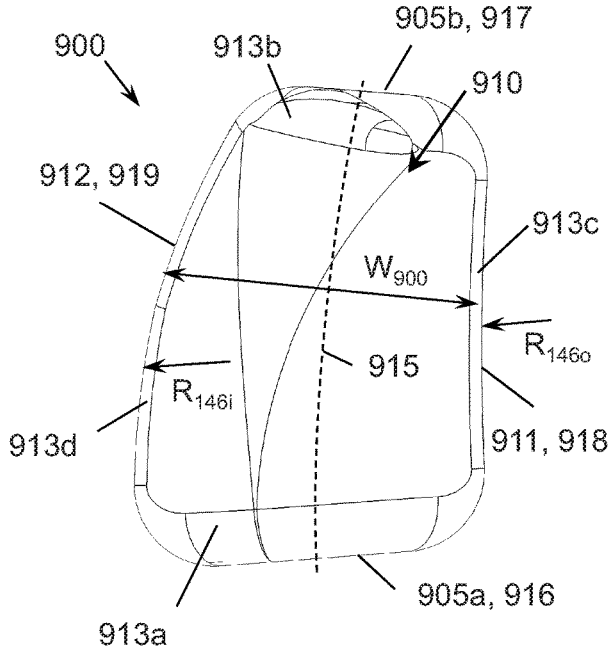
Figure 21C:
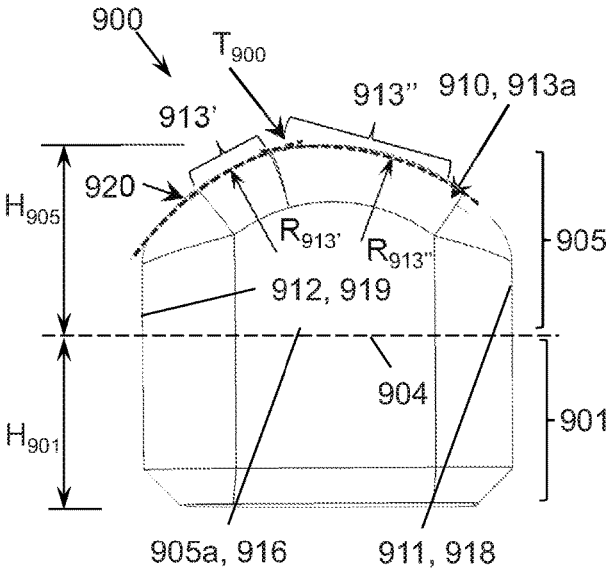
Figure 21D:
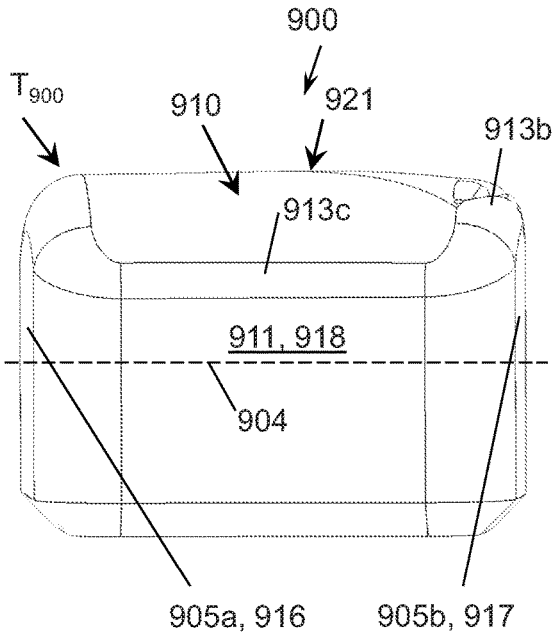

Referring now to FIGS. 21A-21D, one depth-of-cut limiting insert 900 is shown, it is to be understood that all inserts 900 are the same. Insert 900 is substantially the same as insert 200 previously described with the exception of the widths of the ends. More specifically, in this embodiment, insert 900 includes a base portion 901 and a formation engaging portion 905 extending therefrom. As shown in FIGS. 21C and 21D, reference plane of intersection 904 divides insert 900 into base portion 901 and formation engaging portion 905. In this embodiment, base portion 901 is generally rectangular in end and side view (FIGS. 21C and 21D, respectively) and slightly arcuate and trapezoidal in top view (FIG. 21B). As best shown in FIG. 21C, base portion 901 has a height $H_{901}$, and formation engaging portion 905 extends from base portion 901 to a height $H_{905}$. Base portion 901 is retained within a mating socket in cutter-supporting surface 144 of a blade 141, 142 by interference fit, or by other means, such as brazing or welding, such that formation engaging portion 905 extends from cutter supporting surface 144. In other words, when insert 900 is mounted to a blade 141, 142, base portion 901 is the part of insert 900 seated in the mating socket such that a projection of the plane of intersection 904 is generally aligned with cutter-supporting surface 144 of that blade 141, 142. Thus, once mounted to a blade 141, 142, the height $H_{905}$ of portion 905 is generally the distance from the cutter-supporting surface 144 to the outermost point, line, or surface of formation engaging portion 905 as measured perpendicular to cutter-supporting surface 144, and thus, defines the extension height of insert 900.

Referring still to FIGS. 21A-21D, formation engaging portion 905 has an outer or formation engaging surface 910 extending from plane of intersection 904 and an elongate, arcuate central or longitudinal axis 915. In addition, formation engaging portion 905 includes a first end 905*a*, a second end 905*b* longitudinally opposite end 905*a*, a pair of lateral sides 911, 912, and an elongate crown 913. Lateral sides 911, 912 extend longitudinally between ends 905*a*, 905*b*, and thus, sides 911, 912 are disposed on opposite sides of axis 915 and extend generally parallel to axis 915. Axis 915 intersects each end 905*a*, 905*b* perpendicularly thereto and is equidistant from sides 911, 912. Elongate crown 913 extends longitudinally between ends 905*a*, 905*b* generally parallel to axis 915 and laterally between sides 911, 912. Crown 913 intersects ends 905*a*, 905*b* at end corners 913*a*, 913*b*, respectively, and intersects sides 911, 912 at side corners 913*c*, 913*d*, respectively. In this embodiment, corners 913*a*, 913*b*, 913*c*, 913*d* are radiused such that there is a smooth, continuously contoured transition between crown 913 and ends 905*a*, 905*b* and between crown 913 and sides 911, 912. In this embodiment, crown 913 is smoothly curved and convex (i.e., outwardly bowed) as it extends laterally between sides 911, 912 and smoothly transitions into side corners 913*c*, 913*d*. Crown 913 has an elongate arcuate peaked ridge 914 generally extending to and defining the extension height of insert 900. Insert 900 has a width $W_{900}$ measured perpendicular to axis 915 between lateral sides 911, 912 in top view (FIG. 21B).

In this embodiment, ends 905*a*, 905*b* comprise planar surfaces 916, 917, respectively, and lateral sides 911, 912 comprise arcuate or curved surfaces 918, 919, respectively. In particular, surface 918 is concave or bowed inwardly, and surface 919 is convex or bowed outwardly. The curvature of sides 911, 912 and associated surfaces 918, 919, respectively, results in the general C-shaped arcuate geometry of insert 900 in top view (FIG. 21B). As best shown in FIG. 19, in this embodiment, inserts 900 are mounted to blades 141, 142 such that (a) ends 905*a*, 905*b* are generally oriented perpendicular to the direction of rotation 806 of bit 800 with each end 905*a* leading the corresponding end 905*b* of the same insert 900 relative to the direction of rotation 806 of bit 800 (i.e., axis 915 is generally aligned with direction of rotation 806); and (b) each lateral side 911 positioned radially inwardly of the corresponding lateral side 912 of the same insert 900. Accordingly, ends 905*a*, 905*b* may also be referred to as leading and trailing ends, respectively, and sides 911, 912 may also be referred to as radially inner and radially outer sides, respectively. Thus, insert 900 is generally shaped and oriented similarly to insert 200 previously described. Similar to insert 200 previously described, concave surface 918 of radially inner side 911 of insert 900 has a radius of curvature equal to radius $R_{146o}$ and convex surface 919 of radially outer side 912 of insert 900 has a radius of curvature equal to radius $R_{146i}$. As previously described, radius $R_{146i}$ is less than radius $R_{146o}$, and thus, the width $W_{900}$ of insert 900 changes moving along longitudinal axis 915. In contrast to insert 200 previously described where the width $W_{200}$ is largest in the middle between ends 205*a*, 205*b*, in this embodiment, $W_{900}$ is largest at leading end 905*b*, smallest at trailing end 905*b*, and continuously and gradually decreases moving along axis 915 from leading end 905*a* to trailing end 905*b*.

Referring to the end and side views of FIGS. 21C and 21D, respectively, lateral side surfaces 918, 919 and crown 913 define a front periphery or profile 920 of insert 900 generally viewed along axis 915 (FIG. 21C), while end surfaces 916, 917 and peaked ridge 914 define a side periphery or profile 921 of insert 900 generally viewed perpendicular to axis 915 (FIG. 21D). As seen in front profile 920 (FIG. 21C), lateral side surfaces 918, 919 are generally straight in the region between base portion 901 and crown 913. Likewise, as seen in side profile 921 (FIG. 21D), end surfaces 916, 917 are generally straight in the region between base portion 901 and crown 913.

As best shown in the front profile 920 of FIG. 21C, crown 913 is smoothly curved between side corners 913*c*, 913*d*. The apex of peaked ridge 914 at end corner 913*a* defines bearing tip $T_{900}$. In the front profile 920 of FIG. 21C, crown 913 and peaked ridge 914 are generally convex. In this embodiment, the crown 913 includes two sections or portions 913', 913" that intersect in end view. In the front profile view 920, the transition between portions 913', 913" is defined by the intersection of two circles (shown with dashed lines in FIG. 21C) having radii $R_{913'}$, $R_{913''}$. Thus, in front profile view 920, radius of curvature $R_{913'}$, $R_{913''}$ represents the radius of curvature of the corresponding portion 913', 913", respectively. In general, each radius $R_{913'}$, $R_{913''}$, can be the same or different, and further, each radius $R_{913'}$, $R_{913''}$ of crown 913 is preferably less than or equal to radius $R_{146}$ of the corresponding cutting face 146. In this embodiment, both radii $R_{913'}$, $R_{913''}$ are the same, and in particular are equal to the radius $R_{146}$ of cutting face 146. The location where portions 913', 913" intersect can be varied depending on the radial position of the insert 900 on the bit 800.

As best shown in the side profile 921 of FIG. 21D, peaked ridge 914 is slightly convex or bowed outwardly between end corners 913*a*, 913*b*. Although peaked ridge 914 is slightly convex between end corners 913*a*, 913*b* in side profile 921, in other embodiments, the peaked ridge (e.g., peaked ridge 914) may be concave or bowed inwardly or flat between the end corners (e.g., end corners 913*a*, 913*b*) in side profile (e.g., side profile 921). To enhance the contact surface area between formation engaging surface 910 and the formation during drilling operations, in embodiments described herein, each insert 900 positioned radially inside nose 129*d* (i.e., along cone region 149*a*) of bit 800 preferably has a peaked ridge 914 that is slightly concave between end corners 913*a*, 913*b* in side profile 921, and each insert 900 positioned radially outside nose 129*d* (i.e., along shoulder region 129*b* and gage region 149*c*) of bit 800 preferably has a peaked ridge 914 that is slightly convex between end corners 913*a*, 913*b* in side profile 921.

During drilling operations, each cutting face 146 engages, penetrates, and shears the formation as the bit 800 is rotated in the cutting direction 806 and is advanced through the formation. As each cutting face 146 advances through the formation, it cuts a kerf in the formation generally defined by the cutting profile of the cutting face 146. In embodiments described herein, when the depth-of-cut of a cutting face 146 is sufficiently large, the formation bearing surface 910 of the depth-of-cut limiting insert 900 associated with and trailing the cutting face 146 will engage the formation, and more specifically, engage the kerf cut in the formation by the cutting face 146. The depth-of-cut limiting inserts 900 are not intended to penetrate and shear the formation, but rather, contact and slide across the formation, thereby limiting a further increase in the depth-of-cut of the corresponding cutting faces 146. As the depth-of-cut limiting insert 900 is non-aggressive and not intended to penetrate or shear the formation, the formation bearing surface 910 slides across the formation, thereby limiting the penetration of corresponding cutting face 146. In addition, due to the elongate geometry of the depth-of-cut limiting inserts 900, the radii $R_{913'}$, $R_{913''}$ of the crown 913, each matching the radius $R_{146}$ of the corresponding cutting face 146, and the concavity or convexity of peaked ridge 914 in side profile 921 depending on the radial position of the insert 900 (concave peaked ridge 914 for inserts 900 positioned radially inside nose 129*d* and convex peaked ridge 914 for inserts 900 positioned radially outside nose 129*d*), the depth-of-cut limiting inserts 900 provide increased bearing surface area for engaging and sliding across the formation as compared to similarly sized dome-shaped depth-of-cut limiters, and thus, may be particularly beneficial for limiting the depth-of-cut in relatively soft formations.

Figure 22:
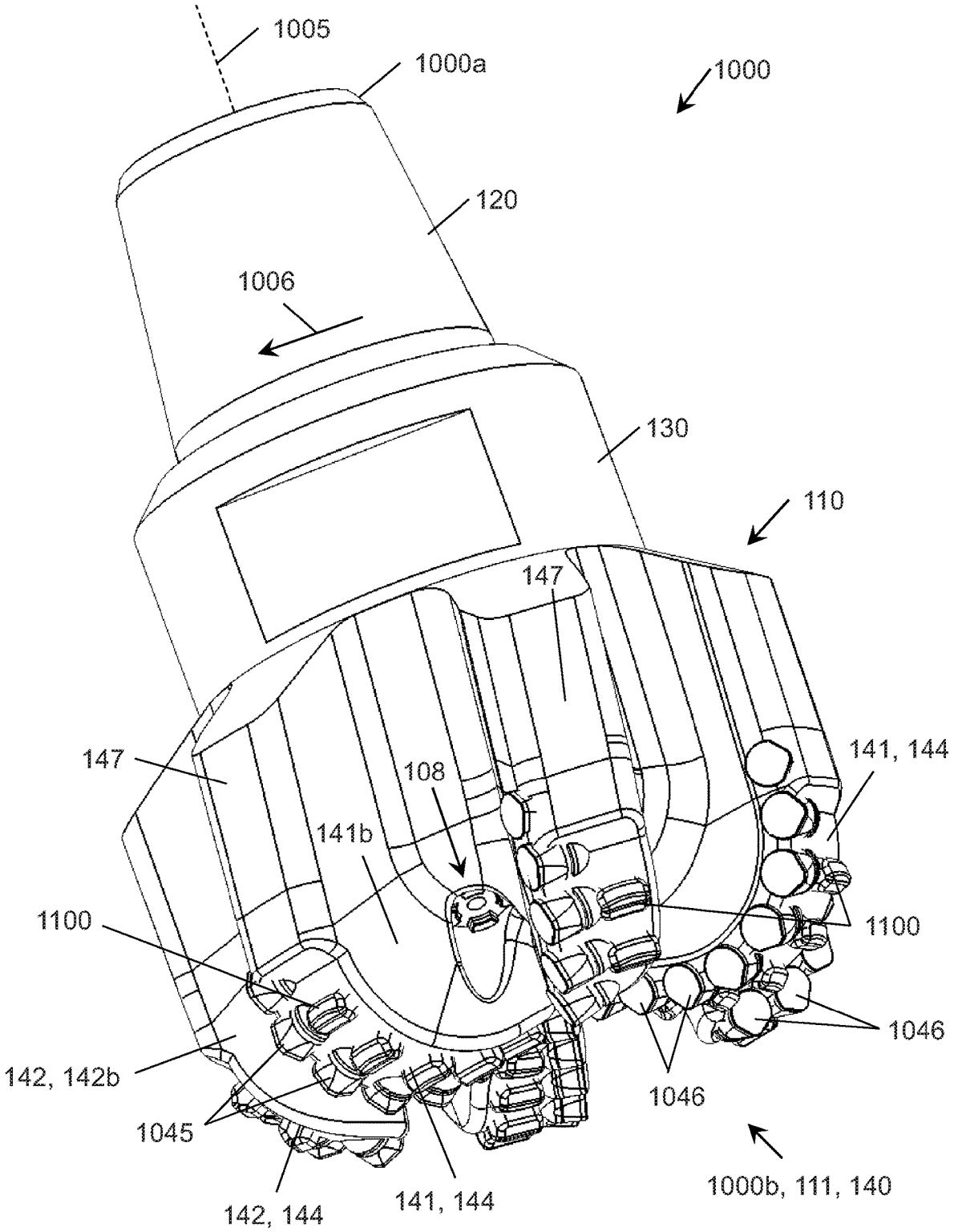
FIG. 22 is a perspective view of an embodiment of a drill bit with a plurality of depth-of-cut limiting inserts in accordance with the principles described herein.
Figure 23:
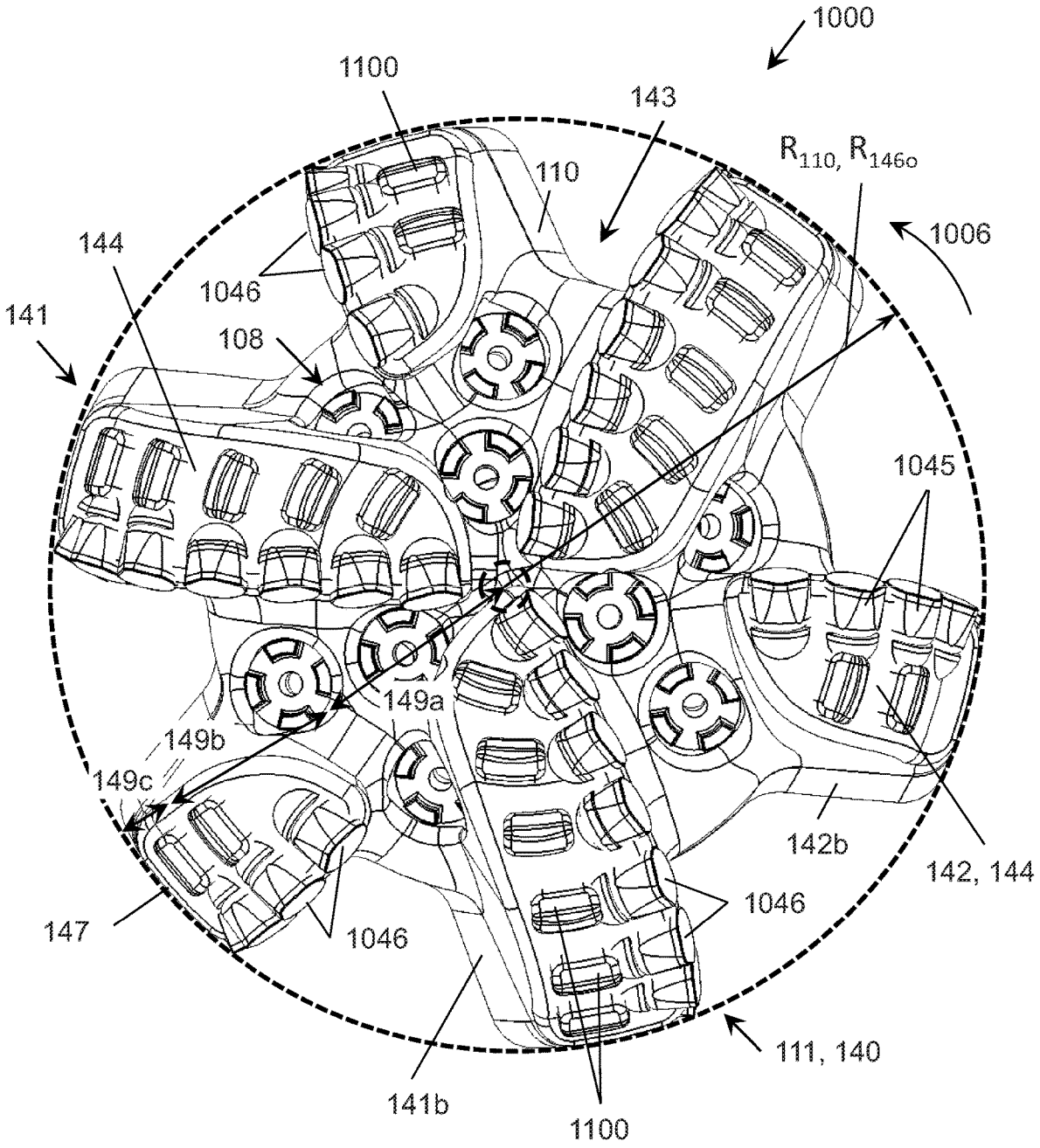
FIG. 23 is an end view of the drill bit of FIG. 22.

Referring now to FIGS. 22 and 23, another embodiment of a fixed cutter drill bit 1000 is shown. Bit 1000 can be used in place of bit 100 in drilling system 10 previously described. Bit 1000 is substantially the same as bit 100 previously described. Namely, bit 1000 has a central or longitudinal axis 1005, a first or uphole end 1000*a*, a second or downhole end 1000*b*, and a cutting direction or rotation 1006 about axis 1005. In addition, bit 1000 includes a bit body 110 extending axially from downhole end 1000*b*, a threaded connection or pin 120 extending axially from uphole end 1000*a*, and a shank 130 extending axially between pin 120 and body 110. Bit body 110, pin 120, and shank 130 are each as previously described. Each blade 141, 142 includes cutter-supporting surface 144 for mounting a plurality of cutter elements. However, in this embodiment, cutter elements 145 are replaced with cutter elements 1045. Unlike cutter elements 145 that include round cutting faces 146, cutter elements 1045 include forward facing cutting faces 1046 that are not completely circular. More specifically, each cutting face 1046 is a circle with two circumferentially-spaced circular segments removed, resulting in two circumferentially-spaced straight or linear sections along the profile of each cutting face 1046. Examples of cutter elements that can be used as cutter elements 1045 are disclosed in PCT Patent Application No. PCT/US2016/52951 filed Sep. 21, 2016 which is hereby incorporated herein by reference in its entirety. Cutter elements 1045 are arranged adjacent one another in a radially extending row proximal the leading edge of each primary blade 141 and each secondary blade 142. In addition, a plurality of DOC limiting inserts 1100 are arranged adjacent one another in a radially extending row on each primary blade 141 and each secondary blade 142. The row of DOC limiting inserts 1100 on each blade 141, 142 trails the row of cutter elements 1045 on the same blade 141, 142 relative to the direction of rotation 1006 of bit 1000. Similar to depth-of-cut limiting inserts 200 previously described, depth-of-cut limiting inserts 1100 are intended to limit the maximum depth-of-cut of cutting faces 1046 as they engage the formation. As will be described in more detail below and similar to inserts 200, each depth-of-cut limiting insert 1100 includes an outer formation engaging surface 1110 extending from cutter-supporting surface 144 of the corresponding blade 141, 142. Surfaces 1110 of inserts 1100 are intended to slide across the formation and limit the depth to which cutting faces 1046 bite or penetrate into the formation. Thus, depth-of-cut limiting inserts 1100 are not intended to penetrate and shear the formation.

Figure 24:
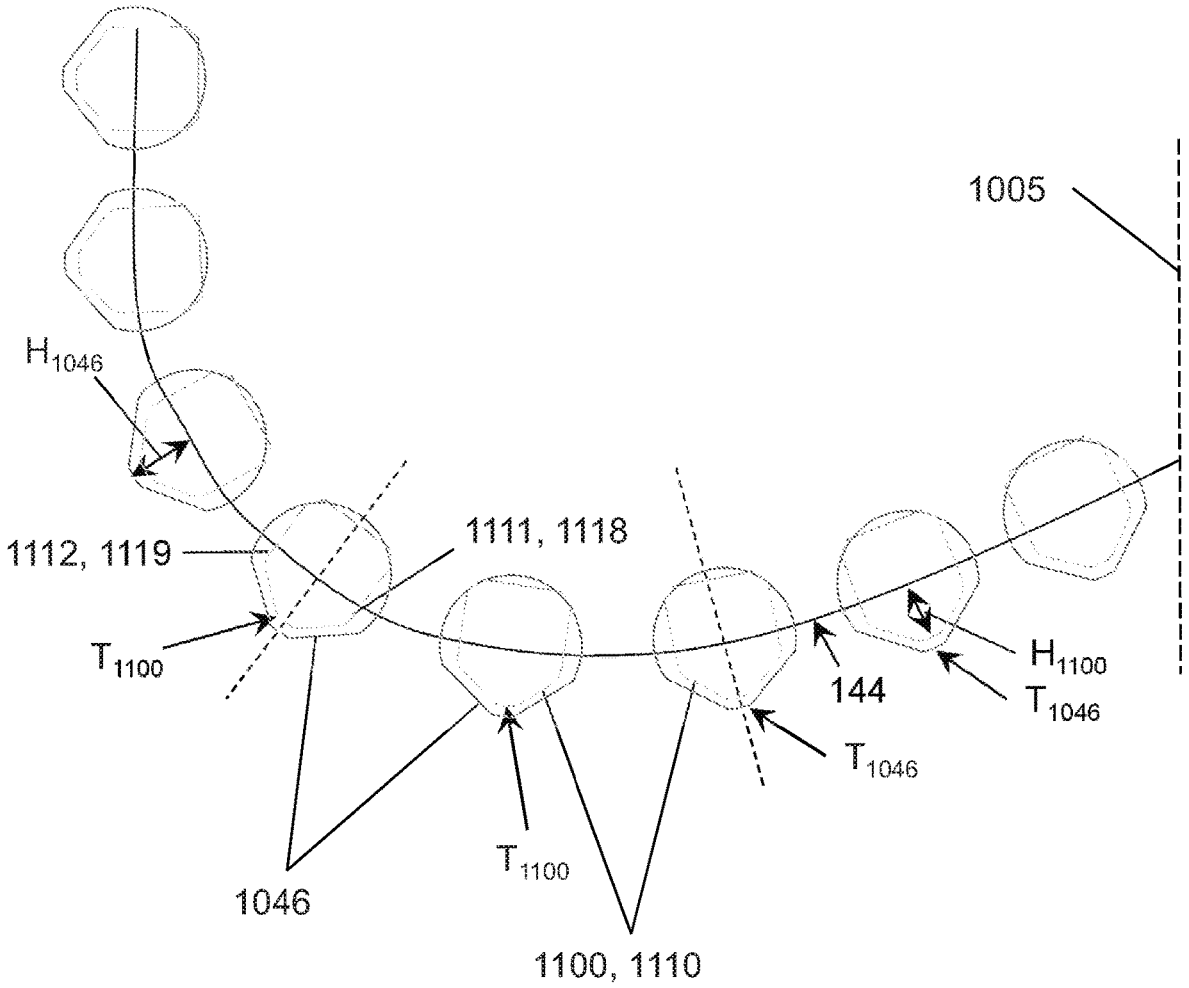
FIG. 24 is an enlarged rotated profile view of one of the primary blades and associated cutting faces and depth-of-cut limiting inserts of the drill bit of FIG. 22.

Referring now to FIG. 24, the profile of one exemplary blade 141, cutting faces 1046 mounted thereto, and inserts 1100 mounted thereto are shown rotated into a single rotated profile. Although only one blade 141 and associated cutting faces 1046 and inserts 1100 is shown in FIG. 24, it is to be understood that the other blades 141, 142 and associated cutting faces 1046 and inserts 1100 of bit 1000 are arranged similarly. One or more cutter elements 1045 and one or more depth-of-cut limiting inserts 1100 are disposed in the cone region 149*a*, the shoulder region 149*b*, and the gage region 149*c*. Although depth-of-cut limiting inserts 1100 are disposed in each region 149*a*, 149*b*, 149*c* in this embodiment, in general, one or more of the depth-of-cut limiting inserts 1100 are preferably mounted to each blade 141, 142 in at least the cone region 149*a* and at or proximal the nose 149*d*.

Each depth-of-cut limiting insert 1100 has an outermost bearing surface 1110 defined by a tip $T_{1100}$ positioned furthest from cutter-supporting surface 144 to which it is mounted (as measured perpendicularly from its respective cutter-supporting surface 144). In this embodiment, bearing tip $T_{1100}$ is a contact line (as opposed to a contact point or surface), however, in other embodiments, the bearing tip positioned furthest from cutter-supporting surface to which it is mounted may be a contact point or surface. In addition, each depth-of-cut limiting insert 1100 has a radial position defined by the radial distance measured perpendicularly from bit axis 1005 to its bearing tip $T_{1100}$. Still further, each depth-of-cut limiting insert 1100 has an extension height $H_{1100}$ measured perpendicularly from cutter-supporting surface 144 (or blade profile 148) to its bearing tip $T_{1100}$. In this embodiment, each cutting face 1046 extends to substantially the same extension height $H_{1046}$, and each depth-of-cut limiting insert 1100 extends to substantially the same extension height $H_{1100}$ that is less than or equal to extension height $H_{1046}$. As previously described and shown in FIG. 23, depth-of-cut limiting inserts 1100 on each blade 141, 142 trail the cutter elements 1045 on the same blade 141, 142 relative to the direction of rotation 1006 of bit 1000. More specifically, in this embodiment, each depth-of-cut limiting insert 1100 on each blade 141, 142 is positioned immediately behind and trails a corresponding cutter element 1045 on the same blade 141, 142. Thus, as best shown in FIG. 24, each depth-of-cut limiting insert 1100 is disposed at substantially the same radial position as the cutting face 1046 of the corresponding cutter element 1045. As a result of the relative sizes, radial positions, and extension heights of cutting faces 1046 and depth-of-cut limiting insert 1100, the profile or path of each depth-of-cut limiting insert 1100 is completely eclipsed and overlapped by the cutting profile or path of its associated primary cutting face 1046 in rotated profile view.

Figure 25A:
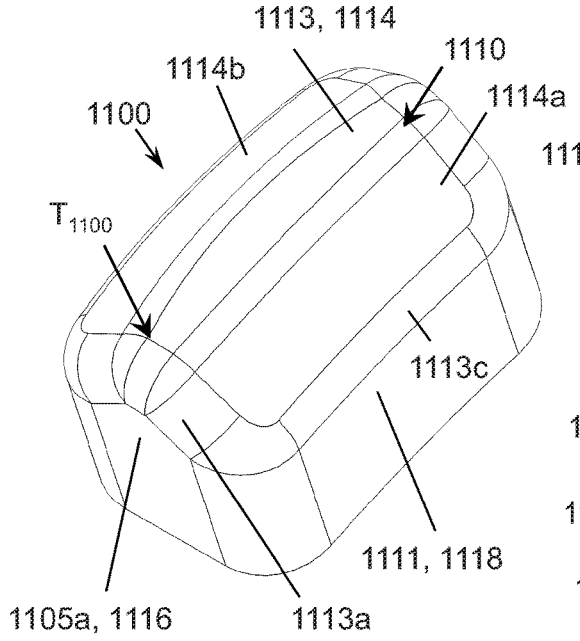
FIGS. 25A-25D are perspective, top, end, and side views, respectively, of one of the depth-of-cut limiting inserts of the drill bit of FIG. 22.
Figure 25B:
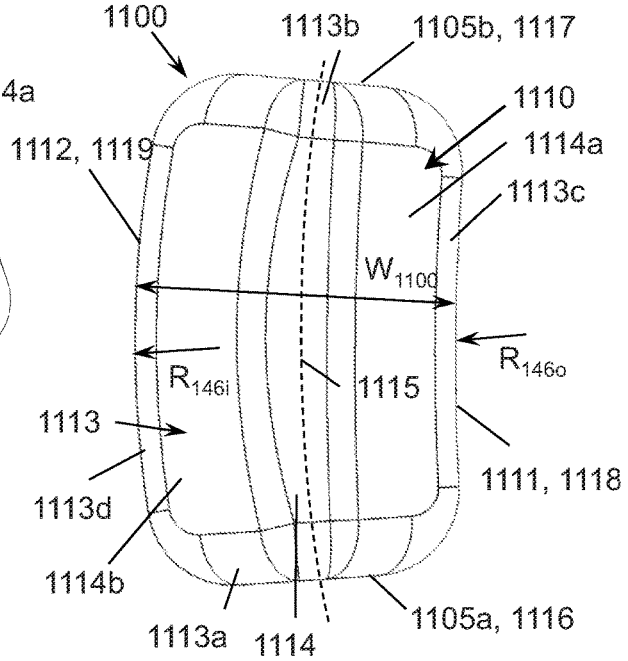
Figure 25C:
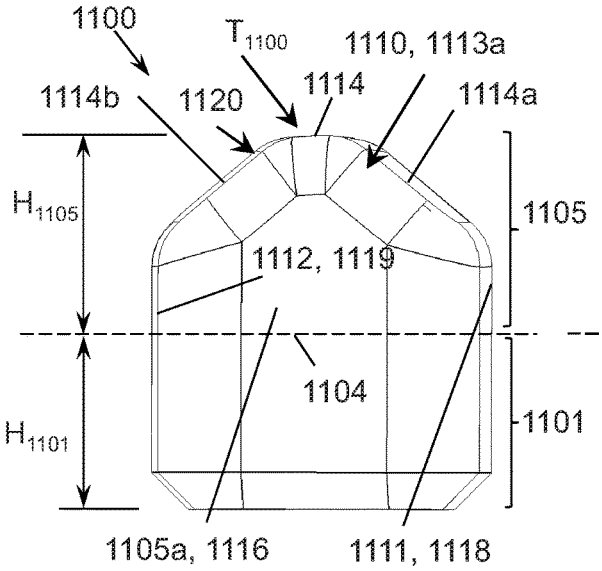
Figure 25D:
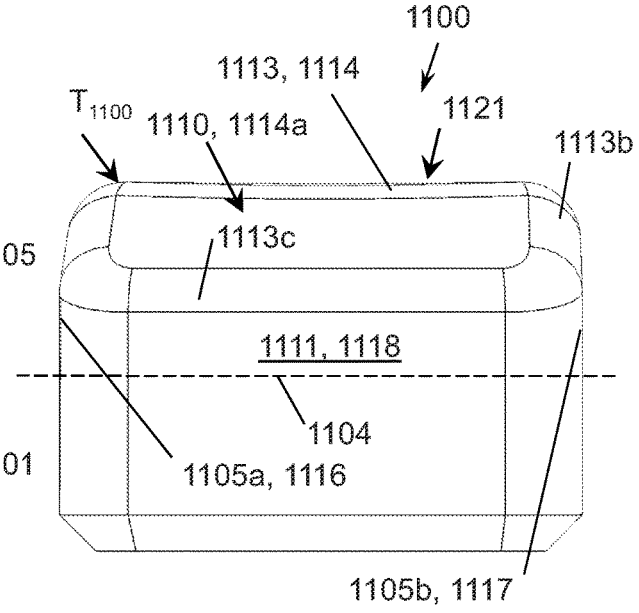

Referring now to FIGS. 25A-25D, one depth-of-cut limiting insert 1100 is shown, it is to be understood that all inserts 1100 are the same. Insert 1100 is substantially the same as insert 200 previously described with the exception that the crown is not continuously curved and convex with two intersecting radii of curvature in front end view. More specifically, in this embodiment, insert 1100 includes a base portion 1101 and a formation engaging portion 1105 extending therefrom. As shown in FIGS. 25C and 25D, reference plane of intersection 1104 divides insert 1100 into base portion 1101 and formation engaging portion 1105. In this embodiment, base portion 1101 is generally rectangular in end and side view (FIGS. 25C and 25D, respectively) and slightly arcuate and C-shaped in top view (FIG. 25B). As best shown in FIG. 25C, base portion 1101 has a height $H_{1101}$, and formation engaging portion 1105 extends from base portion 1101 to a height $H_{1105}$. Base portion 1101 is retained within a mating socket in cutter-supporting surface 144 of a blade 141, 142 by interference fit, or by other means, such as brazing or welding, such that formation engaging portion 1105 extends from cutter supporting surface 144. In other words, when insert 1100 is mounted to a blade 141, 142, base portion 1101 is the part of insert 1100 seated in the mating socket such that a projection of the plane of intersection 1104 is generally aligned with cutter-supporting surface 144 of that blade 141, 142. Thus, once mounted to a blade 141, 142, the height $H_{1105}$ of portion 1105 is generally the distance from the cutter-supporting surface 144 to the outermost point, line, or surface of formation engaging portion 1105 as measured perpendicular to cutter-supporting surface 144, and thus, defines the extension height of insert 1100.

Referring still to FIGS. 25A-25D, formation engaging portion 1105 has an outer or formation engaging surface 1110 extending from plane of intersection 1104 and an elongate, arcuate central or longitudinal axis 1115. In addition, formation engaging portion 1105 includes a first end 1105*a*, a second end 1105*b* longitudinally opposite end 1105*a*, a pair of lateral sides 1111, 1112, and an elongate crown 1113. Lateral sides 1111, 1112 extend longitudinally between ends 1105*a*, 1105*b*, and thus, sides 1111, 1112 are disposed on opposite sides of axis 1115 and extend generally parallel to axis 1115. Axis 1115 intersects each end 1105*a*, 1105*b* perpendicularly thereto and is equidistant from sides 1111, 1112. Elongate crown 1113 extends longitudinally between ends 1105*a*, 1105*b* generally parallel to axis 1115 and laterally between sides 1111, 1112. Crown 1113 intersects ends 1105*a*, 1105*b* at end corners 1113*a*, 1113*b*, respectively, and intersects sides 1111, 1112 at side corners 1113*c*, 1113*d*, respectively. In this embodiment, corners 1113*a*, 1113*b*, 1113*c*, 1113*d* are radiused such that there is a smooth, continuously contoured transition between crown 1113 and ends 1105*a*, 1105*b* and between crown 1113 and sides 1111, 1112. Although crown 1113 smoothly transitions into side corners 1113*c*, 1113*d*, in this embodiment, crown 1113 is not continuously curved and convex as it extends laterally between sides 1111, 1112 in front end view (FIG. 25C). Rather, in this embodiment, crown 1113 is generally an arcuate triangular prism with a front profile that corresponds to the profile of cutting face 1046. In particular, crown 1113 includes a generally planar elongate top surface 1114 disposed at and defining the extension height of insert 1100 and a pair of generally elongate flank surfaces 1114*a*, 1114*b* extending laterally from surface 1114 to corners 1113*c*, 1113*d*. Insert 1100 has a width $W_{1100}$ measured perpendicular to axis 1115 between lateral sides 1111, 1112 in top view (FIG. 25B).

In this embodiment, ends 1105*a*, 1105*b* comprise planar surfaces 1116, 1117, respectively, and lateral sides 1111, 1112 comprise arcuate or curved surfaces 1118, 1119, respectively. In particular, surface 1118 is concave or bowed inwardly, and surface 1119 is convex or bowed outwardly. The curvature of sides 1111, 1112 and associated surfaces 1118, 1119, respectively, results in the general C-shaped arcuate geometry of insert 1100 in top view (FIG. 25B). As best shown in FIG. 23, in this embodiment, inserts 1100 are mounted to blades 141, 142 such that (a) ends 1105*a*, 1105*b* are generally oriented perpendicular to the direction of rotation 1006 of bit 1000 with each end 1105*a* leading the corresponding end 1105*b* of the same insert 1100 relative to the direction of rotation 1006 of bit 1000 (i.e., axis 1115 is generally aligned with direction of rotation 1006); and (b) each lateral side 1111 positioned radially inwardly of the corresponding lateral side 1112 of the same insert 1100. Accordingly, ends 1105*a*, 1105*b* may also be referred to as leading and trailing ends, respectively, and sides 1111, 1112 may also be referred to as radially inner and radially outer sides, respectively. Thus, insert 1100 is generally shaped and oriented similarly to insert 200 previously described. Similar to insert 200 previously described, concave surface 1118 of radially inner side 1111 of insert 1100 has a radius of curvature equal to radius $R_{146o}$ and convex surface 1119 of radially outer side 1112 of insert 1100 has a radius of curvature equal to radius $R_{146i}$. As previously described, radius $R_{146i}$ is less than radius $R_{146o}$, and thus, the width $W_{1100}$ of insert 1100 changes moving along longitudinal axis 1115. More specifically, width $W_{1100}$ is smallest at ends 1105*a*, 1105*b*, largest in the middle of insert 1100 (equidistant from ends 1105*a*, 1105*b*), and continuously and gradually increases moving along axis 1115 from each end 1105*a*, 1105*b* to the middle of insert 1100.

Referring to the end and side views of FIGS. 25C and 25D, respectively, lateral side surfaces 1118, 1119 and crown 1113 define a front periphery or profile 1120 of insert 1100 generally viewed along axis 1115 (FIG. 25C), while end surfaces 1116, 1117 and top surface 1114 define a side periphery or profile 1121 of insert 1100 generally viewed perpendicular to axis 1115 (FIG. 25D). As seen in front profile 1120 (FIG. 25C), lateral side surfaces 1118, 1119 are generally straight in the region between base portion 1101 and crown 1113. Likewise, as seen in side profile 1121 (FIG. 25D), end surfaces 1116, 1117 are generally straight in the region between base portion 1101 and crown 1113.

As best shown in the front profile 1120 of FIG. 25C, top surface 1114 and flanking surfaces 1114*a*, 1114*b* are straight. The transitions between top surface 1114 and each flanking surface 1114*a*, 1114*b*, as well as the transitions between flanking surfaces 1114*a*, 1114*b* and corners 1113*c*, 1113*d* are smoothly curved and convex. The intersection of top surface 1114 and leading end corner 1113*a* defines the bearing tip $T_{1100}$. Flanking surfaces 1114*a*, 1114*b* are oriented at an acute angle of 45° relative to top surface 1114 in the front profile 1120. In this embodiment, each flanking surface 1114*a*, 1114*b* is oriented at the same acute angle, and in particular, each flanking surface 1114*a*, 1114*b* is oriented at 45° relative to top surface 1114.

As best shown in the side profile 1121 of FIG. 253D, top surface 1114 is slightly concave or bowed inwardly between end corners 1113*a*, 1113*b*. Although top surface 1114 is slightly concave between end corners 1113*a*, 1113*b* in side profile 1121, in other embodiments, the top surface (e.g., top surface 1114) may be convex or bowed outwardly or flat between the end corners (e.g., end corners 1113*a*, 1113*b*) in side profile (e.g., side profile 1121). To enhance the contact surface area between formation engaging surface 1110 and the formation during drilling operations, in embodiments described herein, each insert 1100 positioned radially inside nose 129*d* (i.e., along cone region 149*a*) of bit 1000 preferably has a top surface 1114 that is slightly concave between end corners 1113*a*, 1113*b* in side profile 1121, and each insert 1100 positioned radially outside nose 129*d* (i.e., along shoulder region 129*b* and gage region 149*c*) of bit 1000 preferably has a top surface 1114 that is slightly convex between end corners 1113*a*, 1113*b* in side profile 1121.

During drilling operations, each cutting face 1046 engages, penetrates, and shears the formation as the bit 1000 is rotated in the cutting direction 1006 and is advanced through the formation. As each cutting face 1046 advances through the formation, it cuts a kerf in the formation generally defined by the cutting profile of the cutting face 1046. In embodiments described herein, when the depth-of-cut of a cutting face 1046 is sufficiently large, the formation bearing surface 1110 of the depth-of-cut limiting insert 1100 associated with and trailing the cutting face 1046 will engage the formation, and more specifically, engage the kerf cut in the formation by the cutting face 1046. The depth-of-cut limiting inserts 1100 are not intended to penetrate and shear the formation, but rather, contact and slide across the formation, thereby limiting a further increase in the depth-of-cut of the corresponding cutting faces 1046. As the depth-of-cut limiting insert 1100 is non-aggressive and not intended to penetrate or shear the formation, the formation bearing surface 1110 slides across the formation, thereby limiting the penetration of corresponding cutting face 1046. In addition, due to the elongate geometry of the depth-of-cut limiting inserts 1100, the geometry of the crown 1113 in front profile 1120 (matching the profile of the corresponding cutting face 1046), and the concavity or convexity of top surface 1114 in side profile 1121 depending on the radial position of the insert 1100 (concave top surface 1114 for inserts 1100 positioned radially inside nose 129*d* and convex top surface 1114 for inserts 1100 positioned radially outside nose 129*d*), the depth-of-cut limiting inserts 1100 provide increased bearing surface area for engaging and sliding across the formation as compared to similarly sized dome-shaped depth-of-cut limiters, and thus, may be particularly beneficial for limiting the depth-of-cut in relatively soft formations.

Figure 26:
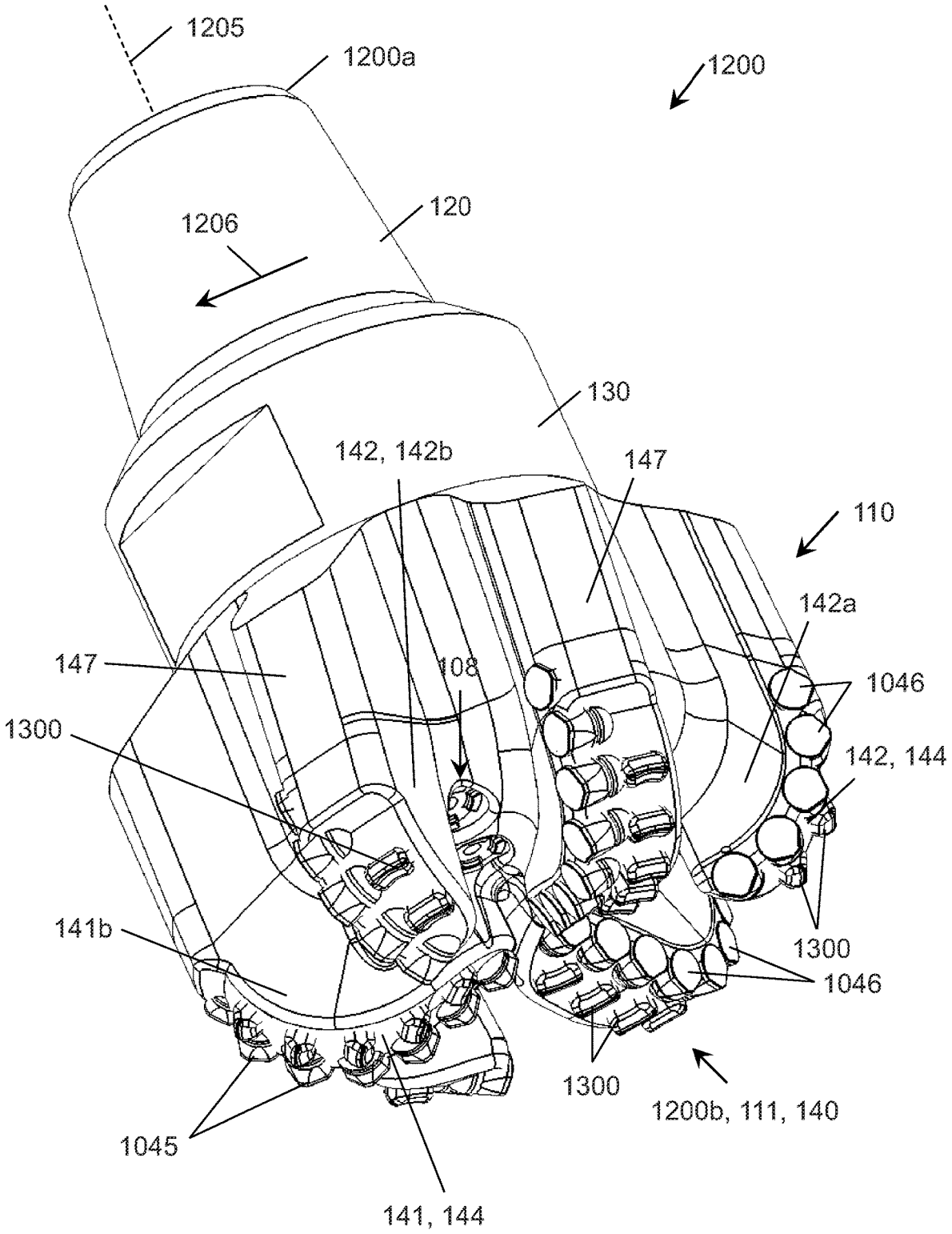
FIG. 26 is a perspective view of an embodiment of a drill bit with a plurality of depth-of-cut limiting inserts in accordance with the principles described herein.
Figure 27:
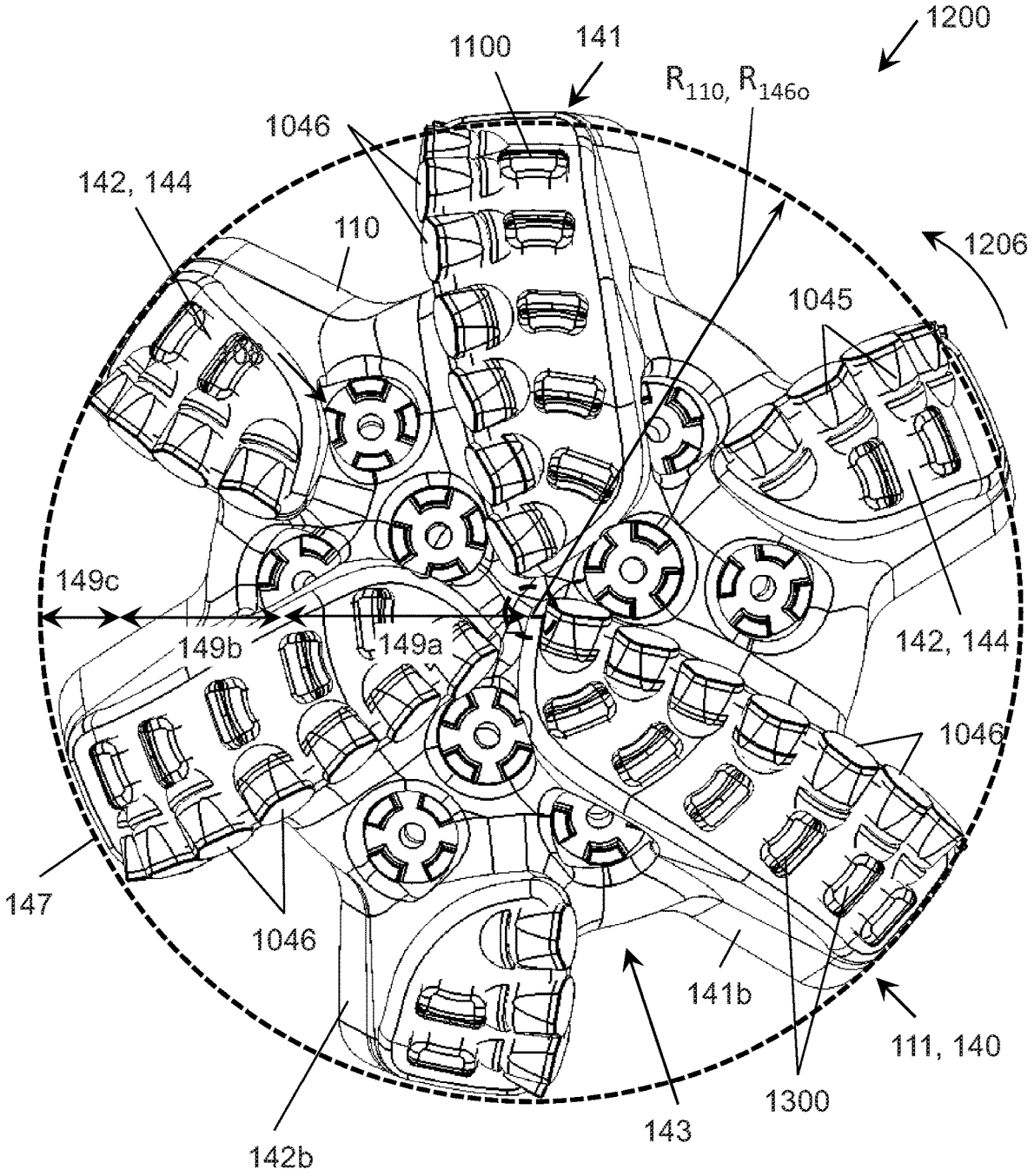
FIG. 27 is an end view of the drill bit of FIG. 26.

Referring now to FIGS. 26 and 27, another embodiment of a fixed cutter drill bit 1200 is shown. Bit 1200 can be used in place of bit 100 in drilling system 10 previously described. Bit 1200 is substantially the same as bit 1000 previously described. Namely, bit 1200 has a central or longitudinal axis 1205, a first or uphole end 1200*a*, a second or downhole end 1200*b*, and a cutting direction or rotation 1206 about axis 1205. In addition, bit 1200 includes a bit body 110 extending axially from downhole end 1200*b*, a threaded connection or pin 120 extending axially from uphole end 1200*a*, and a shank 130 extending axially between pin 120 and body 110. Bit body 110, pin 120, and shank 130 are each as previously described. Each blade 141, 142 includes cutter-supporting surface 144 for mounting a plurality of cutter elements 1045 as previously described.

Cutter elements 1045 are arranged adjacent one another in a radially extending row proximal the leading edge of each primary blade 141 and each secondary blade 142. In addition, a plurality of DOC limiting inserts 1300 are arranged adjacent one another in a radially extending row on each primary blade 141 and each secondary blade 142. The row of DOC limiting inserts 1300 on each blade 141, 142 trails the row of cutter elements 1045 on the same blade 141, 142 relative to the direction of rotation 1206 of bit 1200. Similar to depth-of-cut limiting inserts 200 previously described, depth-of-cut limiting inserts 1300 are intended to limit the maximum depth-of-cut of cutting faces 1046 as they engage the formation. As will be described in more detail below and similar to inserts 200, each depth-of-cut limiting insert 1300 includes an outer formation engaging surface 1310 extending from cutter-supporting surface 144 of the corresponding blade 141, 142. Surfaces 1310 of inserts 1300 are intended to slide across the formation and limit the depth to which cutting faces 1046 bite or penetrate into the formation. Thus, depth-of-cut limiting inserts 1300 are not intended to penetrate and shear the formation.

Figure 28:
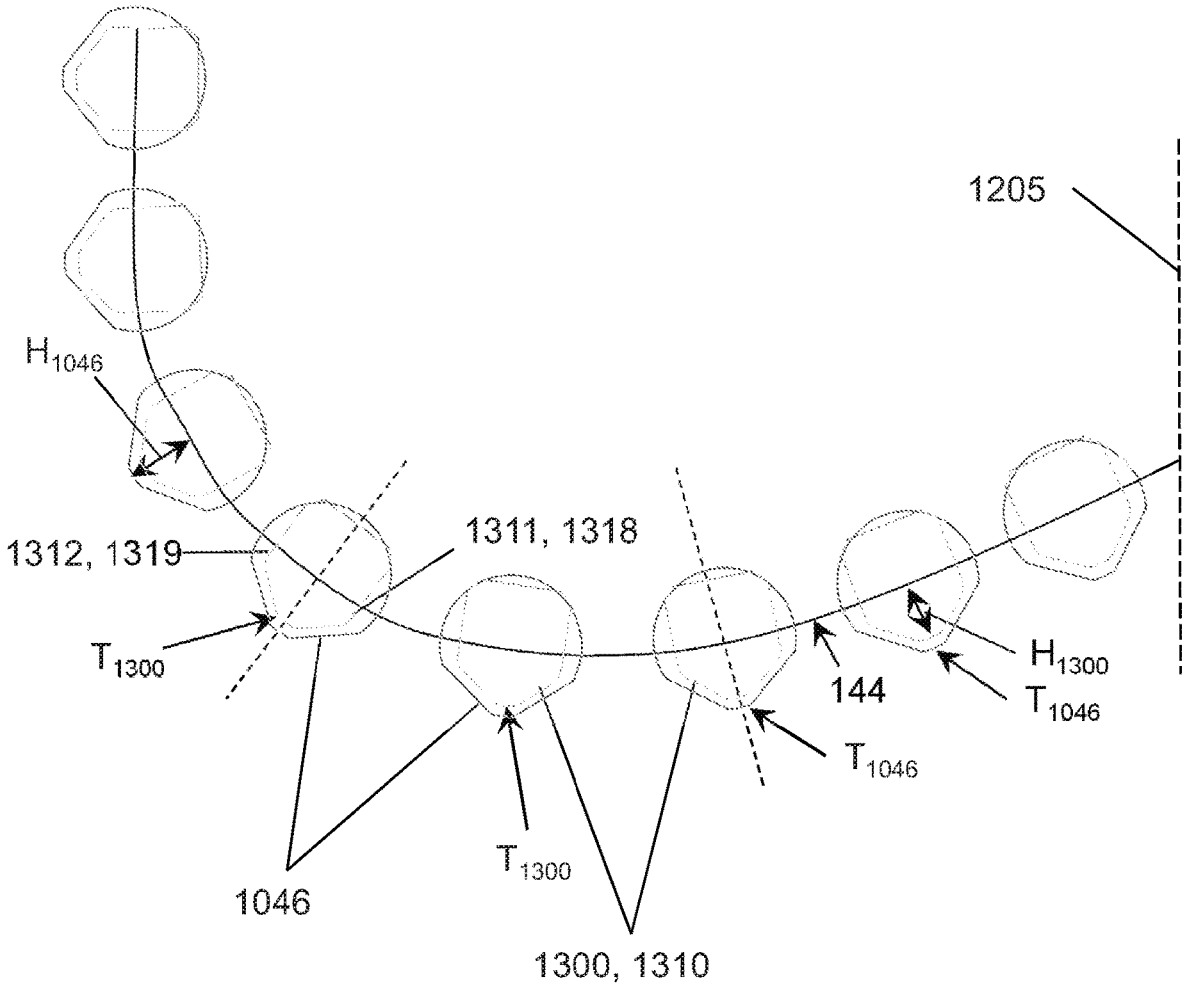
FIG. 28 is an enlarged rotated profile view of one of the primary blades and associated cutting faces and depth-of-cut limiting inserts of the drill bit of FIG. 26.

Referring now to FIG. 28, the profile of one exemplary blade 141, cutting faces 1046 mounted thereto, and inserts 1300 mounted thereto are shown rotated into a single rotated profile. Although only one blade 141 and associated cutting faces 1046 and inserts 1300 is shown in FIG. 28, it is to be understood that the other blades 141, 142 and associated cutting faces 1046 and inserts 1300 of bit 1200 are arranged similarly. One or more cutter elements 1045 and one or more depth-of-cut limiting inserts 1300 are disposed in the cone region 149*a*, the shoulder region 149*b*, and the gage region 149*c*. Although depth-of-cut limiting inserts 1300 are disposed in each region 149*a*, 149*b*, 149*c* in this embodiment, in general, one or more of the depth-of-cut limiting inserts 1300 are preferably mounted to each blade 141, 142 in at least the cone region 149*a* and at or proximal the nose 149*d*.

Each depth-of-cut limiting insert 1300 has an outermost bearing surface 1310 defined by a tip $T_{1300}$ positioned furthest from cutter-supporting surface 144 to which it is mounted (as measured perpendicularly from its respective cutter-supporting surface 144). In this embodiment, bearing tip $T_{1300}$ is a contact line (as opposed to a contact point or surface), however, in other embodiments, the bearing tip positioned furthest from cutter-supporting surface to which it is mounted may be a contact point or surface. In addition, each depth-of-cut limiting insert 1300 has a radial position defined by the radial distance measured perpendicularly from bit axis 1005 to its bearing tip $T_{1300}$ in rotated profile view. Still further, each depth-of-cut limiting insert 1300 has an extension height $H_{1300}$ measured perpendicularly from cutter-supporting surface 144 (or blade profile 148) to its bearing tip $T_{1300}$ in rotated profile view. In this embodiment, each cutting face 1046 extends to substantially the same extension height $H_{1046}$, and each depth-of-cut limiting insert 1300 extends to substantially the same extension height $H_{1300}$ that is less than or equal to extension height $H_{1046}$.

As previously described and shown in FIG. 27, depth-of-cut limiting inserts 1300 on each blade 141, 142 trail the cutter elements 1045 on the same blade 141, 142 relative to the direction of rotation 1206 of bit 1200. More specifically, in this embodiment, each depth-of-cut limiting insert 1300 on each blade 141, 142 is positioned immediately behind and trails a corresponding cutter element 1045 on the same blade 141, 142. Thus, as best shown in FIG. 28, each depth-of-cut limiting insert 1300 is disposed at substantially the same radial position as the cutting face 1046 of the corresponding cutter element 1045. As a result of the relative sizes, radial positions, and extension heights of cutting faces 1046 and depth-of-cut limiting insert 1300, the profile or path of each depth-of-cut limiting insert 1300 is completely eclipsed and overlapped by the cutting profile or path of its associated primary cutting face 1046 in rotated profile view.

Figure 29A:
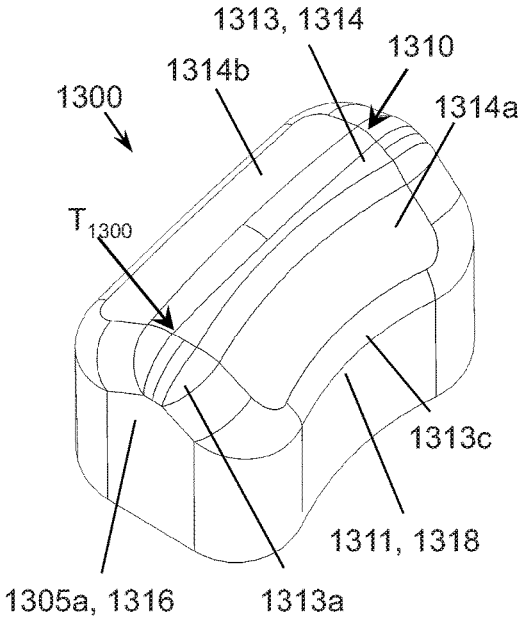
FIGS. 29A-29D are perspective, top, end, and side views, respectively, of one of the depth-of-cut limiting inserts of the drill bit of FIG. 26.
Figure 29B:
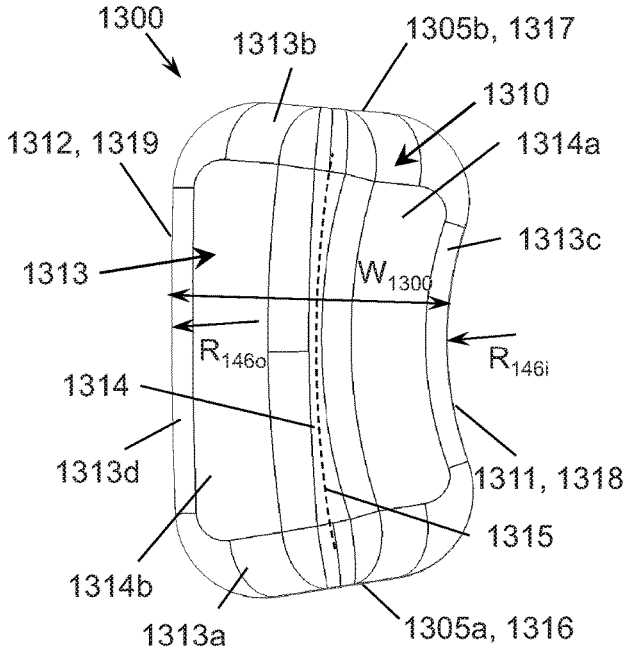
Figure 29C:
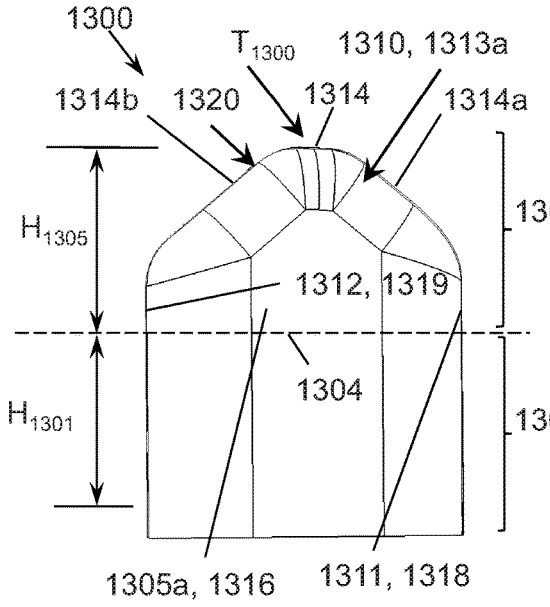
Figure 29D:
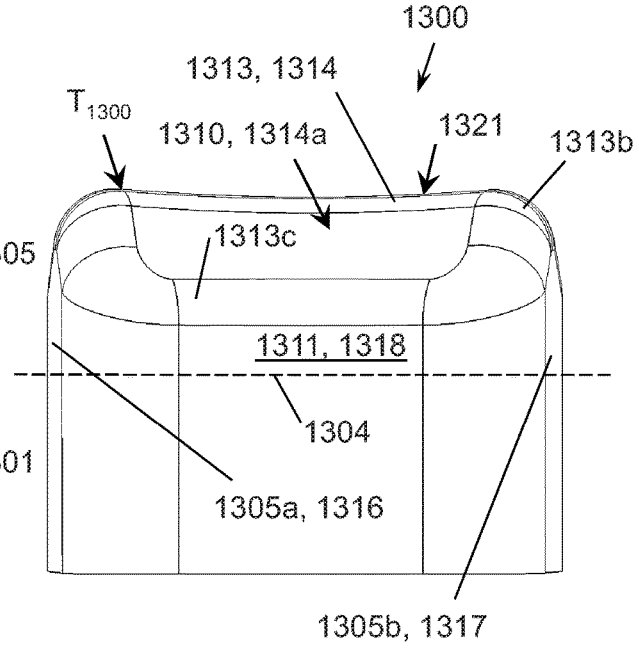

Referring now to FIGS. 29A-29D, one depth-of-cut limiting insert 1300 is shown, it is to be understood that all inserts 1300 are the same. Insert 1300 is substantially the same as insert 1100 previously described with the exception of the geometry of the lateral sides and corresponding side surfaces. More specifically, in this embodiment, insert 1300 includes a base portion 1301 and a formation engaging portion 1305 extending therefrom. As shown in FIGS. 29C and 29D, reference plane of intersection 1304 divides insert 1300 into base portion 1301 and formation engaging portion 1305. In this embodiment, base portion 1301 is generally rectangular in end and side view (FIGS. 29C and 29D, respectively) and slightly arcuate and C-shaped in top view (FIG. 29B). As best shown in FIG. 29C, base portion 1301 has a height $H_{1301}$, and formation engaging portion 1305 extends from base portion 1301 to a height $H_{1305}$. Base portion 1301 is retained within a mating socket in cutter-supporting surface 144 of a blade 141, 142 by interference fit, or by other means, such as brazing or welding, such that formation engaging portion 1305 extends from cutter supporting surface 144. In other words, when insert 1300 is mounted to a blade 141, 142, base portion 1301 is the part of insert 1300 seated in the mating socket such that a projection of the plane of intersection 1304 is generally aligned with cutter-supporting surface 144 of that blade 141, 142. Thus, once mounted to a blade 141, 142, the height $H_{1305}$ of portion 1305 is generally the distance from the cutter-supporting surface 144 to the outermost point, line, or surface of formation engaging portion 1305 as measured perpendicular to cutter-supporting surface 144, and thus, defines the extension height of insert 1300.

Referring still to FIGS. 29A-29D, formation engaging portion 1305 has an outer or formation engaging surface 1310 extending from plane of intersection 1304 and an elongate, arcuate central or longitudinal axis 1315. In addition, formation engaging portion 1305 includes a first end 1305*a*, a second end 1305*b* longitudinally opposite end 1305*a*, a pair of lateral sides 1311, 1312, and an elongate crown 1313. Lateral sides 1311, 1312 extend longitudinally between ends 1305*a*, 1305*b*, and thus, sides 1311, 1312 are disposed on opposite sides of axis 1315 and extend generally parallel to axis 1315. Axis 1315 intersects each end 1305*a*, 1305*b* perpendicularly thereto and is equidistant from sides 1311, 1312. Elongate crown 1313 extends longitudinally between ends 1305*a*, 1305*b* generally parallel to axis 1315 and laterally between sides 1311, 1312. Crown 1313 intersects ends 1305*a*, 1305*b* at end corners 1313*a*, 1313*b*, respectively, and intersects sides 1311, 1312 at side corners 1313*c*, 1313*d*, respectively. In this embodiment, corners 1313*a*, 1313*b*, 1313*c*, 1313*d* are radiused such that there is a smooth, continuously contoured transition between crown 1313 and ends 1305*a*, 1305*b* and between crown 1313 and sides 1311, 1312. Although crown 1313 smoothly transitions into side corners 1313*c*, 1313*d*, crown 1313 is not continuously curved and convex as it extends laterally between sides 1311, 1312 in front end view (FIG. 29C). Rather, in this embodiment, crown 1313 is generally an arcuate triangular prism with a front profile that corresponds to the profile of cutting face 1046. In particular, crown 1313 includes a generally planar elongate top surface 1314 disposed at and defining the extension height of insert 1300 and a pair of generally elongate flank surfaces 1314*a*, 1314*b* extending laterally from surface 1314 to corners 1313*c*, 1313*d*. Insert 1300 has a width $W_{1300}$ measured perpendicular to axis 1315 between lateral sides 1311, 1312 in top view (FIG. 29B).

In this embodiment, ends 1305*a*, 1305*b* comprise planar surfaces 1316, 1317, respectively, and lateral sides 1311, 1312 comprise arcuate or curved surfaces 1318, 1319, respectively. In particular, surface 1318 is concave or bowed inwardly, and surface 1319 is convex or bowed outwardly. The curvature of sides 1311, 1312 and associated surfaces 1318, 1319, respectively, results in the general C-shaped arcuate geometry of insert 1300 in top view (FIG. 29B). As best shown in FIG. 27, in this embodiment, inserts 1300 are mounted to blades 141, 142 such that (a) ends 1305*a*, 1305*b* are generally oriented perpendicular to the direction of rotation 1006 of bit 1000 with each end 1305*a* leading the corresponding end 1305*b* of the same insert 1300 relative to the direction of rotation 1006 of bit 1000 (i.e., axis 1315 is generally aligned with direction of rotation 1006); and (b) each lateral side 1311 positioned radially inwardly of the corresponding lateral side 1312 of the same insert 1300. Accordingly, ends 1305*a*, 1305*b* may also be referred to as leading and trailing ends, respectively, and sides 1311, 1312 may also be referred to as radially inner and radially outer sides, respectively. Thus, insert 1300 is generally shaped and oriented similarly to insert 400 previously described. Similar to insert 400 previously described, concave surface 1318 of radially inner side 1311 of insert 1300 has a radius of curvature equal to radius $R_{146i}$ and convex surface 1319 of radially outer side 1312 of insert 1300 has a radius of curvature equal to radius $R_{146o}$. As previously described, radius $R_{146i}$ is less than radius $R_{146o}$, and thus, the width $W_{1300}$ of insert 1300 changes moving along longitudinal axis 1315. More specifically, width $W_{1300}$ is largest at ends 1305*a*, 1305*b*, smallest in the middle of insert 1300 (equidistant from ends 1305*a*, 1305*b*), and continuously and gradually decreases moving along axis 1315 from each end 1305*a*, 1305*b* to the middle of insert 1300.

Referring to the end and side views of FIGS. 29C and 29D, respectively, lateral side surfaces 1318, 1319 and crown 1313 define a front periphery or profile 1320 of insert 1300 generally viewed along axis 1315 (FIG. 29C), while end surfaces 1316, 1317 and top surface 1314 define a side periphery or profile 1321 of insert 1300 generally viewed perpendicular to axis 1315 (FIG. 29D). As seen in front profile 1320 (FIG. 29C), lateral side surfaces 1318, 1319 are generally straight in the region between base portion 1301 and crown 1313. Likewise, as seen in side profile 1321 (FIG. 29D), end surfaces 1316, 1317 are generally straight in the region between base portion 1301 and crown 1313.

As best shown in the front profile 1320 of FIG. 29C, top surface 1314 and flanking surfaces 1314*a*, 1314*b* are straight. The transitions between top surface 1314 and each flanking surface 1314*a*, 1314*b*, as well as the transitions between flanking surfaces 1314*a*, 1314*b* and corners 1313*c*, 1313*d* are smoothly curved and convex. The intersection of top surface 1314 and leading end corner 1313*a* defines the bearing tip $T_{1300}$. Flanking surfaces 1314*a*, 1314*b* are oriented at an acute angle of 45° relative to top surface 1314 in the front profile 1320. In this embodiment, each flanking surface 1314*a*, 1314*b* is oriented at the same acute angle, and in particular, each flanking surface 1314*a*, 1314*b* is oriented at 45° relative to top surface 1314.

As best shown in the side profile 1321 of FIG. 29D, top surface 1314 is slightly concave or bowed inwardly between end corners 1313*a*, 1313*b*. Although top surface 1314 is slightly concave between end corners 1313*a*, 1313*b* in side profile 1321, in other embodiments, the top surface (e.g., top surface 1314) may be convex or bowed outwardly or flat between the end corners (e.g., end corners 1313*a*, 1313*b*) in side profile (e.g., side profile 1321). To enhance the contact surface area between formation engaging surface 1310 and the formation during drilling operations, in embodiments described herein, each insert 1300 positioned radially inside nose 129*d* (i.e., along cone region 149*a*) of bit 1000 preferably has a top surface 1314 that is slightly concave between end corners 1313*a*, 1313*b* in side profile 1321, and each insert 1300 positioned radially outside nose 129*d* (i.e., along shoulder region 129*b* and gage region 149*c*) of bit 1000 preferably has a top surface 1314 that is slightly convex between end corners 1313*a*, 1313*b* in side profile 1321.

During drilling operations, each cutting face 1046 engages, penetrates, and shears the formation as the bit 1000 is rotated in the cutting direction 1006 and is advanced through the formation. As each cutting face 1046 advances through the formation, it cuts a kerf in the formation generally defined by the cutting profile of the cutting face 1046. In embodiments described herein, when the depth-of-cut of a cutting face 1046 is sufficiently large, the formation bearing surface 1310 of the depth-of-cut limiting insert 1300 associated with and trailing the cutting face 1046 will engage the formation, and more specifically, engage the kerf cut in the formation by the cutting face 1046. The depth-of-cut limiting inserts 1300 are not intended to penetrate and shear the formation, but rather, contact and slide across the formation, thereby limiting a further increase in the depth-of-cut of the corresponding cutting faces 1046. As the depth-of-cut limiting insert 1300 is non-aggressive and not intended to penetrate or shear the formation, the formation bearing surface 1310 slides across the formation, thereby limiting the penetration of corresponding cutting face 1046. In addition, due to the elongate geometry of the depth-of-cut limiting inserts 1300, the geometry of the crown 1313 in front profile 1320 (matching the profile of the corresponding cutting face 1046), and the concavity or convexity of top surface 1314 in side profile 1321 depending on the radial position of the insert 1300 (concave top surface 1314 for inserts 1300 positioned radially inside nose 129*d* and convex top surface 1314 for inserts 1300 positioned radially outside nose 129*d*), the depth-of-cut limiting inserts 1300 provide increased bearing surface area for engaging and sliding across the formation as compared to similarly sized dome-shaped depth-of-cut limiters, and thus, may be particularly beneficial for limiting the depth-of-cut in relatively soft formations.

Referring now to FIGS. 30A-30D, an insert 1400 for a fixed cutter drill bit is shown. In general, insert 1400 can be used as a depth-of-cut limiting insert or as a cutter element. For example, insert 1400 can be used in place of any one or more depth-of-cut limiting inserts 200, 400, 600, 900, 1100, 1300 of bits 100, 300, 500, 700, 800, 1000, 1200, respectively, as previously described and/or used in place of any one or more cutter elements 145 of bits 100, 300, 500, 700, 800, 1000, 1200 previously described.

Figure 30A:
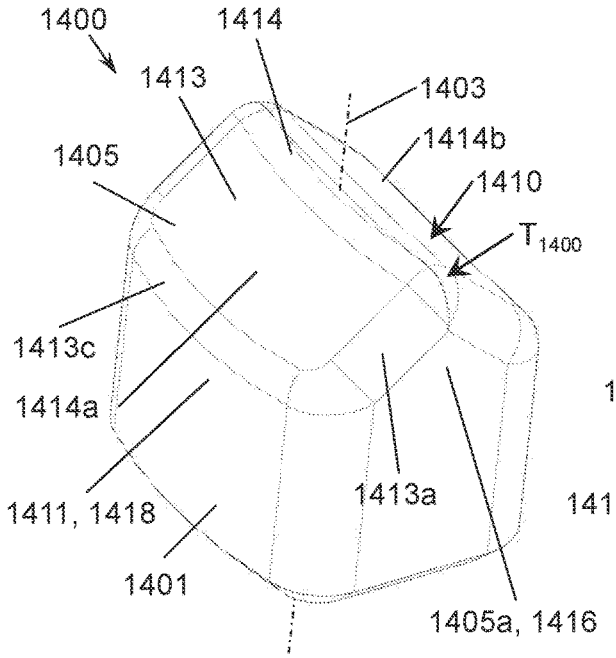
FIGS. 30A-30D are perspective, top, end, and side views, respectively, of an embodiment of an insert for a fixed cutter drill bit.
Figure 30B:
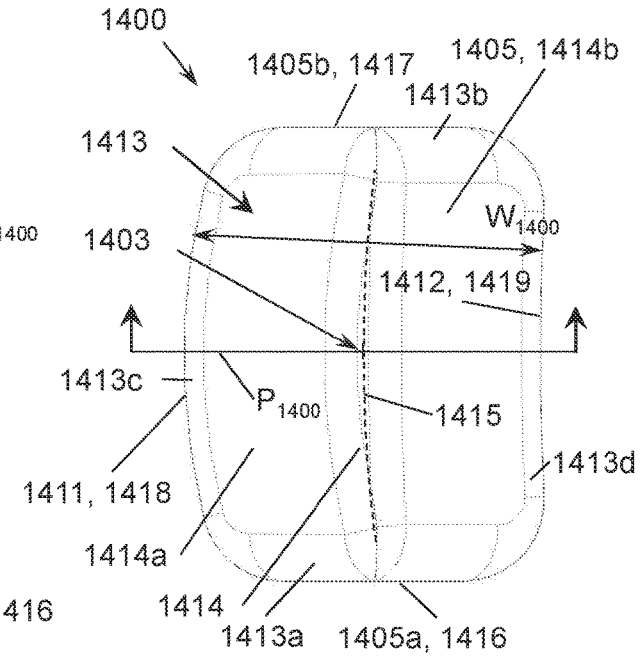
Figure 30C:
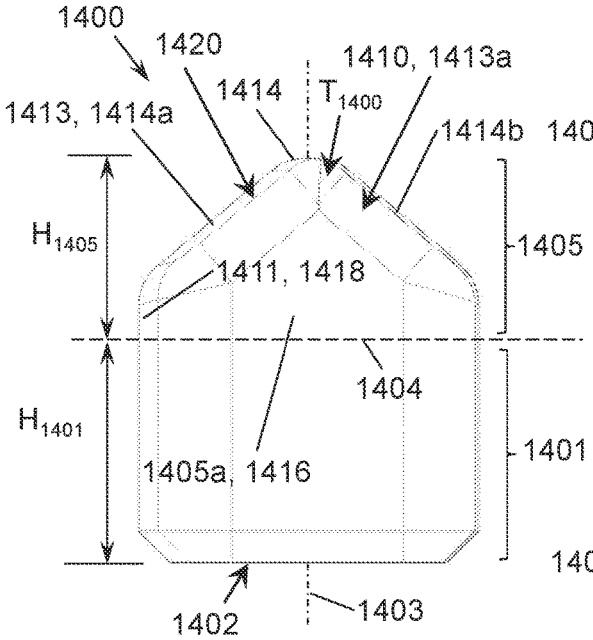
Figure 30D:
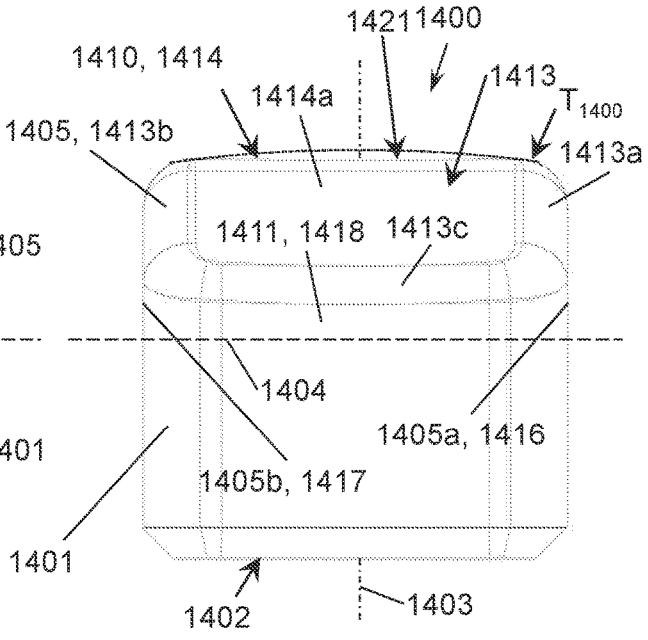

In this embodiment, insert 1400 includes a base portion 1401 and a formation engaging portion 1405 extending therefrom. As shown in FIGS. 30C and 30D, reference plane of intersection 1404 divides insert 1400 into base portion 1401 and formation engaging portion 1405. In this embodiment, base portion 1401 is generally rectangular in end and side view (FIGS. 30C and 30D, respectively) and slightly arcuate and C-shaped in top view (FIG. 30B). As best shown in FIGS. 30C and 30D, base portion 1401 has a planar lower surface 1402, a central axis 1403, and a height $H_{1401}$. Formation engaging portion 1405 extends from base portion 1401 to a height $H_{1405}$. In this embodiment, central axis 1403 of base portion 1401 is oriented perpendicular to lower surface 1402 and disposed at the geometric center of base portion 1401 in top and side view (FIGS. 30B and 30D, respectively). In addition, in this embodiment, height $H_{1401}$ is measured parallel to central axis 1403 from lower surface 1402 to plane of intersection 1404 and formation engaging portion 1405, and height $H_{1405}$ is measured parallel to central axis 1403 from plane of intersection 1404 and formation engaging portion 1405 to the outermost point, line, or surface of formation engaging portion 1405.

Base portion 1401 is retained within a mating socket in cutter-supporting surface of a blade of a fixed cutter bit (e.g., supporting surface 144 of a blade 141, 142) by interference fit, or by other means, such as brazing or welding, such that formation engaging portion 1405 extends from the cutter supporting surface. In other words, when insert 1400 is mounted to a blade of a fixed cutter bit, base portion 1401 is the part of insert 1400 seated in the mating socket such that a projection of the plane of intersection 1404 is generally aligned with cutter-supporting surface of that blade. Thus, once mounted to a blade, the height $H_{1405}$ of portion 1405 is generally the distance from the cutter-supporting surface to the outermost point, line, or surface of formation engaging portion 1405 as measured perpendicular to the cutter-supporting surface, and thus, defines the extension height of insert 1400.

Referring still to FIGS. 30A-30D, formation engaging portion 1405 has an outer or formation engaging surface 1410 extending from plane of intersection 1404 and an elongate, arcuate central axis 1415. In addition, formation engaging portion 1405 includes a first end 1405*a*, a second end 1405*b* longitudinally opposite end 1405*a* (relative to axis 1415), a pair of lateral sides 1411, 1412, and an elongate crown 1413. Lateral sides 1411, 1412 extend longitudinally (relative to axis 1415) between ends 1405*a*, 1405*b*, and thus, sides 1411, 1412 are disposed on opposite sides of axis 1415 and extend generally parallel to axis 1415. Axis 1415 is equidistant from sides 1411, 1412 in top view (FIG. 30B). In this embodiment, central axis 1415 of formation engaging portion 1405 intersects central axis 1403 of base portion 1401 (FIG. 30B). Elongate crown 1413 extends longitudinally between ends 1405*a*, 1405*b* generally parallel to axis 1415 and laterally between sides 1411, 1412. Crown 1413 intersects ends 1405*a*, 1405*b* at end corners 1413*a*, 1413*b*, respectively, and intersects sides 1411, 1412 at side corners 1413*c*, 1413*d*, respectively. In this embodiment, corners 1413*a*, 1413*b*, 1413*c*, 1413*d* are radiused such that there is a smooth, continuously contoured transition between crown 1413 and ends 1405*a*, 1405*b* and between crown 1413 and sides 1411, 1412.

In this embodiment, crown 1413 is generally an arcuate triangular prism. In particular, crown 1413 includes an elongate arcuate peaked ridge 1414 and a pair of generally elongate flank surfaces 1414*a*, 1414*b*. Peaked ridge 1414 extends longitudinally (generally parallel to axis 1415) between ends 1405*a*, 1405*b* and associated corners 1413*a*, 1413*b*, respectively. Flank surfaces 1414*a*, 1414*b* extend laterally from peaked ridge 1414 to sides 1411, 1412 and associated corners 1413*c*, 1413*d*, respectively. Peaked ridge 1414 is disposed at and defines the height $H_{1405}$ of formation engaging portion 1405 and the extension height of insert 1400. Insert 1400 has a width $W_{1400}$ measured perpendicular to axis 1415 between lateral sides 1411, 1412 in top view (FIG. 30B).

In this embodiment, ends 1405*a*, 1405*b* comprise planar surfaces 1416, 1417, respectively, and lateral sides 1411, 1412 comprise arcuate or curved surfaces 1418, 1419, respectively. In particular, surface 1418 is convex or bowed outwardly, and surface 1419 is concave or bowed inwardly. The curvature of sides 1411, 1412 and associated surfaces 1318, 1319, respectively, results in the general C-shaped arcuate geometry of insert 1400 in top view (FIG. 30B). In this embodiment, inserts 1400 are mounted to the blades of a fixed cutter bit (e.g., blades 141, 142) such that (a) ends 1405*a*, 1405*b* are generally oriented perpendicular to the direction of rotation of the fixed cutter bit with each end 1405*a* leading the corresponding end 1405*b* of the same insert 1400 relative to the direction of rotation of the bit (e.g., axis 1415 is generally aligned with direction of rotation); and (b) each lateral side 1412 positioned radially inwardly (relative to the central axis of the bit) of the corresponding lateral side 1411 of the same insert 1400. Accordingly, ends 1405*a*, 1405*b* may also be referred to as leading and trailing ends, respectively, and sides 1411, 1412 may also be referred to as radially outer and radially inner sides, respectively. Thus, insert 1400 is generally shaped and oriented similarly to insert 400 previously described. Similar to insert 1100 previously described, convex surface 1418 of radially outer side 1411 of insert 1400 has a radius of curvature equal to the radius of the outermost cutting edge of the radially outermost cutting face of the bit (e.g., the radially outermost cutting face 146 has a radially outermost cutting edge disposed at radius $R_{146o}$), and concave surface 1419 of radially inner side 1412 of insert 1400 has a radius of curvature equal to the radius of the innermost cutting edge of the radially innermost cutting face of the bit (e.g., the radially innermost cutting face 146 having a radially innermost cutting edge disposed at a radius $R_{146i}$). For the same reasons as previously described, the radius of the outermost cutting edge of the radially outermost cutting face is greater than the radius of the innermost cutting edge of the radially innermost cutting face of the bit, and thus, the width $W_{1400}$ of insert 1400 changes moving along longitudinal axis 1415. More specifically, width $W_{1400}$ is smallest at ends 1405*a*, 1405*b*, greatest in the middle of insert 1400 (equidistant from ends 1405*a*, 1405*b*), and continuously and gradually increases moving along axis 1415 from each end 1405*a*, 1405*b* to the middle of insert 1400.

Referring to the end and side views of FIGS. 30C and 30D, respectively, lateral side surfaces 1418, 1419 and crown 1413 define a front periphery or profile 1420 of insert 1400 generally viewed along axis 1415 and perpendicular to axis 1403 (FIG. 30C), while end surfaces 1416, 1417 and peaked ridge 1414 define a side periphery or profile 1421 of insert 1400 generally viewed perpendicular to axes 1403, 1415 (FIG. 30D). As seen in front profile 1420 (FIG. 30C), lateral side surfaces 1418, 1419 are generally straight in the region between base portion 1401 and crown 1413. Likewise, as seen in side profile 1421 (FIG. 30D), end surfaces 1416, 1417 are generally straight in the region between base portion 1401 and crown 1413.

As best shown in the front profile 1420 of FIG. 30C, flanking surfaces 1414*a*, 1414*b* are straight. Although flanking surfaces 1414*a*, 1414*b* are straight in front profile 1420, in other embodiments, one or both of the flanking surfaces (e.g., flanking surfaces 1414*a*, 1414*b*) may be convex or bowed outwardly, flat, concave or bowed inwardly, or combinations thereof in front profile view (e.g., front profile 1420). The transitions between peaked ridge 1414 and each flanking surface 1414*a*, 1414*b*, as well as the transitions between flanking surfaces 1414*a*, 1414*b* and corners 1413*c*, 1413*d* are smoothly curved and convex. The intersection of peaked ridge 1414 and leading end corner 1413*a* defines the leading tip $T_{1400}$ of insert 1400. As best shown in the side profile 1421 of FIG. 30D, peaked ridge 1414 is slightly concave or bowed inwardly between end corners 1413*a*, 1413*b*. Although peaked ridge 1414 is slightly concave between end corners 1413*a*, 1413*b* in side profile 1421, in other embodiments, the peaked ridge (e.g., peaked ridge 1414) may be convex or bowed outwardly, as schematically illustrated with a dashed line positioned immediately above peaked ridge 1414 in FIG. 30D, or flat between the end corners (e.g., end corners 1413*a*, 1413*b*) in side profile (e.g., side profile 1421).

Figure 31:
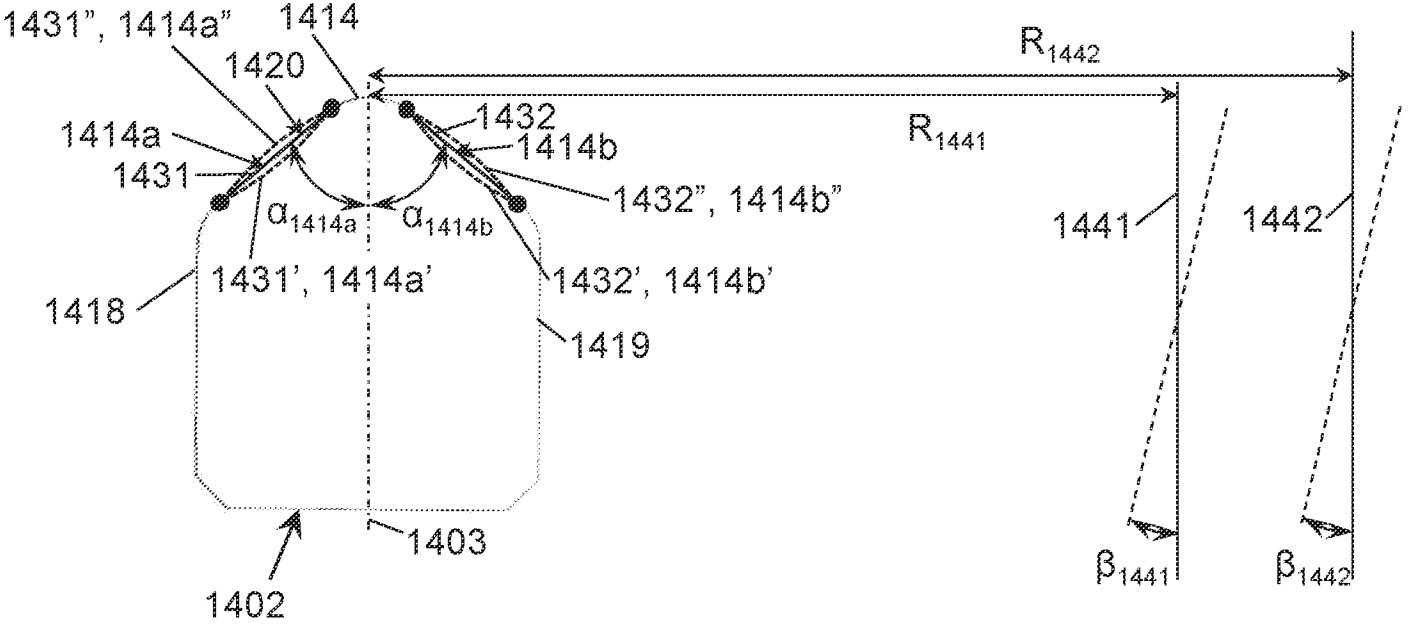
FIG. 31 is a cross-sectional front view of the insert of FIGS. 30A-30D illustrating the front profile of the insert of FIGS. 30A-30D.

Referring now to FIG. 31, a cross-sectional view of insert 1400 taken in reference plane $P_{1400}$ shown in the top view of FIG. 30B. Reference plane $P_{1400}$ contains central axis 1403 of base portion 1401 and bisects insert 1400 (e.g., reference plane $P_{1400}$ is equidistant from each end surface 1416, 1417 along axis 1415). In this embodiment, each flanking surface 1414*a*, 1414*b* is oriented at an acute angle $\alpha_{1414a}$, $\alpha_{1414b}$, respectively, relative to axis 1403 in the cross-sectional view shown in FIG. 31, as well as in the front profile 1420 shown in FIG. 30C. In this embodiment, angle $\alpha_{1414a}$ between axis 1403 and flanking surface 1414*a* is equal to angle $\alpha_{1414b}$ between axis 1403 and flanking surface 1414*b*, and in this embodiment, each angle $\alpha_{1414a}$, $\alpha_{1414b}$ is 45°. However, in general, the acute angle between the central axis of the base portion and each flanking surface (e.g., angles $\alpha_{1414a}$, $\alpha_{1414b}$ between axis 1403 and flanking surfaces 1414*a*, 1414*b*) in the cross-sectional front view can be the same or different, and further, can be greater or less than 45°. In some embodiments, the acute angle between the central axis of the base portion and each flanking surface (e.g., each angle $\alpha_{1414a}$, $\alpha_{1414b}$) in the reference plane containing the central axis of the base portion and bisecting the insert (e.g., reference plane $P_{1400}$) is greater than 0° and less than or equal to 60°.

Referring still to FIG. 31, in this embodiment, each flanking surface 1414*a*, 1414*b* is defined by a corresponding line segment 1431, 1432, respectively, rotated about a corresponding axis 1441, 1442, respectively, between ends 1405*a*, 1405*b* and associated corners 1413*a*, 1413*b*. For purposes of clarity, line segments 1431, 1432 are shown in bold and with dots identifying the ends of each line segment 1431, 1432 in FIG. 31. Each axis 1441, 1442 is disposed within reference plane $P_{1400}$ at a distance or radius $R_{1441}$, $R_{1442}$, respectively, measured perpendicular to central axis 1403 of base portion 1401 from peaked ridge 1414 to axis 1441, 1442, respectively. In embodiments described herein, radii $R_{1441}$, $R_{1442}$ are different. For example, in this embodiment, radius $R_{1441}$ is greater than radius $R_{1442}$. In other embodiments, radius $R_{1441}$ may be less than radius $R_{1442}$. In addition, in this embodiment, each axis 1441, 1442 is oriented parallel to central axis 1403 of base portion 1401. However, in general, axis 1441 may be oriented parallel to central axis 1403 or at an acute angle $\beta_{1441}$ relative to axis 1403 (within reference plane $P_{1400}$) and axis 1442 may be oriented parallel to central axis 1403 or at an acute angle $\beta_{1442}$ relative to axis 1403 (within reference plane $P_{1400}$) as shown with dashed lines in FIG. 31. It should be appreciated that each angle $\beta_{1441}$, $\beta_{1442}$ can be positive or negative depending on whether the corresponding axis 1441, 1442, respectively, is tilted toward or away from axis 1403 moving from base portions 1402 to formation engaging portions 1405 when viewed in reference plane $P_{1400}$. In general, each angle $\beta_{1441}$, $\beta_{1442}$ can be the same or different. In some embodiments, the acute angle between the central axis of the base portion and the axis about which a curve is rotated to define a corresponding flanking surface (e.g., each angle $\beta_{1441}$, $\beta_{1442}$) taken in the reference plane containing the central axis of the base portion and bisecting the insert (e.g., reference plane $P_{1400}$) is between +30° and −30°

As previously described, flanking surfaces 1414*a*, 1414*b* are defined by rotating a corresponding line segment 1431, 1432, respectively, about axis 1441, 1442, respectively. In this embodiment, each line segment 1431, 1432 is a straight or linear line segment. However, in other embodiments, each line segment defining a flanking surface of the crown (e.g., each line segment 1431, 1432) can be linear, curved (e.g., concave or convex), or combinations thereof (e.g., include a linear section and a curved section). For example, as shown schematically with dashed lines in FIG. 31, a concave line segment 1431', 1432'can be rotated about axis 1441, 1442, respectively, to define a concave flanking surface 1414*a*', 1414*b*', respectively; and a convex line segment 1431", 1432"can be rotated about axis 1441, 1442, respectively, to define a convex flanking surface 1414*a*", 1414*b*", respectively.

Referring now to FIGS. 32A-32D, an insert 1500 for a fixed cutter drill bit is shown. In general, insert 1500 can be used as a depth-of-cut limiting insert or as a cutter element. For example, insert 1500 can be used in place of any one or more depth-of-cut limiting inserts 200, 400, 600, 900, 1100, 1300 of bits 100, 300, 500, 700, 800, 1000, 1200, respectively, as previously described and/or used in place of any one or more cutter elements 145 of bits 100, 300, 500, 700, 800, 1000, 1200 previously described.

Insert 1500 is substantially the same as insert 1400 previously described with the exception of the geometry of the base portion of insert 1500. More specifically, in this embodiment, insert 1500 includes a base portion 1501 and a formation engaging portion 1505 extending therefrom. As shown in FIGS. 32C and 32D, reference plane of intersection 1504 divides insert 1500 into base portion 1501 and formation engaging portion 1505. Unlike base portion 1401 of insert 1400 previously described, in this embodiment, base portion 1501 is cylindrical. As best shown in FIGS. 32C and 32D, base portion 1501 has a planar lower surface 1502, a central axis 1503, and a height $H_{1501}$. Formation engaging portion 1505 extends from base portion 1501 to a height $H_{1505}$. In this embodiment, central axis 1503 of base portion 1501 is oriented perpendicular to lower surface 1502 and disposed at the geometric center of cylindrical base portion 1501. In addition, in this embodiment, height $H_{1501}$ is measured parallel to central axis 1503 from lower surface 1502 to plane of intersection 1504 and formation engaging portion 1505, and height $H_{1505}$ is measured parallel to central axis 1503 from plane of intersection 1504 and formation engaging portion 1505 to the outermost point, line, or surface of formation engaging portion 1505.

Base portion 1501 is retained within a mating socket in cutter-supporting surface of a blade of a fixed cutter bit (e.g., supporting surface 144 of a blade 141, 142) by interference fit, or by other means, such as brazing or welding, such that formation engaging portion 1505 extends from the cutter supporting surface. In other words, when insert 1500 is mounted to a blade of a fixed cutter bit, base portion 1501 is the part of insert 1500 seated in the mating socket such that a projection of the plane of intersection 1504 is generally aligned with cutter-supporting surface of that blade. Thus, once mounted to a blade, the height $H_{1505}$ of portion 1505 is generally the distance from the cutter-supporting surface to the outermost point, line, or surface of formation engaging portion 1505 as measured perpendicular to the cutter-supporting surface, and thus, defines the extension height of insert 1500.

Figure 32A:
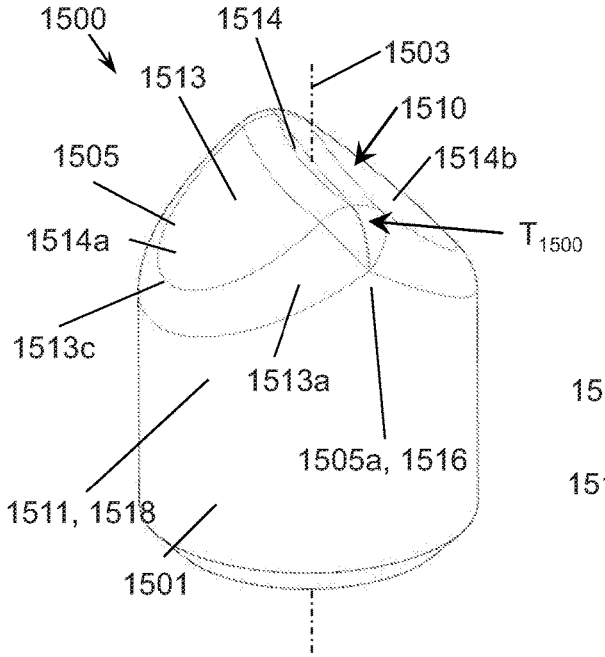
FIGS. 32A-32D are perspective, top, end, and side views, respectively, of an embodiment of an insert for a fixed cutter drill bit.
Figure 32B:
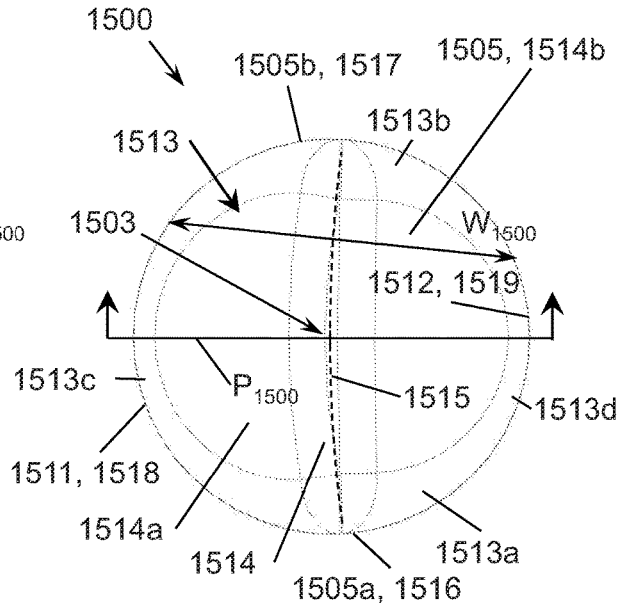
Figure 32C:
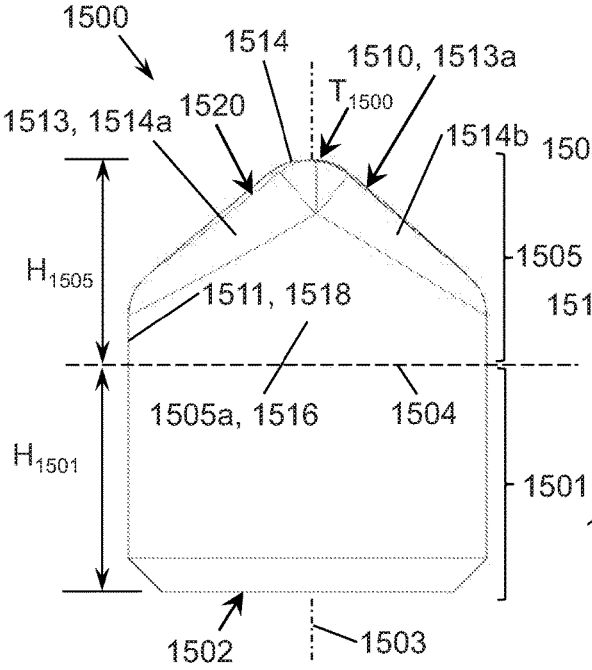
Figure 32D:
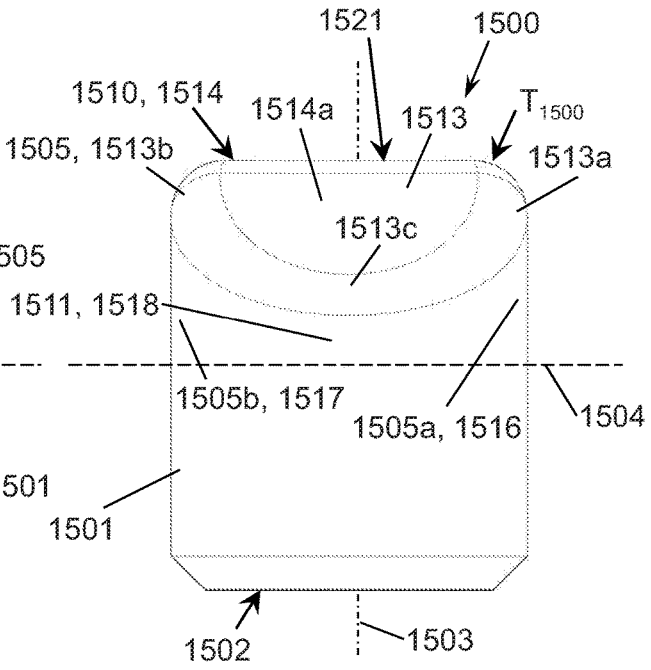

Referring still to FIGS. 32A-32D, formation engaging portion 1505 has an outer or formation engaging surface 1510 extending from plane of intersection 1504 and an elongate, arcuate central axis 1515. In addition, formation engaging portion 1505 includes a first end 1505*a*, a second end 1505*b* longitudinally opposite end 1505*a* (relative to axis 1515), a pair of lateral sides 1511, 1512, and an elongate crown 1513. In this embodiment, lateral sides 1511, 1512 extend longitudinally (relative to axis 1515) between ends 1505*a*, 1505*b*, and thus, sides 1511, 1512 are disposed on opposite sides of axis 1515 and extend generally parallel to axis 1515. Axis 1515 is equidistant from sides 1511, 1512 in top view (FIG. 32B). In this embodiment, central axis 1515 of formation engaging portion 1505 intersects central axis 1503 of base portion 1501 (FIG. 32B). Elongate crown 1513 extends longitudinally between ends 1505*a*, 1505*b* generally parallel to axis 1515 and laterally between sides 1511, 1512. Crown 1513 intersects ends 1505*a*, 1505*b* at end corners 1513*a*, 1513*b*, respectively, and intersects sides 1511, 1512 at side corners 1513*c*, 1513*d*, respectively. In this embodiment, corners 1513*a*, 1513*b*, 1513*c*, 1513*d* are radiused such that there is a smooth, continuously contoured transition between crown 1513 and ends 1505*a*, 1505*b* and between crown 1513 and sides 1511, 1512.

In this embodiment, crown 1513 is generally an arcuate triangular prism. In particular, crown 1513 includes an elongate arcuate peaked ridge 1514 and a pair of generally elongate flank surfaces 1514*a*, 1514*b*. Peaked ridge 1514 extends longitudinally (generally parallel to axis 1515) between ends 1505*a*, 1505*b* and associated corners 1513*a*, 1513*b*, respectively. Flank surfaces 1514*a*, 1514*b* extend laterally from peaked ridge 1514 to sides 1511, 1512 and associated corners 1513*c*, 1513*d*, respectively. Peaked ridge 1514 is disposed at and defines the height $H_{1505}$ of formation engaging portion 1505 and the extension height of insert 1500. Insert 1500 has a width $W_{1500}$ measured perpendicular to axis 1515 between lateral sides 1511, 1512 in top view (FIG. 32B).

In this embodiment, ends 1505*a*, 1505*b* comprise cylindrical surfaces 1516, 1517, respectively, and lateral sides 1511, 1512 comprise cylindrical surfaces 1518, 1519, respectively. In particular, in this embodiment, surfaces 1516, 1517, 1518, 1519 are disposed at the same radius relative to central axis 1503, oriented parallel to axis 1503, and are contiguous with the cylindrical outer surface of base portion 1501. Thus, unlike inserts 400, 1100 previously described, cylindrical surfaces 1516, 1517, 1518, 1519 have the same radius of curvature equal to the radius of base portion 1501. Due to the cylindrical geometry of surfaces 1516, 1517, 1518, 1519 and base portion 1501, the width $W_{1500}$ of insert 1500 changes moving along longitudinal axis 1515 of formation engaging surface 1510. More specifically, width $W_{1500}$ is smallest at ends 1505*a*, 1505*b*, greatest in the middle of insert 1500 (equidistant from ends 1505*a*, 1505*b*), and continuously and gradually increases moving along axis 1515 from each end 1505*a*, 1505*b* to the middle of insert 1500.

In this embodiment, inserts 1500 are mounted to the blades of a fixed cutter bit (e.g., blades 141, 142) such that (a) ends 1505*a*, 1505*b* are generally oriented perpendicular to the direction of rotation of the fixed cutter bit with each end 1505*a* leading the corresponding end 1505*b* of the same insert 1500 relative to the direction of rotation of the bit (e.g., axis 1515 is generally aligned with direction of rotation); and (b) each lateral side 1512 positioned radially inwardly (relative to the central axis of the bit) of the corresponding lateral side 1511 of the same insert 1500. Accordingly, ends 1505*a*, 1505*b* may also be referred to as leading and trailing ends, respectively, and sides 1511, 1512 may also be referred to as radially outer and radially inner sides, respectively.

Referring to the end and side views of FIGS. 32C and 32D, respectively, lateral side surfaces 1518, 1519 and crown 1513 define a front periphery or profile 1520 of insert 1500 generally viewed along axis 1515 and perpendicular to axis 1503 (FIG. 32C), while end surfaces 1516, 1517 and peaked ridge 1514 define a side periphery or profile 1521 of insert 1500 generally viewed perpendicular to axes 1503, 1515 (FIG. 32D). As seen in front profile 1520 (FIG. 32C), lateral side surfaces 1518, 1519 are generally straight in the region between base portion 1501 and crown 1513. Likewise, as seen in side profile 1521 (FIG. 32D), end surfaces 1516, 1517 are generally straight in the region between base portion 1501 and crown 1513.

As best shown in the front profile 1520 of FIG. 32C, flanking surfaces 1514*a*, 1514*b* are straight. Although flanking surfaces 1514*a*, 1514*b* are straight in front profile 1520, in other embodiments, one or both of the flanking surfaces (e.g., flanking surfaces 1514*a*, 1514*b*) may be convex or bowed outwardly, flat, concave or bowed inwardly, or combinations thereof in front profile view (e.g., front profile 1520). The transitions between peaked ridge 1514 and each flanking surface 1514*a*, 1514*b*, as well as the transitions between flanking surfaces 1514*a*, 1514*b* and corners 1513*c*, 1513*d* are smoothly curved and convex. The intersection of peaked ridge 1514 and leading end corner 1513*a* defines the leading tip $T_{1500}$ of insert 1500. As best shown in the side profile 1521 of FIG. 32D, peaked ridge 1514 is slightly concave or bowed inwardly between end corners 1513*a*, 1513*b*. Although peaked ridge 1514 is slightly concave between end corners 1513*a*, 1513*b* in side profile 1521, in other embodiments, the peaked ridge (e.g., peaked ridge 1514) may be convex or bowed outwardly or flat between the end corners (e.g., end corners 1513*a*, 1513*b*) in side profile (e.g., side profile 1521).

Figure 33:
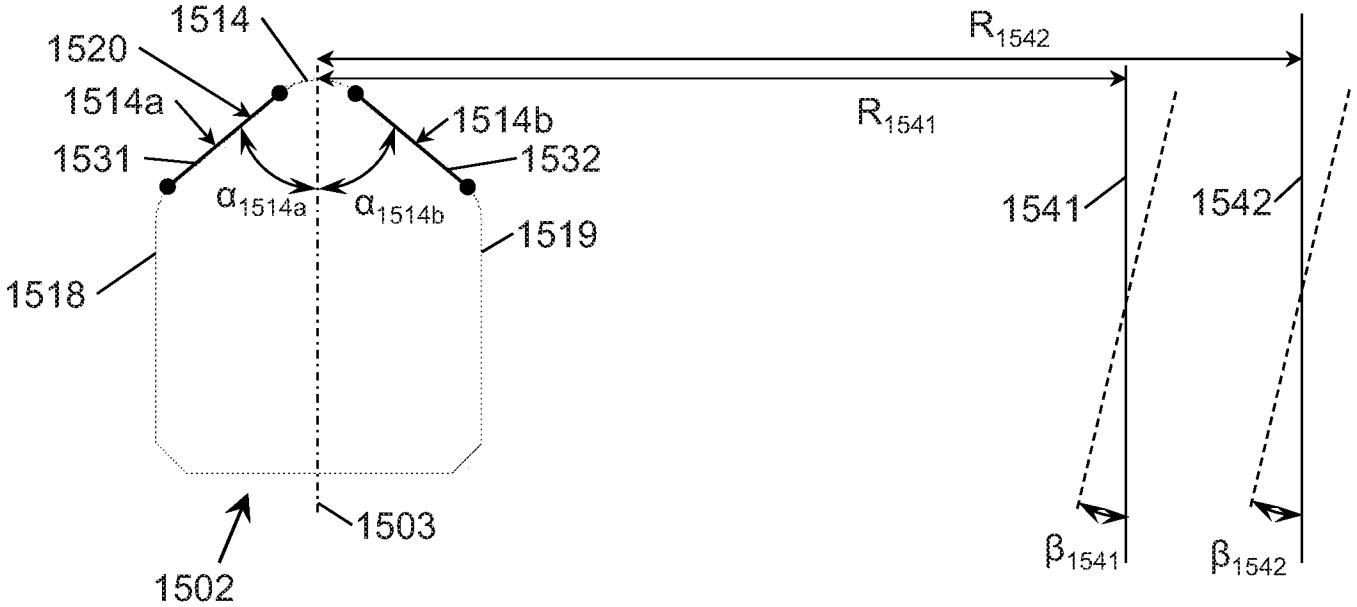
FIG. 33 is a cross-sectional front view of the insert of FIGS. 32A-32D illustrating the front profile of the insert of FIGS. 32A-32D.

Referring now to FIG. 33, a cross-sectional view of insert 1500 taken in reference plane $P_{1500}$ shown in the top view of FIG. 32B. Reference plane $P_{1500}$ contains central axis 1503 of base portion 1501 and bisects insert 1500 (e.g., reference plane $P_{1500}$ is equidistant from each end surface 1516, 1517 along axis 1515). In this embodiment, each flanking surface 1514*a*, 1514*b* is oriented at an acute angle $\alpha_{1514a}$, $\alpha_{1514b}$, respectively, relative to axis 1503 in the cross-sectional view shown in FIG. 33, as well as in the front profile 1520 shown in FIG. 32C. In this embodiment, angle $\alpha_{1514a}$ between axis 1503 and flanking surface 1514*a* is equal to angle $\alpha_{1514b}$ between axis 1503 and flanking surface 1514*b*, and in this embodiment, each angle $\alpha_{1514a}$, $\alpha_{1514b}$ is 45°. However, as previously described, in general, the acute angle between the central axis of the base portion and each flanking surface (e.g., angles $\alpha_{1514a}$, $\alpha_{1514b}$ between axis 1503 and flanking surfaces 1514*a*, 1514*b*) in the cross-sectional front view can be the same or different, and further, can be greater or less than 45°. In some embodiments, the acute angle between the central axis of the base portion and each flanking surface (e.g., each angle $\alpha_{1514a}$, $\alpha_{1514b}$) in the reference plane containing the central axis of the base portion and bisecting the insert (e.g., reference plane $P_{1400}$) is greater than 0° and less than or equal to 60°.

Referring still to FIG. 33, in this embodiment, each flanking surface 1514*a*, 1514*b* is defined by a corresponding line segment 1531, 1532, respectively, rotated about a corresponding axis 1541, 1542, respectively, between ends 1505*a*, 1505*b* and associated corners 1513*a*, 1513*b*. For purposes of clarity, line segments 1531, 1532 are shown in bold and with dots identifying the ends of each line segment 1531, 1532 in FIG. 33. Each axis 1541, 1542 is disposed within reference plane $P_{1500}$ at a distance or radius $R_{1541}$, $R_{1542}$, respectively, measured perpendicular to central axis 1503 of base portion 1501 from peaked ridge 1514 to axis 1541, 1542, respectively. In embodiments described herein, radii $R_{1541}$, $R_{1542}$ are different. For example, in this embodiment, radius $R_{1541}$ is greater than radius $R_{1542}$. In other embodiments, radius $R_{1541}$ may be less than radius $R_{1542}$. In addition, in this embodiment, each axis 1541, 1542 is oriented parallel to central axis 1503 of base portion 1501. However, in general, axis 1541 may be oriented parallel to central axis 1503 or at an acute angle $\beta_{1541}$ relative to axis 1503 (within reference plane $P_{1500}$) and axis 1542 may be oriented parallel to central axis 1503 or at an acute angle $\beta_{1542}$ relative to axis 1503 (within reference plane $P_{1500}$) as shown with dashed lines in FIG. 33. It should be appreciated that each angle $\beta_{1541}$, $\beta_{1542}$ can be positive or negative depending on whether the corresponding axis 1541, 1542, respectively, is tilted toward or away from axis 1503 moving from base portions 1502 to formation engaging portions 1505 when viewed in reference plane $P_{1500}$. In general, each angle $\beta_{1541}$, $\beta_{1542}$ can be the same or different. In some embodiments, the acute angle between the central axis of the base portion and the axis about which a curve is rotated to define a corresponding flanking surface (e.g., each angle $\beta_{1541}$, $\beta_{1542}$) taken in the reference plane containing the central axis of the base portion and bisecting the insert (e.g., reference plane $P_{1400}$) is between +30° and −30°

As previously described, flanking surfaces 1514*a*, 1514*b* are defined by rotating a corresponding line segment 1531, 1532, respectively, about axis 1541, 1542, respectively. In this embodiment, each line segment 1531, 1532 is a straight or linear line segment. However, in other embodiments, each line segment defining a flanking surface of the crown (e.g., each line segment 1531, 1532) can be linear, curved (e.g., concave or convex), or combinations thereof (e.g., include a linear section and a curved section).

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An insert for a drill bit, the insert comprising:

a base portion having a central axis and defining a bottom portion of the insert;

a formation engaging portion extending from the base portion and defining an upper portion of the insert, wherein the formation engaging portion comprises:

a crown with an elongate peaked ridge extending from a first end of the formation engaging portion to a second end of the formation engaging portion;

a first flanking surface extending from the peaked ridge to a first lateral side of the formation engaging portion; and a second flanking surface extending from the peaked ridge to a second lateral side of the formation engaging portion, wherein the first lateral side extends from the first end to the second end and the second lateral side extends from the first end to the second end;

wherein the first flanking surface is defined by a first line segment in a front profile view of the insert rotated about a first axis from the first end to the second end, wherein the first axis is disposed in a reference plane that bisects the base portion and contains the central axis of the base portion, wherein the first axis is disposed at a first radius measured in the reference plane and perpendicular to the central axis from a top of the peaked ridge to the first axis;

wherein the second flanking surface is defined by a second line segment in the front profile view of the insert rotated about a second axis from the first end to the second end, wherein the second axis is disposed in the reference plane, wherein the second axis is disposed at a second radius measured in the reference plane and perpendicular to the central axis from the top of the peaked ridge to the second axis;

wherein the first radius is different from the second radius.

2. The insert of claim 1, wherein the first axis is oriented parallel to the central axis of the base portion.

3. The insert of claim 2, wherein the second axis is oriented parallel to the central axis of the base portion.

4. The insert of claim 1, wherein the first axis is oriented at an acute angle β relative to the central axis of the base portion in the reference plane.

5. The insert of claim 4, wherein the angle β is between −30° and +30°.

6. The insert of claim 1, wherein the first line segment is linear in the front profile view; and wherein an angle α measured between the central axis of the base portion and the first flanking surface in the reference plane is greater than 0° and less than or equal to 60°.

7. The insert of claim 1, wherein the base portion is cylindrical.

8. The insert of claim 1, wherein the first line segment is concave, convex, or linear in the front profile view; and wherein the second line segment is concave, convex, or linear in the front profile view.

9. The insert of claim 1, wherein the formation engaging portion has a longitudinal axis extending between the first end and the second end in top view, wherein the insert has a width measured perpendicular to the longitudinal axis in top view from the first lateral side to the second lateral side, wherein the width of the insert increases moving longitudinally from the first end and the width of the insert increases moving longitudinally from the second end.

10. The insert of claim 1, wherein the formation engaging portion has a longitudinal axis extending between the first end and the second end in top view, wherein the insert has a width measured perpendicular to the longitudinal axis in top view from the first lateral side to the second lateral side, wherein the width of the insert decreases moving longitudinally from or proximal the first end toward a middle of the insert relative to the longitudinal axis in top view and the width of the insert decreases moving longitudinally from proximal the second end toward the middle of the insert.

11. The insert of claim 1, wherein the formation engaging portion has a longitudinal axis extending between the first end and the second end in top view, wherein the insert has a width measured perpendicular to the longitudinal axis in top view from the first lateral side to the second lateral side, wherein the width of the insert at the first end is greater than the width of the insert at the second end.

12. The insert of claim 1, wherein the peaked ridge is concave or convex in side view of the insert.

13. The drill bit of claim 1, wherein the first line segment includes a linear section and a curved section in the front profile view; and wherein the second line segment includes a linear section and a curved section in the front profile view.

14. A drill bit for drilling a borehole in an earthen formation, the bit having a central axis and a cutting direction of rotation, the bit comprising:

a bit body configured to rotate about the axis in the cutting direction of rotation, wherein the bit body includes a bit face;

a blade extending radially along the bit face;

an insert mounted to a surface of the blade, wherein the insert comprises:

a base portion seated in a recess in the surface of the blade;

a formation engaging portion extending from the base portion and the surface of the blade, wherein the formation engaging portion comprises:

a crown with an elongate peaked ridge extending from a first end of the formation engaging portion to a second end of the formation engaging portion;

a first flanking surface extending from the peaked ridge to a first lateral side of the formation engaging portion; and a second flanking surface extending from the peaked ridge to a second lateral side of the formation engaging portion wherein the first lateral side extends from the first end to the second end and the second lateral side extends from the first end to the second end;

wherein the first flanking surface is defined by a first line segment in a front profile view of the insert rotated about a first axis from the first end to the second end, wherein the first axis is disposed in a reference plane that bisects the base portion and contains the central axis of the base portion, wherein the first axis is disposed at a first radius measured in the reference plane and perpendicular to the central axis from a top of the peaked ridge to the first axis;

wherein the second flanking surface is defined by a second line segment in the front profile view of the insert rotated about a second axis from the first end to the second end, wherein the second axis is disposed in the reference plane, wherein the second axis is disposed at a second radius measured in the reference plane and perpendicular to the central axis from the top of the peaked ridge to the second axis;

wherein the first radius is different from the second radius.

15. An insert for a drill bit, the insert comprising:

a base portion;

a formation engaging portion extending from the base portion, wherein the formation engaging portion has a longitudinal axis and includes a first end, a second end opposite the first end, a first lateral side extending from the first end to the second end, and a second lateral side extending from the first end to the second end, and an elongate crown extending longitudinally from the first end to the second end and laterally from the first lateral side to the second lateral side;

wherein the first lateral side comprises a concave surface extending from the first end to the second end and having a first radius of curvature in top view of the insert and the second lateral side comprises a convex surface extending from the first end to the second end and having a second radius of curvature in top view of the insert, wherein the first radius of curvature of the concave surface is different than the second radius of curvature of the convex surface; and wherein the insert has a width measured perpendicular to the longitudinal axis from the first lateral side to the second lateral side, wherein the width of the insert at the first end is greater than the width of the insert at the second end.

16. The insert of claim 15, wherein the width of the insert increases moving longitudinally from the first end and the width of the insert increases moving longitudinally from the second end.

17. The insert of claim 15, wherein the width of the insert decreases moving longitudinally from proximal the first end toward a middle of the insert relative to the longitudinal axis in top view and the width of the insert decreases moving longitudinally from proximal the second end toward the middle of the insert.

18. The insert of claim 15, wherein the width of the insert decreases continuously moving longitudinally from proximal the first end to proximal the second end.

19. The insert of claim 15, wherein the first end comprises a planar surface and the second end comprises a planar surface.

20. The insert of claim 15, wherein the elongate crown includes a peaked ridge extending longitudinally from the first end to the second end, wherein the peaked ridge defines an extension height for the insert, and wherein the elongated crown has a radius of curvature in a front profile of the insert.

21. The insert of claim 20, wherein the peaked ridge is concave or convex in side view of the insert.

22. The insert of claim 15, wherein the elongate crown comprises a planar surface extending longitudinally from the first end to the second end.

23. A drill bit for drilling a borehole in an earthen formation, the bit having a central axis and a cutting direction of rotation, the bit comprising:

a bit body configured to rotate about the axis in the cutting direction of rotation, wherein the bit body includes a bit face;

a blade extending radially along the bit face;

the insert of claim 15 mounted to a surface of the blade.

24. The drill bit of claim 23, further comprising:

a plurality of cutter elements mounted to the surface of the blade, wherein each cutter element includes a forward-facing cutting face;

wherein the insert trails the plurality of cutter elements mounted to the blade relative to the cutting direction of rotation.

* * * * *